US012458090B2

(12) United States Patent
Walsh

(10) Patent No.: US 12,458,090 B2
(45) Date of Patent: Nov. 4, 2025

(54) SYSTEMS AND METHODS FOR HAIR EXTENSIONS

(71) Applicant: Adelyn Faye Innovations LLC, Downers Grove, IL (US)

(72) Inventor: Melissa Anne Walsh, Downers Grove, IL (US)

(73) Assignee: Adelyn Faye Innovations LLC, Downers Grove, IL (US)

( * ) Notice: Subject to any disclaimer, the term of this patent is extended or adjusted under 35 U.S.C. 154(b) by 0 days.

(21) Appl. No.: 19/075,218

(22) Filed: Mar. 10, 2025

(65) Prior Publication Data

US 2025/0280909 A1 Sep. 11, 2025

Related U.S. Application Data

(60) Provisional application No. 63/755,523, filed on Feb. 7, 2025, provisional application No. 63/563,950, filed on Mar. 11, 2024.

(51) Int. Cl.
*A41G 5/00* (2006.01)

(52) U.S. Cl.
CPC ..... *A41G 5/0073* (2013.01); *A41G 5/006* (2013.01); *A41G 5/008* (2013.01)

(58) Field of Classification Search
CPC .... A41G 5/004; A41G 5/0046; A41G 5/0053; A41G 5/0073; A41G 5/006; A41G 5/008; A41G 5/0006; A41G 5/0013; A41G 5/002; A41G 5/0026
See application file for complete search history.

(56) References Cited

U.S. PATENT DOCUMENTS

| | | | | |
|---|---|---|---|---|
| 3,809,099 | A | 5/1974 | Goldberg et al. | |
| 4,037,274 | A | 7/1977 | Agosta | |
| 4,168,713 | A | 9/1979 | Agiotis | |
| 4,176,669 | A | 12/1979 | Levin | |
| 4,254,784 | A | 3/1981 | Nelson | |
| 5,722,434 | A | 3/1998 | Walker | |
| 5,741,336 | A | 4/1998 | Fraser | |
| 6,405,736 | B2 | 6/2002 | Townsend | |
| 6,634,366 | B1 * | 10/2003 | Simmons | A41G 5/0073 132/278 |
| 8,753,367 | B1 | 6/2014 | Costabile | |

(Continued)

FOREIGN PATENT DOCUMENTS

| | | | |
|---|---|---|---|
| DE | 202020102478 | U1 | 6/2020 |
| EP | 3434124 | A1 | 1/2019 |

(Continued)

*Primary Examiner* — Rachel R Steitz
(74) *Attorney, Agent, or Firm* — Nixon Peabody LLP

(57) ABSTRACT

A substrate is coupled to a scalp of a user and a hair extension element is attached to the substrate. The substrate can be permanently or temporarily attached to the scalp using various techniques, such as adhesive, piercing, or sewing. The substrate may be made of a mesh material. The substrate may include a first coupling mechanism that interacts with a second coupling mechanism on the hair extension element. These coupling mechanisms can include zippers, interlocking mechanisms, magnetic elements, snaps, fasteners, or a combination thereof to facilitate easy and secure attachment. The hair extension can be removably, semi-permanently, or permanently bonded to the substrate.

18 Claims, 38 Drawing Sheets

(56) References Cited

U.S. PATENT DOCUMENTS

| | | | | |
|---|---|---|---|---|
| 8,794,246 | B2 * | 8/2014 | Springfield-Thomas | A41G 5/0053 132/201 |
| 10,010,125 | B1 * | 7/2018 | Maman | A41G 5/00 |
| 10,334,901 | B1 | 7/2019 | Brooks | |
| 10,750,809 | B2 | 8/2020 | Kim et al. | |
| 2001/0037813 | A1 | 11/2001 | Ra | |
| 2002/0179108 | A1 | 12/2002 | Harrison | |
| 2005/0252517 | A1 | 11/2005 | Salinas | |
| 2005/0252518 | A1 | 11/2005 | Salinas | |
| 2009/0014023 | A1 | 1/2009 | Waters | |
| 2010/0170523 | A1 | 7/2010 | Depalma | |
| 2010/0236568 | A1 | 9/2010 | Betts | |
| 2012/0260933 | A1 | 10/2012 | Ourique et al. | |
| 2013/0167858 | A1 | 7/2013 | Lee | |
| 2013/0199554 | A1 | 8/2013 | Dimitriou | |
| 2013/0263871 | A1 | 10/2013 | Glass | |
| 2014/0261529 | A1 | 9/2014 | Carvalho | |
| 2016/0120252 | A1 | 5/2016 | Kenna | |
| 2016/0135531 | A1 | 5/2016 | Ezechukwu | |
| 2016/0143381 | A1 | 5/2016 | Helmers et al. | |
| 2017/0055616 | A1 | 3/2017 | Swoope | |
| 2017/0215506 | A1 | 8/2017 | Sim | |
| 2018/0070664 | A1 | 3/2018 | Hazan | |
| 2018/0146732 | A1 | 5/2018 | Gucciardi | |
| 2019/0059488 | A1 | 2/2019 | Kim | |
| 2019/0090567 | A1 | 3/2019 | Johnson | |
| 2019/0166938 | A1 | 6/2019 | Bendavid | |
| 2019/0208849 | A1 | 7/2019 | Maman | |
| 2019/0254372 | A1 | 8/2019 | Rigby et al. | |
| 2019/0281912 | A1 | 9/2019 | Mayer et al. | |
| 2020/0113262 | A1 | 4/2020 | Tokko | |
| 2020/0154807 | A1 | 5/2020 | Guenter | |
| 2023/0225440 | A1 * | 7/2023 | Kalantari | A41G 5/0073 132/201 |

FOREIGN PATENT DOCUMENTS

| | | | |
|---|---|---|---|
| EP | 3434125 | A1 | 1/2019 |
| EP | 3524077 | A1 | 8/2019 |
| EP | 3935982 | A1 | 1/2022 |
| WO | 9851173 | A1 | 11/1998 |
| WO | 2020033392 | A1 | 2/2020 |

* cited by examiner

SYSTEMS AND METHODS FOR HAIR EXTENSIONS

RELATED APPLICATIONS

This application claims priority to and the benefit of U.S. Provisional Application No. 63/563,950, filed on Mar. 11, 2024, and U.S. Provisional Application No. 63/755,523, filed on Feb. 7, 2025, each of which is hereby incorporated by reference herein in its entirety.

TECHNICAL FIELD

The present disclosure relates generally to systems and methods for hair extensions, and more particularly, to systems and methods for permanent and semi-permanent bases for coupling with hair extensions, hair wefts, toppers, wigs, or the like.

BACKGROUND

Typical hair extensions or hair wefts are coupled to a base formed from hair of the user and as the hair base of the user grows, the hair extensions coupled thereto also grow out relative to the scalp of the user. This requires routine maintenance and costs about every 4-8 weeks to maintain the desired look of the hair extensions. Also, the hair extensions add bulk and weight to the user's head and because the hair extensions are typically sewn to the hair base or taped/glued into/onto the hair of the user, the hair extensions are worn by the user all day and night long until removed. As such, the user needs to wash, rinse, and dry their natural hair along with the hair extensions every time they wash, rinse, and dry their natural hair. In some circumstances, the user may not have sufficient hair for coupling typical hair extensions or hair wefts to a hair base. As such, a user lacking sufficient hair may not be able to secure typical hair extensions to their head. The present disclosure is directed to solving these and other problems.

SUMMARY

According to some implementations of the present disclosure, a method is provided. The method includes coupling a substrate to a scalp of a user and coupling a hair extension element to the substrate.

According to some implementations of the present disclosure, a hair extension system is disclosed. The system includes a substrate configured to be coupled to a scalp of a user and a hair extension element configured to be coupled to the substrate.

According to some implementations of the present disclosure, a hair extension system includes: a foundation with (i) a plurality of implants configured to be positioned about a head of a user, and (ii) a wire coupled to each of the plurality of implants; and a hair extension coupled to the foundation.

According to some implementations of the present disclosure, a hair extension system includes a foundation with (i) a first implant configured to be positioned adjacent to a first ear of a user; (ii) a second implant configured to be positioned adjacent to a second ear of the user; (iii) a loop piercing configured to be positioned between the first implant and the second implant; and (iv) a wire coupled to the first implant, the second implant, and the loop piercing; and a hair extension coupled to the foundation.

According to some implementations of the present disclosure, a hair extension system includes a foundation configured to be coupled about a portion of a head of a user, the foundation has (i) a first substrate with a first surface that is configured to face the head of the user and a second opposing surface; and (ii) a first portion of an interlocking mechanism protruding from the second opposing surface of the first substrate; and a hair extension configured to be removably coupled to the foundation, the hair extension has (i) extension hair bundled together; (ii) a second substrate with a first surface that is configured to face the extension hair and a second opposing surface; and (iii) a second portion of the interlocking mechanism protruding from the second opposing surface of the second substrate.

According to some implementations of the present disclosure, a hair extension system includes a foundation configured to be coupled about a portion of a head of a user, the foundation has (i) a first substrate; and (ii) a first portion of a zipper mechanism coupled to the first substrate; and a hair extension configured to be removably coupled to the foundation, the hair extension has (i) a second substrate; (ii) extension hair bundled together and coupled to the second substrate; and (iii) a second portion of the zipper mechanism coupled to the second substrate.

According to some implementations of the present disclosure, an end clip configured to be used in a hair extension system, the end clip having a base having a first portion and a second portion with a necked portion between the first portion and the second portion; and a plurality of fingers extending from the second portion of the base.

The above summary is not intended to represent each implementation or every aspect of the present disclosure. Additional features and benefits of the present disclosure are apparent from the detailed description and figures set forth below.

Figure 1:
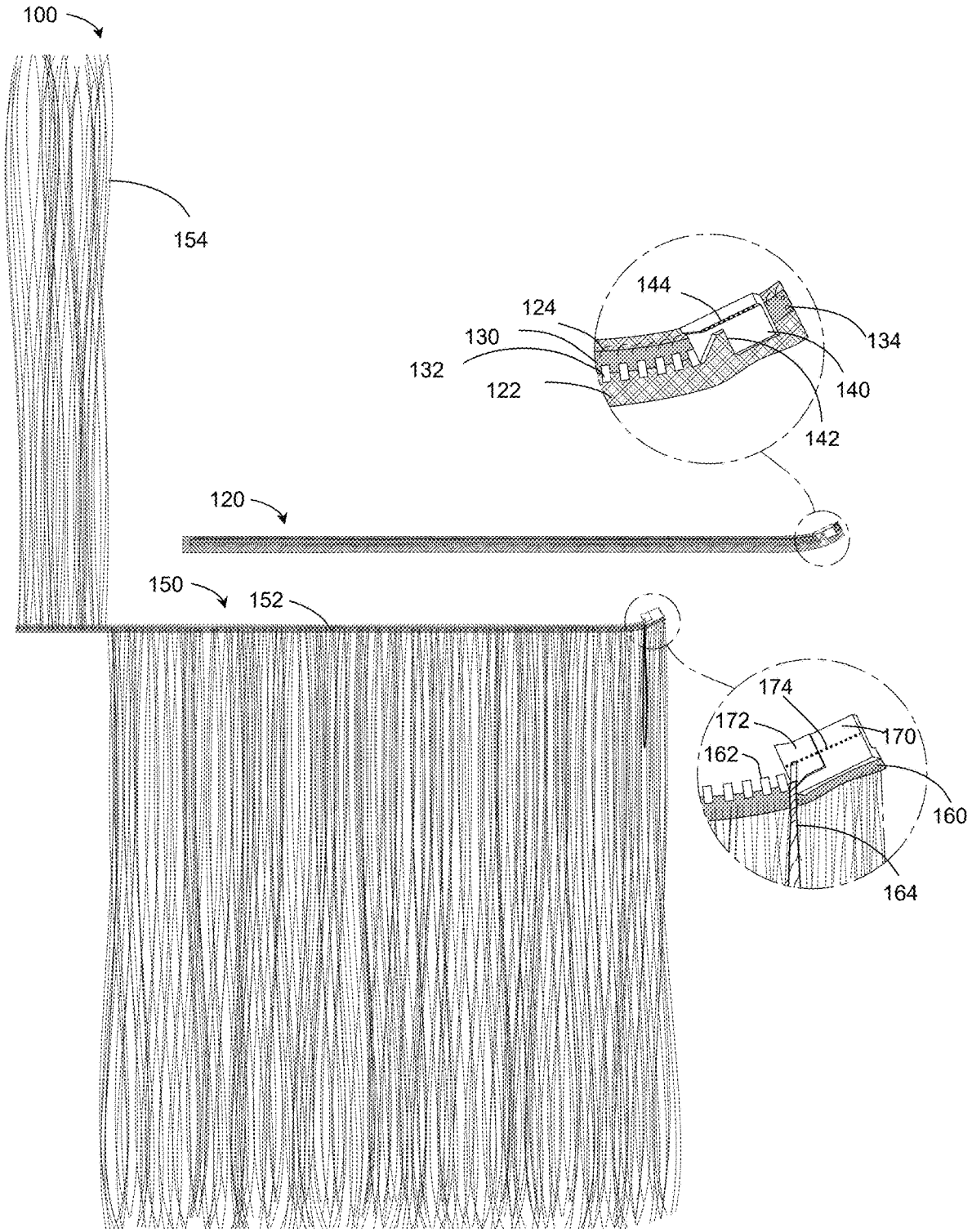
FIG. 1 is a front view of a hair extension system including a zipper fastening mechanism according to some implementations of the present disclosure.

While the present disclosure is susceptible to various modifications and alternative forms, specific implementations thereof have been shown by way of example in the drawings and will herein be described in detail. It should be understood, however, that it is not intended to limit the present disclosure to the particular forms disclosed, but on the contrary, the present disclosure is to cover all modifications, equivalents, and alternatives falling within the spirit and scope of the present disclosure as defined by the appended claims.

DETAILED DESCRIPTION

The present disclosure provides systems and methods for installing hair extension elements or hair weft elements to a head of a user (e.g., a client, a patient, a human, an animal, a subject, etc.) in semi-permanent, permanent, and removable fashions.

According to some implementations, the disclosed systems and methods for installing hair extension elements allow for users with varying hair lengths, hair density, and the absence of natural hair itself, to securely attach a hair extension element to the head of the user.

According to some implementations, a hair extension system includes a substrate configured to be coupled to the scalp of a user and a hair extension element configured to be coupled to the substrate.

In some implementations, the substrate is made of one or more materials, such as, for example, metal, plastic, rubber, glue, tape, magnetic strips, silicone, fabric, or any combination thereof. In some implementations, the substrate includes one or more layers of the same and/or different materials.

According to some implementations, the substrate is coupled to the scalp of the user in a permanent fashion. In some such implementations, the substrate is sewn, threaded, sutured, stitched, stapled, pierced, or any combination thereof to the scalp of the user with a thread or suture that is not readily biodegradable. In other words, the thread or suture that couples the substrate to the scalp of the user remains in place without dissolving or breaking apart until removed by a technician or a user, for example, to adjust or replace the hair extension system after a period of wear.

According to some implementations, the substrate is coupled to the scalp of the user in a semi-permanent fashion. In some such implementations, the substrate may be sewn, threaded, sutured, stitched, stapled, pierced, or any combination thereof to the scalp of the user with a thread or suture that is readily biodegradable. In other words, the thread or suture that couples the substrate to the scalp of the user may be configured to be absorbed into tissue of the user (e.g., into the tissue of the scalp of the user) and/or to be dissolved or broken up over a period of time (e.g., after a period of two weeks, after a period of one month, after a period of six months, after a period of a year, etc.).

The hair extension elements described herein can be customized to the needs of the user. In some implementations, the hair extension elements are configured to enhance the appearance of the user's natural hair by supplementing the natural hair of the user with hair extension elements sized and fitted to the user in a manner to complement the natural hair of the user. In some implementations, the hair extension elements are configured to act as a replacement or a substantial replacement to the user's natural hair, for example, for users who are not able to maintain natural hair due to illness or other conditions, when a user has thinned hair, hair loss, or the like. In this regard, the size and shape of the substrate and the hair extension elements can be adjusted to provide the user with hair extension elements that mimic the look and feel of natural hair. Accordingly, the hair extension elements and substrates described herein can be customized according to the needs of the user.

According to some implementations, the hair extension elements described herein are created by starting with a string and/or material that is positioned relatively horizontally. The string has no memory properties and is not rigid. Then strands of extension hair (e.g., one at time, two at a time, a bundle of hairs at a time) are tied (manually by hand and/or automatically using a machine) along the string to create a row of extension hair or a hair weft. Thereafter, the interface or junction of the extension hair and string is secured by (i) attaching a substrate to the interface, (ii) sewing the soft string about itself, the extension hair, the substrate, and/or the scalp of the user, (iii) applying an adhesive/glue, keratin, or the like to the interface, (iv) or any combination thereof.

In some implementations, and generally in the context of attaching a hair weft to a hair base, sewing generally refers to the use of thread to attach two items together by wrapping the thread about the items and/or through at least a portion of one or both items and/or by making stitches or ties or knots with the thread. In some such implementations, the thread is made of any suitable material, such as, for example, cotton, polyester, nylon, silk, or any combination thereof. In some implementations, and generally in the context of attaching an item (e.g., a hair weft, a substrate, a mesh, etc.) directly to skin of a user, stitching generally refers to the use of sutures to attach the item directly to the skin of the user. In some such implementations, the suture material is made of any suitable material, such as, for example, polyglycolic acid, cat gut, silk, nylon, polypropylene, or any combination thereof. In some such implementations, polyglycolic acid and/or cat gut are used for absorbable sutures, and silk, nylon, polypropylene, or any combination thereof are used for non-absorbable sutures.

In some implementations, in lieu of the string, the strands of extension hair are bonded directly to a substrate. The substrate may be of minimal dimensions necessary to appropriately bond to the strands of extension hair. In some implementations, the substrate is a thin layer of keratin glue or any other similar material.

In some implementations, in lieu of or in addition to using the string, a rigid wire is used. The rigid wire has memory properties such that the rigid wire can be bent and/or shaped into a structure/pattern that is relatively maintained over time. The rigid wire can have a thickness between about 0.03 millimeters to about 1 millimeter. As such, the hair extension can be molded and bent about the head of a user and hold that shape as desired by the installer. The rigid wire also aids in minimizing and/or reducing and/or eliminating a ripping effect that can occur with hair extensions that are sewn to foundations without such a rigid wire incorporated into the hair extension structure.

In some such implementations, the rigid wire is encapsulated in the hair extension by the extension hair, the substrate, the adhesive/glue, etc., or any combination thereof to aid in providing a cushion between the rigid wire and the scalp of the user.

Referring now to FIG. 1, a hair extension system 100 is illustrated. The hair extension system 100 includes a base 120 and a hair extension element 150. The base 120 is configured to be coupled to a user along, for example, a hair part running along a rear of the head of the user between respective temples of the user. The hair extension element 150 is configured to be coupled to the base 120. The base 120 includes a substrate 122 that serves as the foundation for the hair extension element 150 to be attached thereto. Similarly, the hair extension element 150 includes a substrate 152 to which extension hair 154 is bonded.

Attached to the substrate 122 is a zipper tape 130 with zipper teeth 132. The zipper tape 130 runs generally along the entire length of the base 120. A first end portion of the zipper tape 130 includes a first zipper stop element 140. As shown, the zipper tape 130 is coupled to the substrate 122 with a thread 124 with one or more stitches. Alternatively, the zipper tape 130 can be coupled to the substrate 122 by any other means, such as for example, adhesive, bonding, glue, etc., or any combination thereof.

The substrate 152 of the hair extension element 150 includes, is coupled with, and/or bonded to a zipper tape 160 with zipper teeth 162. The zipper tape 160 runs generally along the entire length of the hair extension element 150. A first end portion of the zipper tape 160 includes a second zipper stop element 170.

According to some implementations, to couple the extension hair element 150 to the base 120, the first zipper stop element 140 and the second zipper stop element 170 are brought together such that a zipper slider 172 aligns with a zipper notch 142 formed in the first zipper stop element 140. In some implementations, the first zipper stop element 140 includes a magnetic element 144 and the second zipper stop element 170 includes a corresponding magnetic element 174 that are configured to attract one another and facilitate an alignment of the second zipper stop element 170 with the first zipper stop element 140. According to some implementations, the magnetic element 144 and the magnetic element 174 attract one another to a sufficient degree to keep the first zipper stop element 140 engaged to the second zipper stop element 170 (e.g., with the zipper slider 172 aligned with the zipper notch 142) even while the zipper is in an unzipped configuration (e.g., when the zipper teeth 132 and the corresponding zipper teeth 162 are not interlocked).

According to some implementations, the first end portion of the zipper tape 130 includes apertures 134. The apertures 134 extend through the substrate 122. The apertures 134 allow a technician installing the hair extension system 100 and/or the user of hair extension system 100 to further secure the base 120 to the user. For example, in some implementations, thread is used to stitch a first end of the substrate 122 to the user so that the interface between hair extension element 150 and base 120 remains tightly, securely, and discreetly against the user during use. The number and size of the apertures 134 is varied. While two apertures are shown on a first end of the base 120, the base 120 can include one, two, three, four, or more apertures 134 on each respective end of the substrate 122.

To couple the hair extension element 150 to the base 120, a user of hair extension system 100 engages first zipper stop element 140 with the second zipper stop element 170 (e.g., by positioning the first magnetic element 144 sufficiently close to the second magnetic element 174), and then uses the zipper pull 164 to pull the zipper slider 172 along the zipper tape 160. As the zipper slider 172 moves across the zipper tape 160, the zipper teeth 132 interlock with the corresponding zipper teeth 162 thereby removably coupling the hair extension element 150 to the base 120.

The base 120 can couple to the user in a variety of manners. According to some implementations, the base 120 is attached to a hair base formed using natural hair of the user (e.g., hair that has grown from the head of the user and is still attached and not fallen out, yet). In some implementations, the base 120 is attached to the skin and/or scalp of the user, for example, to the skin/scalp of the user that is exposed along a hair part line established between, for example, respective temples of the user along the back of the head of the user (hereinafter referred to as a "scalp base"). The base 120 can be attached to the hair base and/or the scalp base of the user using a variety of methods and materials including thread, sutures, stitches, staples, adhesives, piercings, or any combination thereof.

While the hair extension system 100 has been described as having the zipper tape 130, 160 bonded to the substrate 122 of base 120 and the substrate 152 of hair extension element 150, in some alternative implementations, there are no separate substrates where the zipper tape itself acts as the substrate. Further, in some implementations, the base 120 is composed entirely of the substrate 122. In this regard, the base 120 can be composed of a mesh material, as is described in more detail with respect to FIG. 8.

Referring to FIGS. 2A-2J, a method of installing the hair extension system 100 to a hair base on the head of a user is illustrated. However, the base 120 of the hair extension system 100 can also be coupled to the head of the user using any of the other disclosed methodologies herein (e.g., to the scalp base of the user).

Figure 2A:
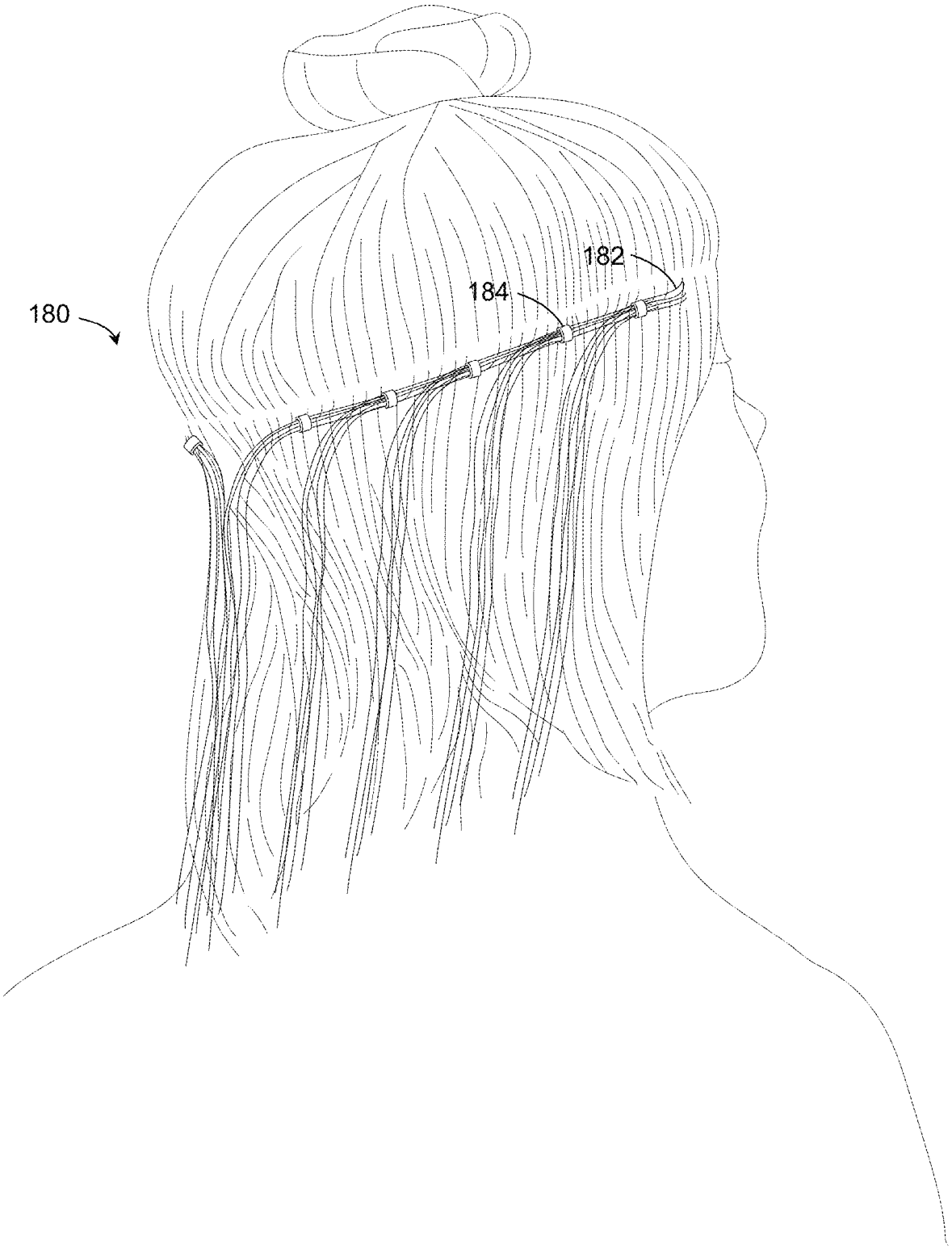
FIG. 2A illustrates a portion of a method of installing the hair extension system of FIG. 1 on a user according to some implementations of the present disclosure.

As illustrated in FIG. 2A, a hair base 180 is designed to securely hold the extension hair 154 in place while blending naturally with the user's existing hair. The hair base 180 is made from natural hair 182 and hair beads 184. The hair beads 184 are small, discreet components that attach to the natural hair 182. These beads are typically made from a lightweight material such as silicone and/or metal and are designed to be gentle on the hair while providing a secure hold. A first portion of natural hair with roots along the hair part of the user is threaded through a first hair bead closest to the roots of the first portion of natural hair. The first portion of natural hair is divided into a second portion that is allowed to hang down from the first hair bead and a third portion that is threaded through a successive, second hair bead. An additional fourth portion of natural hair with roots along the hair part of the user is threaded through the second hair bead along with the third portion of natural hair. This process continues in a similar manner until hair base 180 is formed. During use, the hair beads 184 remain tightly fixed to the natural hair 182, thereby ensuring that the hair base 180 does not move much relative to the scalp of the user.

Figure 2B:
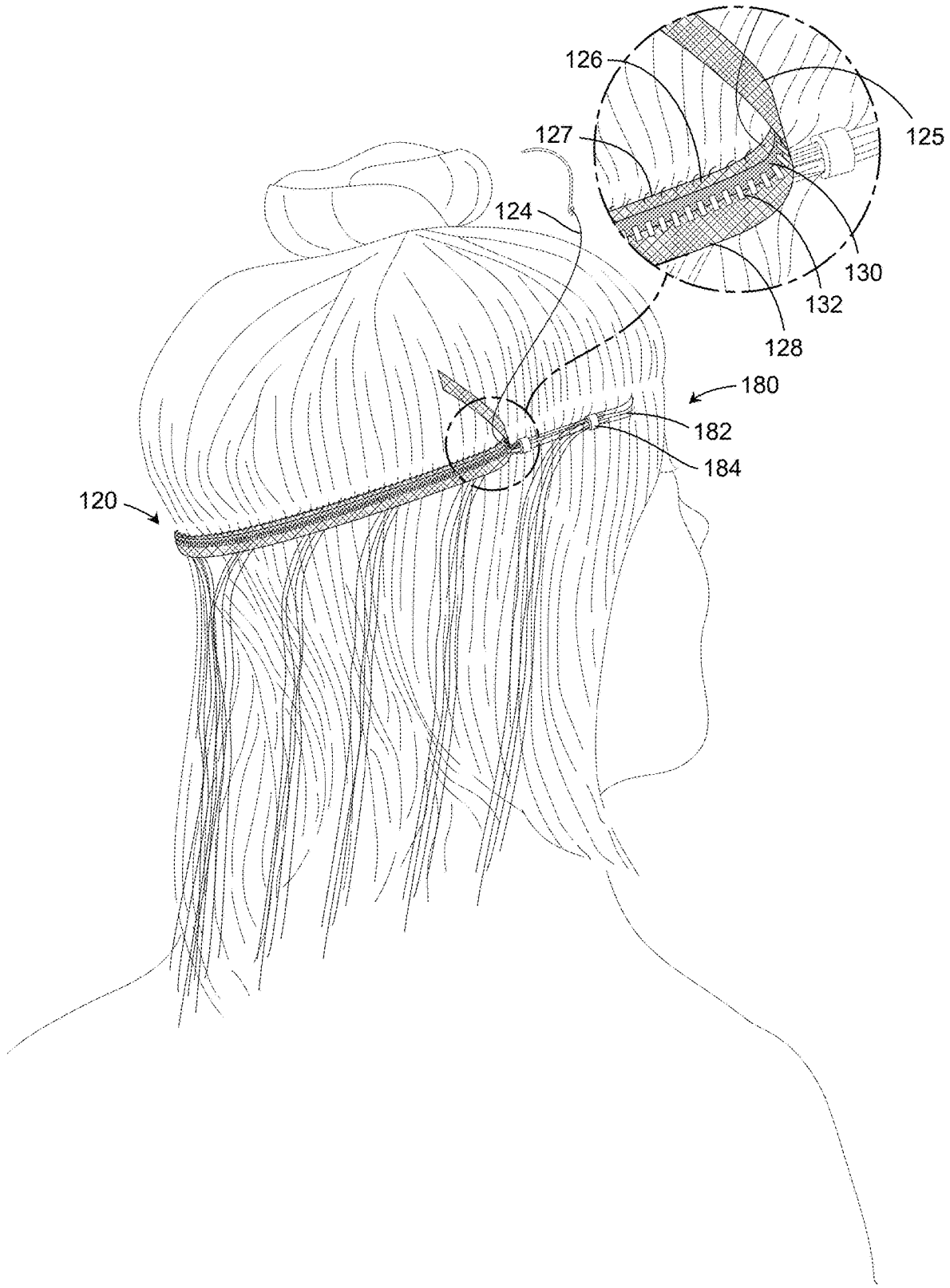
FIG. 2B illustrates another portion of the method of installing the hair extension system of FIG. 1 on a user according to some implementations of the present disclosure.

FIG. 2B illustrates an implementation of attaching the base 120 of the hair extension system 100 to the hair base 180. As shown, the thread 124, is used to secure the base 120 to the hair base 180. The thread 124 is threaded and stitched along a top edge 127 of the base 120 to secure the base 120 to the hair base 180. When attached, a first surface 125 of the base 120 faces the user's head, while a second surface 126 faces away from the head. Further, the top edge 127 and a bottom edge 128 of base 120 provide structural boundaries for the attachment of other components. For example, along the second surface 126, the zipper tape 130 is affixed. The zipper tape 130 includes the zipper teeth 132, which interlock with the corresponding zipper teeth 172 of the hair extension element 150 to secure the hair extension element 150 in place when the hair extension system 100 is in a worn configuration.

Figure 2C:
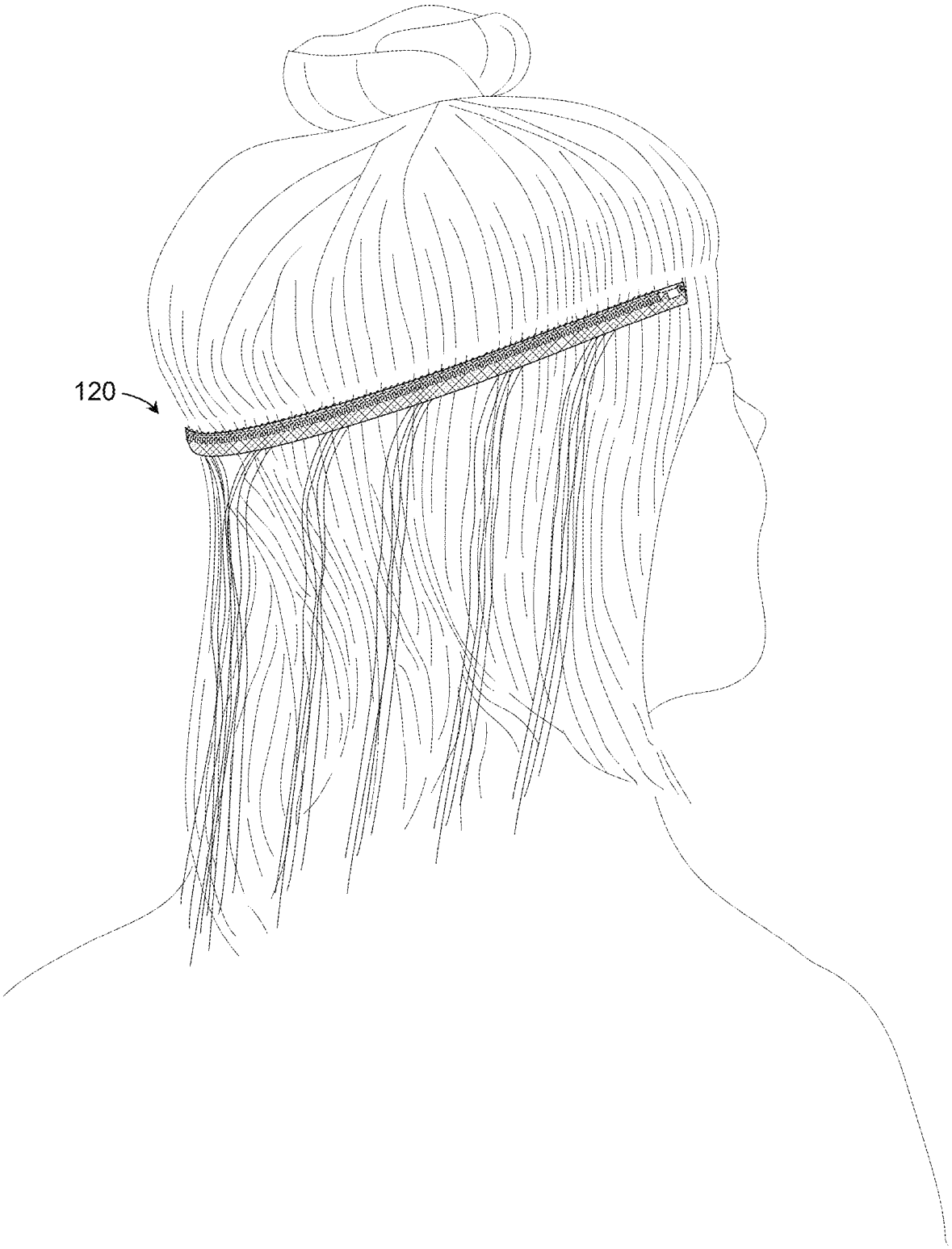
FIG. 2C illustrates another portion of the method of installing the hair extension system of FIG. 1 on a user according to some implementations of the present disclosure.
Figure 2D:
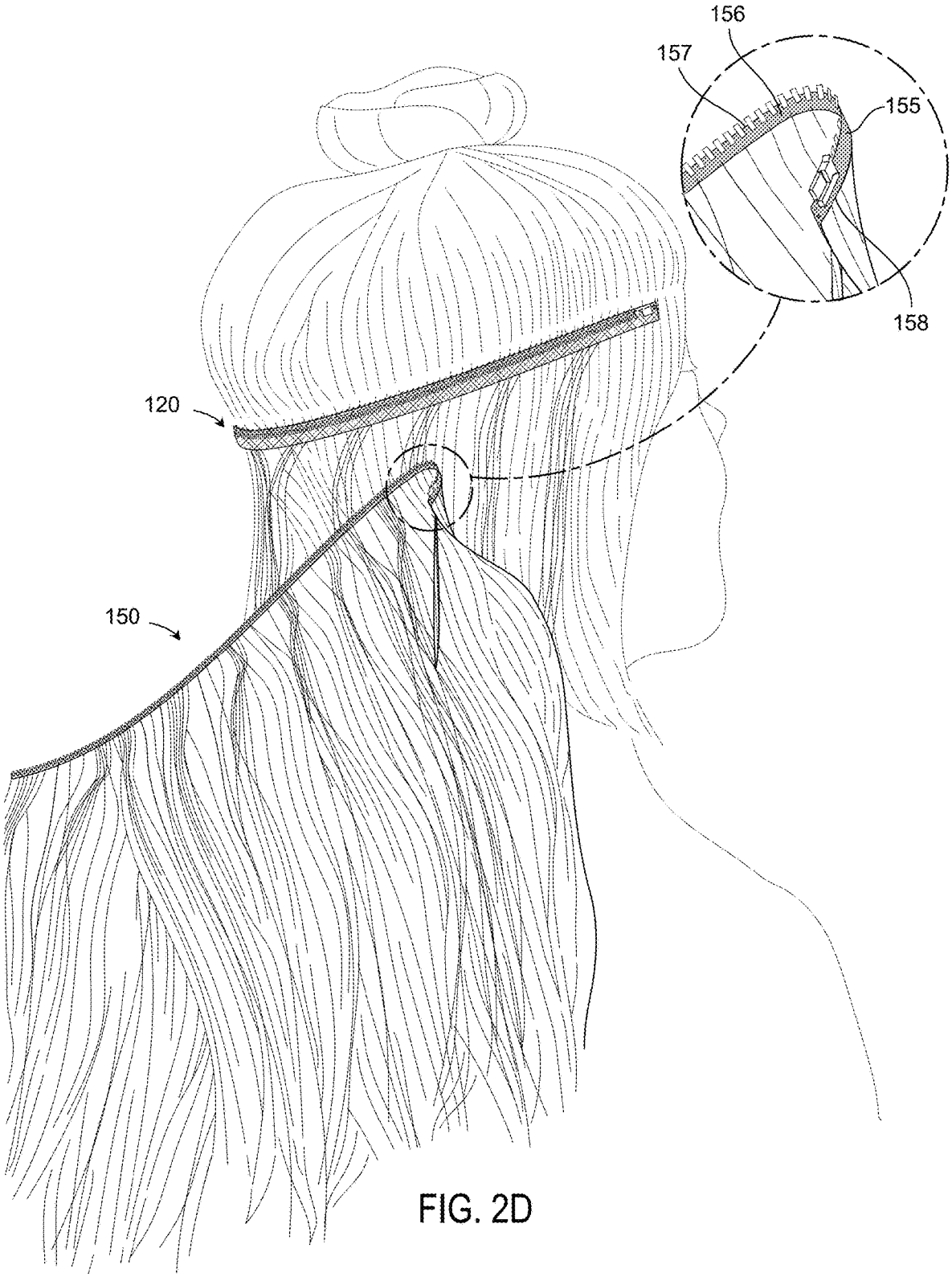
FIG. 2D illustrates another portion of the method of installing the hair extension system of FIG. 1 on a user according to some implementations of the present disclosure.

Referring to FIG. 2C, the hair extension system 100 is illustrated in its applied state on a user's head (e.g., coupled to the hair base 180). The base 120 is positioned along the hair base 180, ensuring a seamless integration with the natural hair. Following attachment of the base 120, FIG. 2D illustrates a process of attaching the hair extension element 150 to the base 120 that has been secured to the hair base 180 of the user. As illustrated in FIG. 2D, the hair extension element 150 includes a first surface 155, which faces the head when the device is worn, and a second surface 156, which faces away from the head. Further, the hair extension element 150 features a top edge 157 and a bottom edge 158, which provide structural boundaries for the attachment of other components.

Figure 2E:
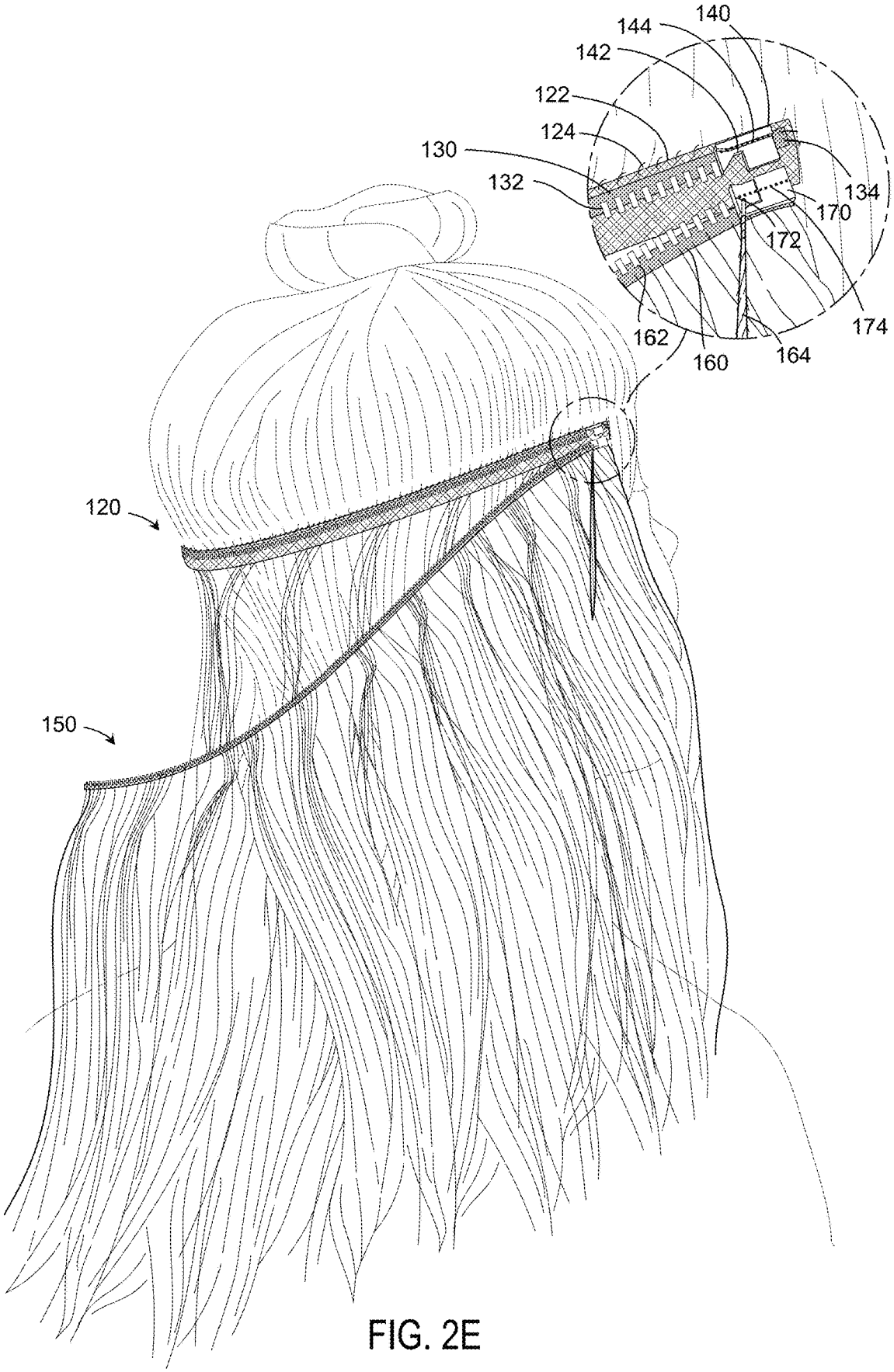
FIG. 2E illustrates another portion of the method of installing the hair extension system of FIG. 1 on a user according to some implementations of the present disclosure.

Referring to FIG. 2E, corresponding ends of the base 120 and the hair extension element 150 are brought together to begin the coupling process. At a sufficiently close distance, magnetic attraction between the magnetic element 144 and the magnetic element 174 causes the first zipper stop element 140 and the second zipper stop element 170 to couple.

The base 120 further includes the zipper tape 130, which is equipped with the zipper teeth 132. The zipper teeth 132 interlock with the corresponding zipper teeth 162 on the hair extension element 150, allowing for easy attachment and removal of the hair extension element 150. The zipper tape 130 is securely attached to the substrate 122.

The first zipper stop element 140 is provided at one end of the zipper tape 130 to facilitate the engagement of the zipper teeth 132 with the zipper teeth 162. Adjacent to the first the zipper stop element 140 is the zipper notch 142, which helps guide align the zipper slide 172 with the first zipper stop element 140 during the attachment process. The zipper pull 164 allows a user to easily move the zipper slide 172 to engage and disengage the zipper teeth 132 from the zipper teeth 162, allowing the hair extension element 150 to be attached or removed from the base 120. The zipper pull 164 is designed to be easy to use, even with one hand, making the hair extension system 100 convenient and user-friendly.

In addition to the zipper components, according to some implementations the base 120 includes apertures 134, which are used for additional securing mechanisms, such as clips or bobby pins, to provide extra stability to the hair extension system.

According to implementations, the hair extension element 150 includes the substrate 152, which is similar in construction to the substrate 122 of the base 120. The substrate 152 supports the extension hair 154, which is designed to blend seamlessly with the user's natural hair. The extension hair 154 is made from natural or synthetic fibers, depending on the desired look and feel.

The hair extension element 150 also includes the zipper tape 160, which is equipped with the zipper teeth 162 that correspond to the zipper teeth 132 on the base 120. The zipper tape 160 is securely attached to the substrate 152, ensuring the hair extension element 150 remains stable during use.

The magnetic element 144 and the magnetic element 174 which facilitate alignment of the first zipper stop element 140 and the second zipper stop element 170. The magnetic attraction between the magnetic element 144 and the magnetic element 174 also allow the first zipper stop element 140 to be retained within the second zipper stop element 170 when the zipper is in an unzipped configuration.

Figure 2F:
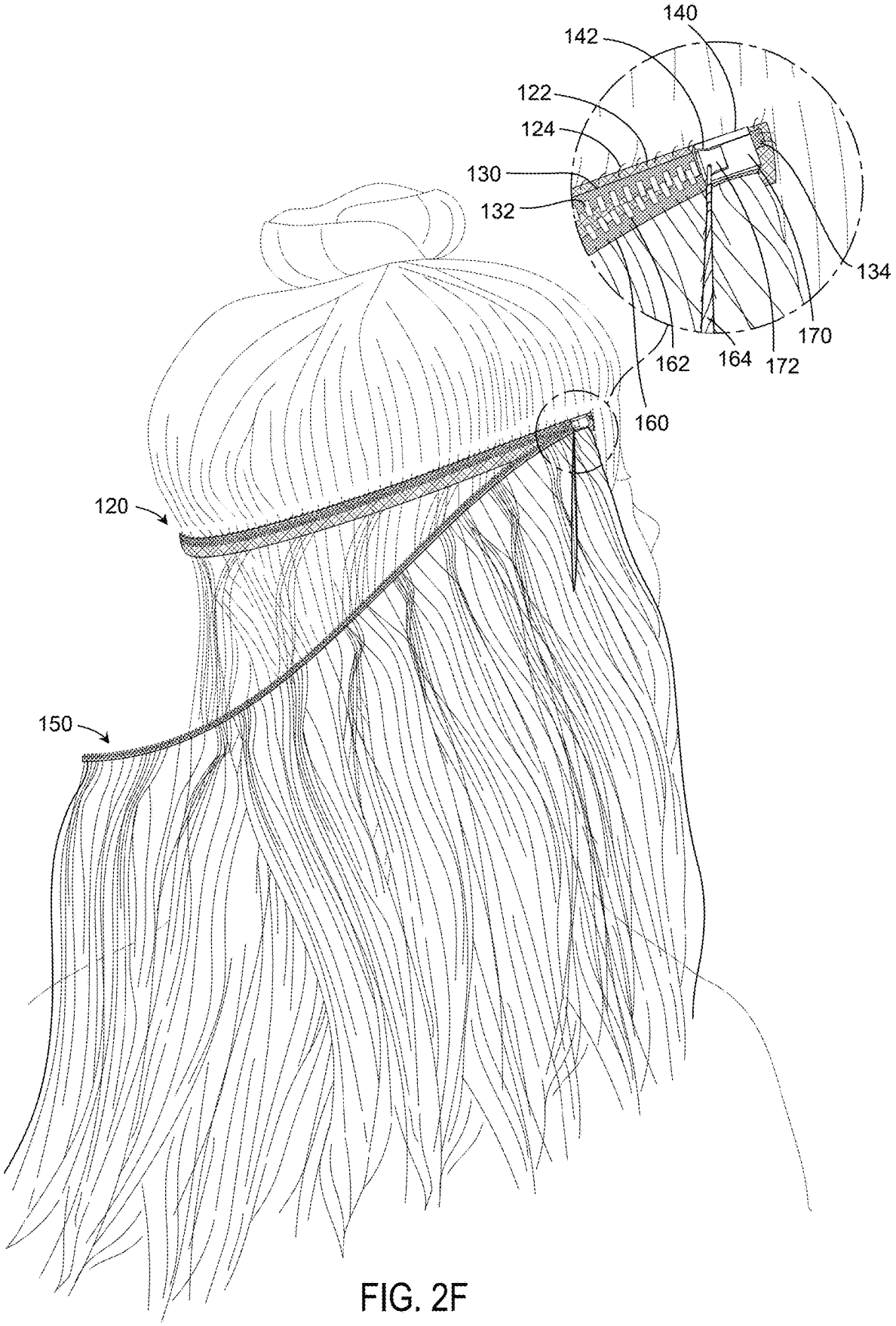
FIG. 2F illustrates another portion of the method of installing the hair extension system of FIG. 1 on a user according to some implementations of the present disclosure.
Figure 2G:
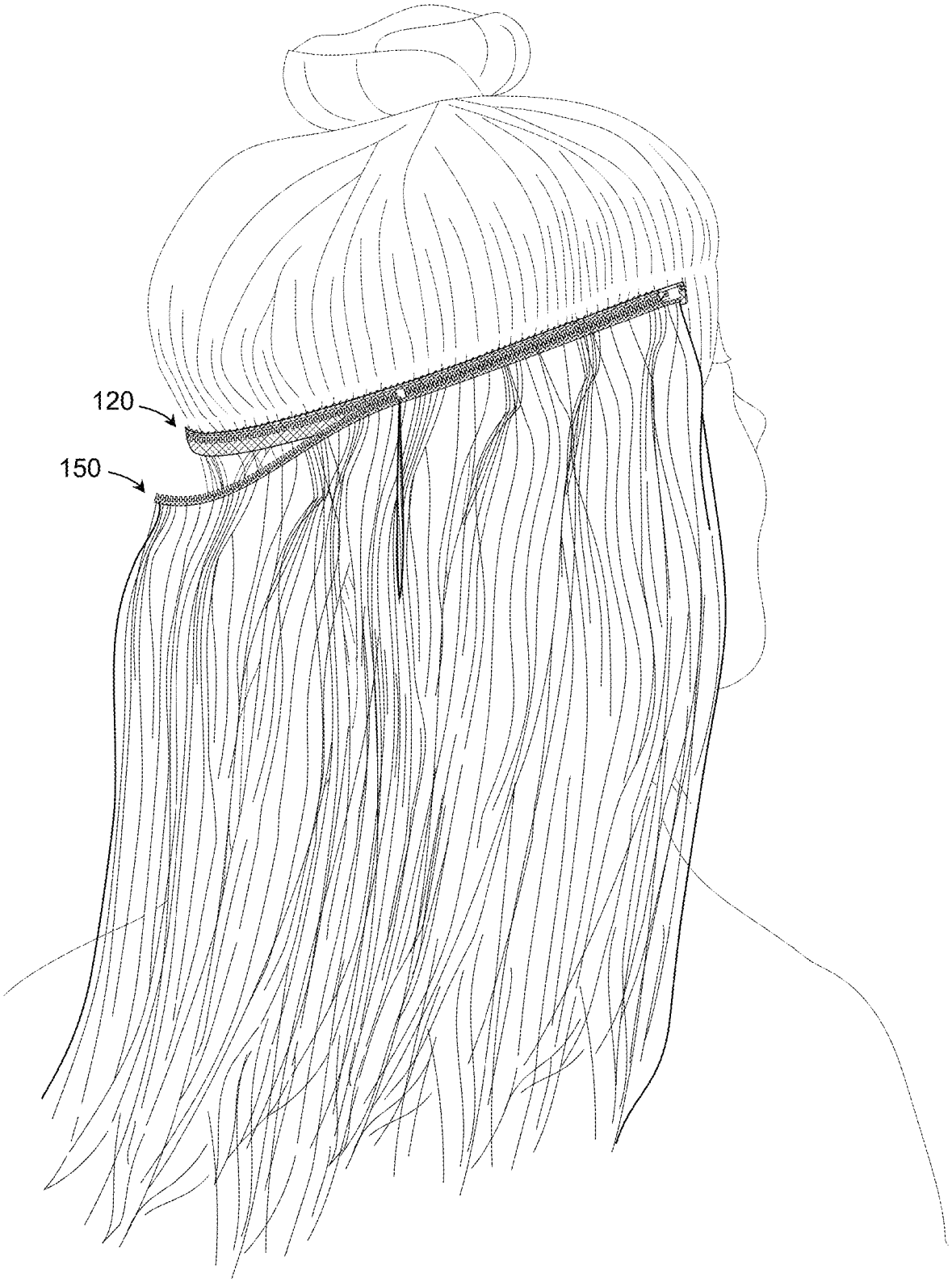
FIG. 2G illustrates another portion of the method of installing the hair extension system of FIG. 1 on a user according to some implementations of the present disclosure.
Figure 2H:
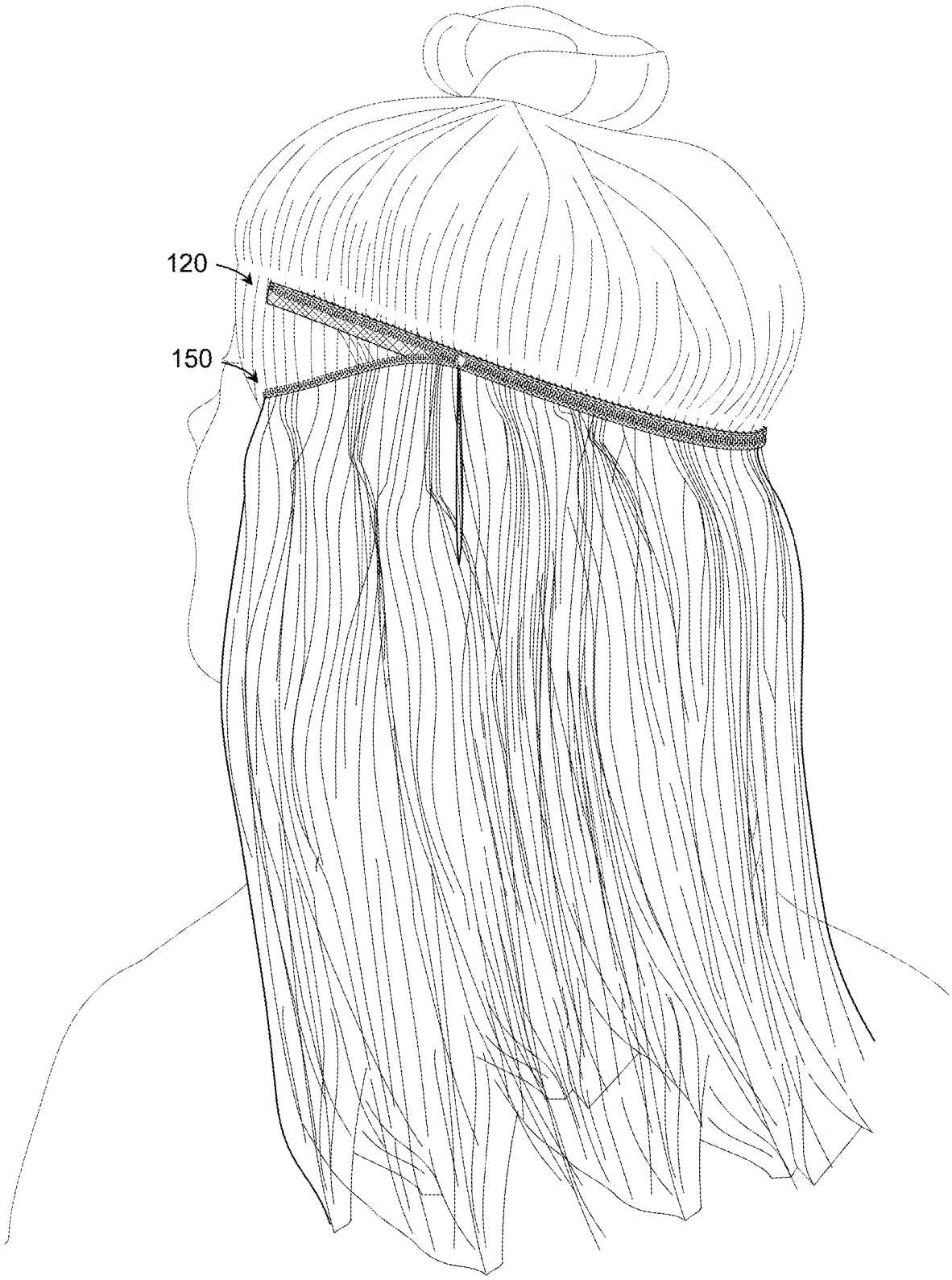
FIG. 2H illustrates another portion of the method of installing the hair extension system of FIG. 1 on a user according to some implementations of the present disclosure.
Figure 2I:
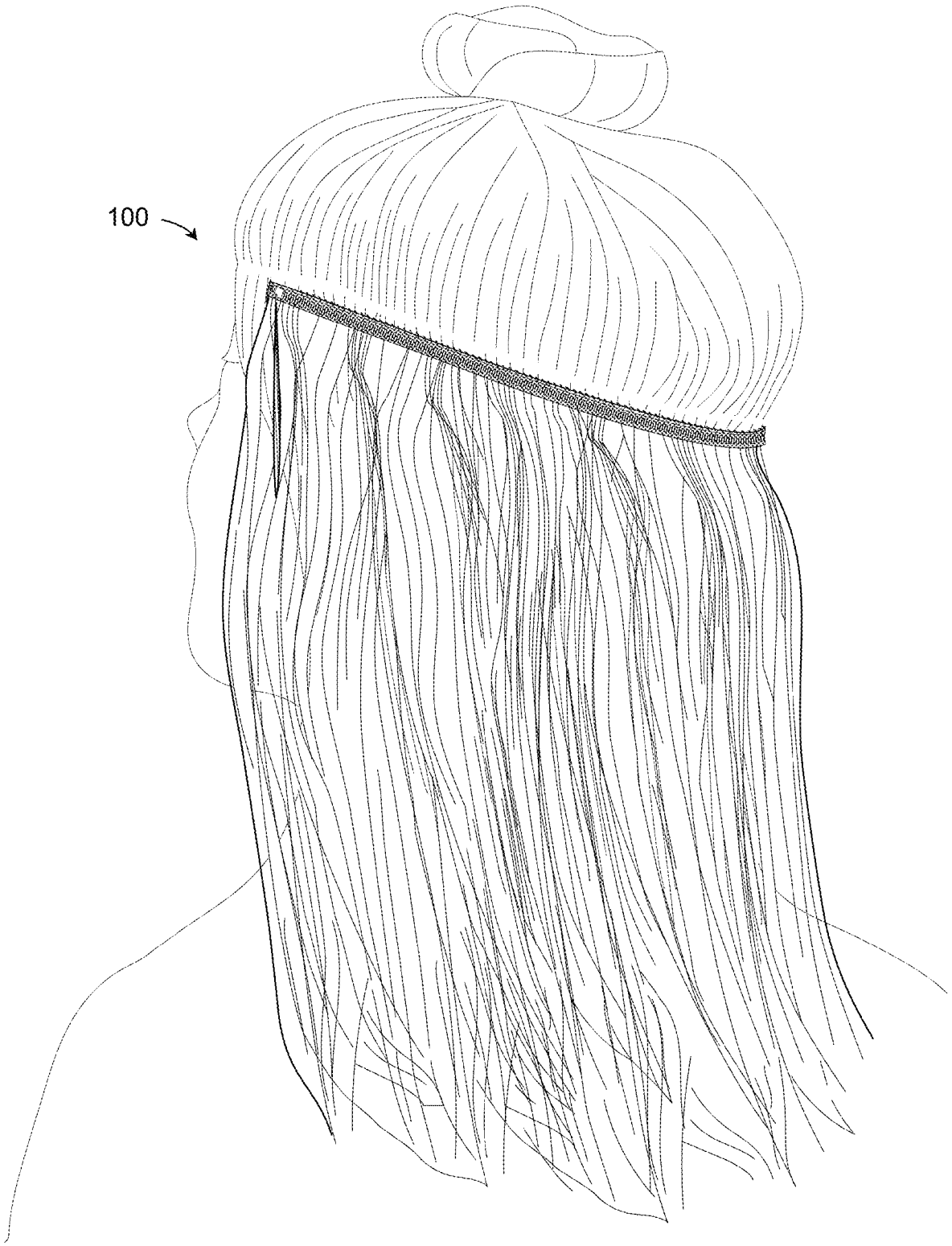
FIG. 2I illustrates another portion of the method of installing the hair extension system of FIG. 1 on a user according to some implementations of the present disclosure.
Figure 2J:
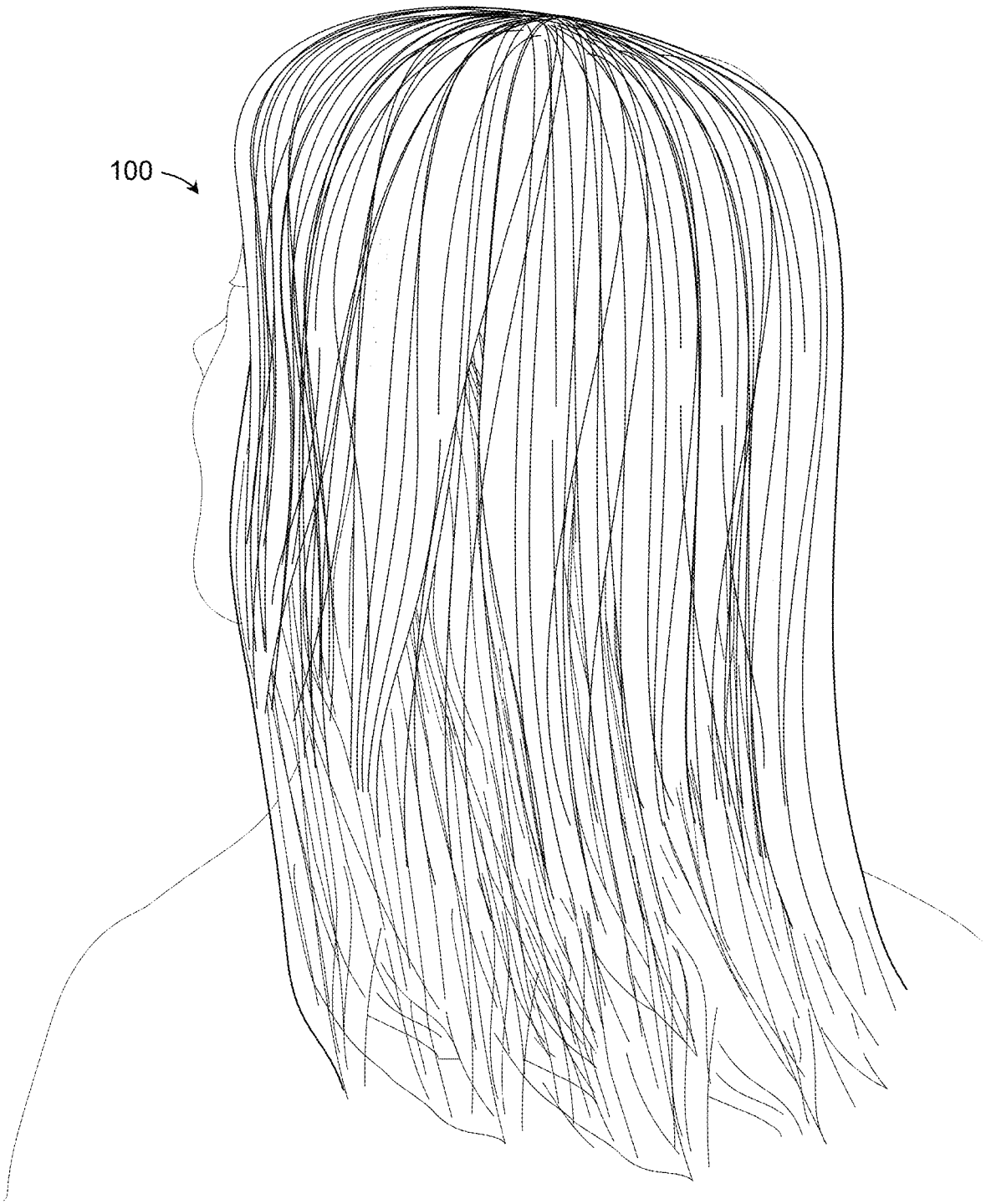
FIG. 2J illustrates another portion of the method of installing the hair extension system of FIG. 1 on a user according to some implementations of the present disclosure.

Referring now to FIGS. 2F-2H, once the second zipper stop element 170 has been properly aligned with the first zipper stop element 140 and engaged thereto, a user begins to pull the zipper pull 164 along the base 120 to detachably couple the base 120 to the hair extension element 150. FIG. 2I illustrates the hair extension system 100 fully coupled to the hair base 180 of a user. FIG. 2J illustrates hair extension system 100 fully coupled to the hair base 180 of a user, with the user's hair part unparted and the natural hair repositioned in its typical resting location.

Figure 3:
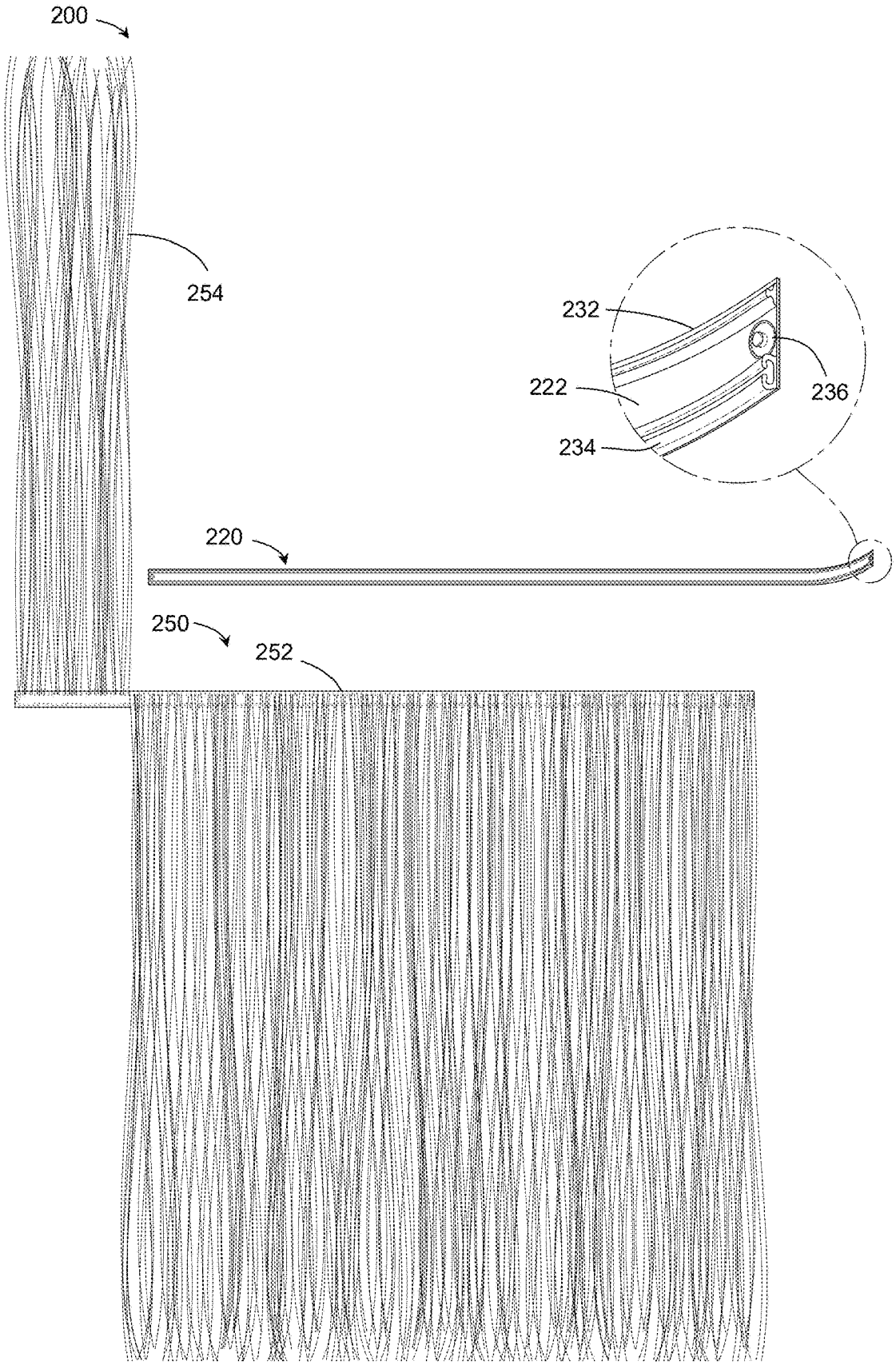
FIG. 3 is a front view of a hair extension system including an interlocking mechanism according to some implementations of the present disclosure.

In another implementation, a hair extension system 200 is provided as illustrated in FIG. 3. The hair extension system 200 includes a base 220, which serves as the primary support structure for a hair extension element 250. The base 220 has a substrate 222, which is designed to interface with the user, for example, using any of the methodologies described above with respect to the base 120 of the hair extension system 100 (e.g., to the hair base 180 and/or to the scalp base, as described below). The base 220 also includes a first interlocking mechanism 232 and a second interlocking mechanism 234 coupled to the substrate 222. The interlocking mechanisms 232, 234 are configured to secure the hair extension element 250 to the base 220. The first interlocking mechanism 232 is positioned on an upper portion of the substrate 222, while the second interlocking mechanism 234 is positioned on a lower portion of the substrate 222. Together, interlocking mechanisms 232, 234 ensure a firm and stable connection between the base 220 and the hair extension element 250.

Additionally, according to some implementations, the base 220 includes an additional securing mechanism 236 located on one or both ends of the substrate 222, proximate to the temples of the user when the substrate 222 is coupled to the user. The additional securing mechanism 236 provides extra stability and security, preventing any accidental detachment of the hair extension element 250 during use. The additional securing mechanism 236 is strategically placed to complement the interlocking mechanisms 232 and 234, enhancing the overall reliability of the system 200.

The hair extension element 250 includes a substrate 252 and a extension hair 254. As illustrated in FIG. 4D, the hair extension element 250 includes a first interlocking mechanism 262 that corresponds to the first interlocking mechanism 232 of the substrate 222 and a second interlocking mechanism 264 that corresponds to the second interlocking mechanism 234 of the substrate 222. The first interlocking mechanism 262 is positioned on an upper portion of the substrate 252, while the second interlocking mechanism 264 is positioned on a lower portion of the substrate 252. Together, these interlocking mechanisms 232, 262 and 234, 264 ensure a firm and stable connection between the base 220 and the hair extension element 250. Also as illustrated in FIG. 4D is an additional securing mechanism 266 located on one or both ends of the substrate 252, corresponding to the additional securing mechanism 236 of base 220. The additional securing mechanism 266 provides extra stability and security, preventing any accidental detachment of the hair extension element 250 during use. The additional securing mechanism 266 is strategically placed to complement the interlocking mechanisms 262 and 264, enhancing the overall reliability of the system 200.

Figure 4A:
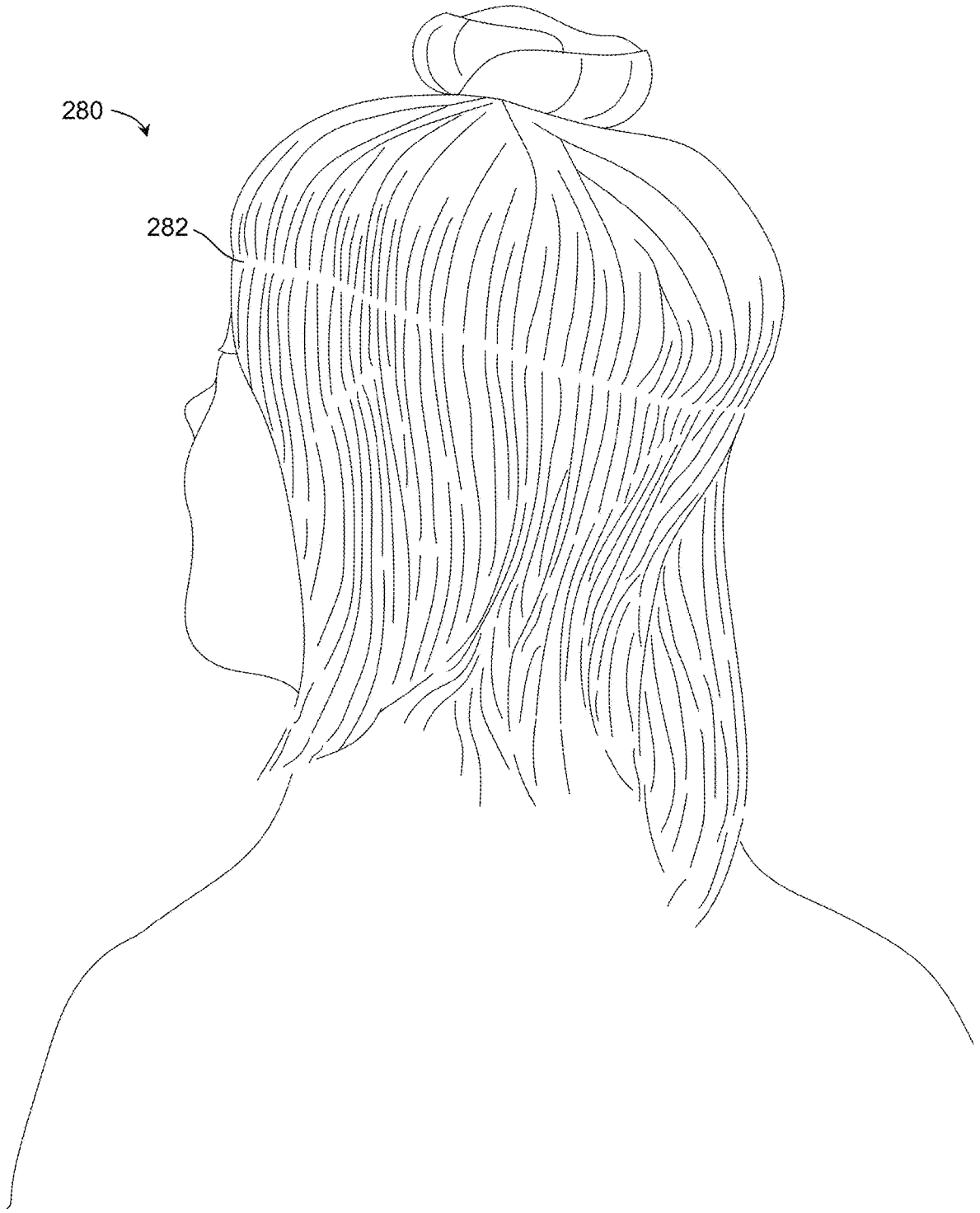
FIG. 4A illustrates a portion of a method of installing the hair extension system of FIG. 3 on a user according to some implementations of the present disclosure.
Figure 4B:
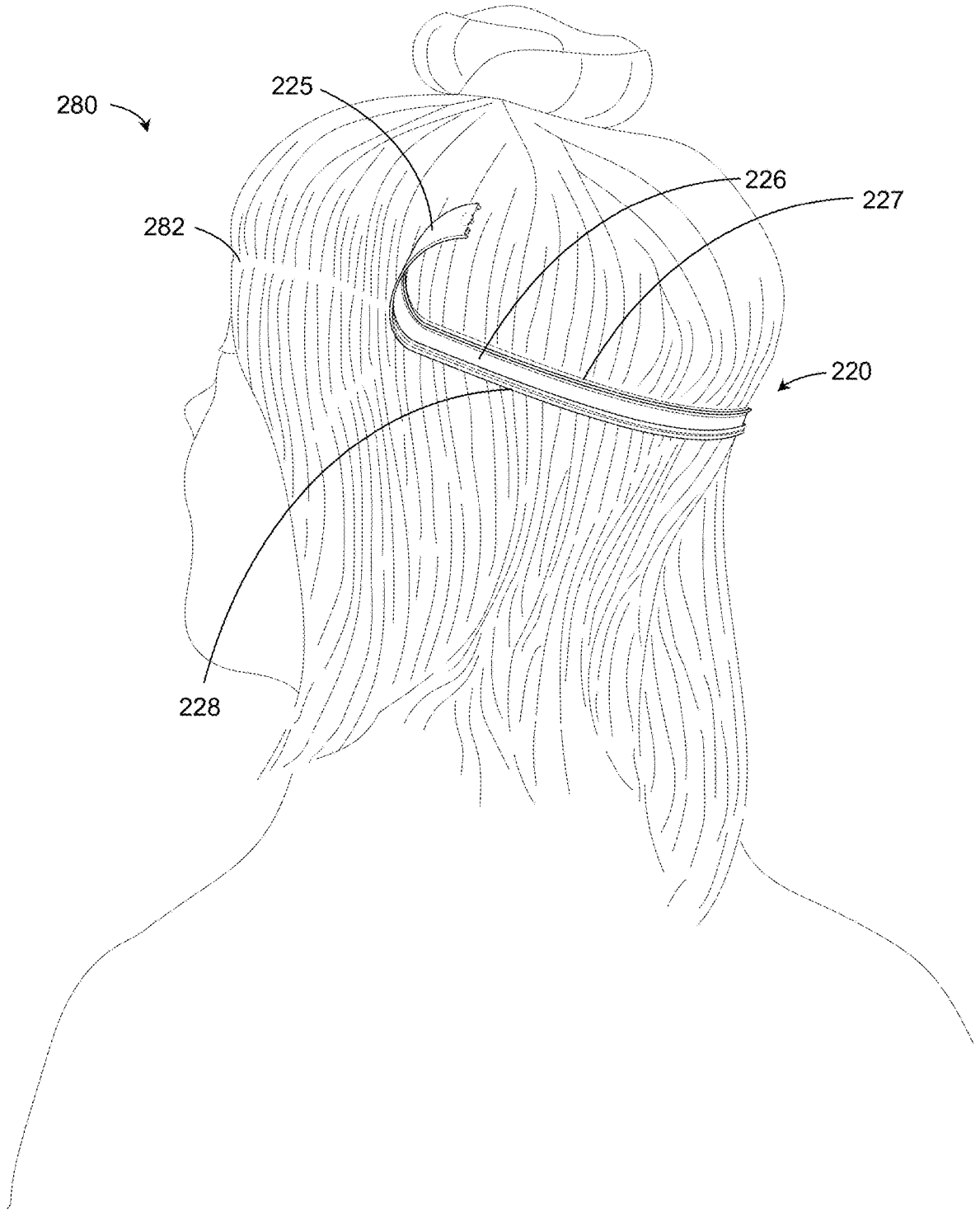
FIG. 4B illustrates another portion of the method of installing the hair extension system of FIG. 3 on a user according to some implementations of the present disclosure.
Figure 4C:
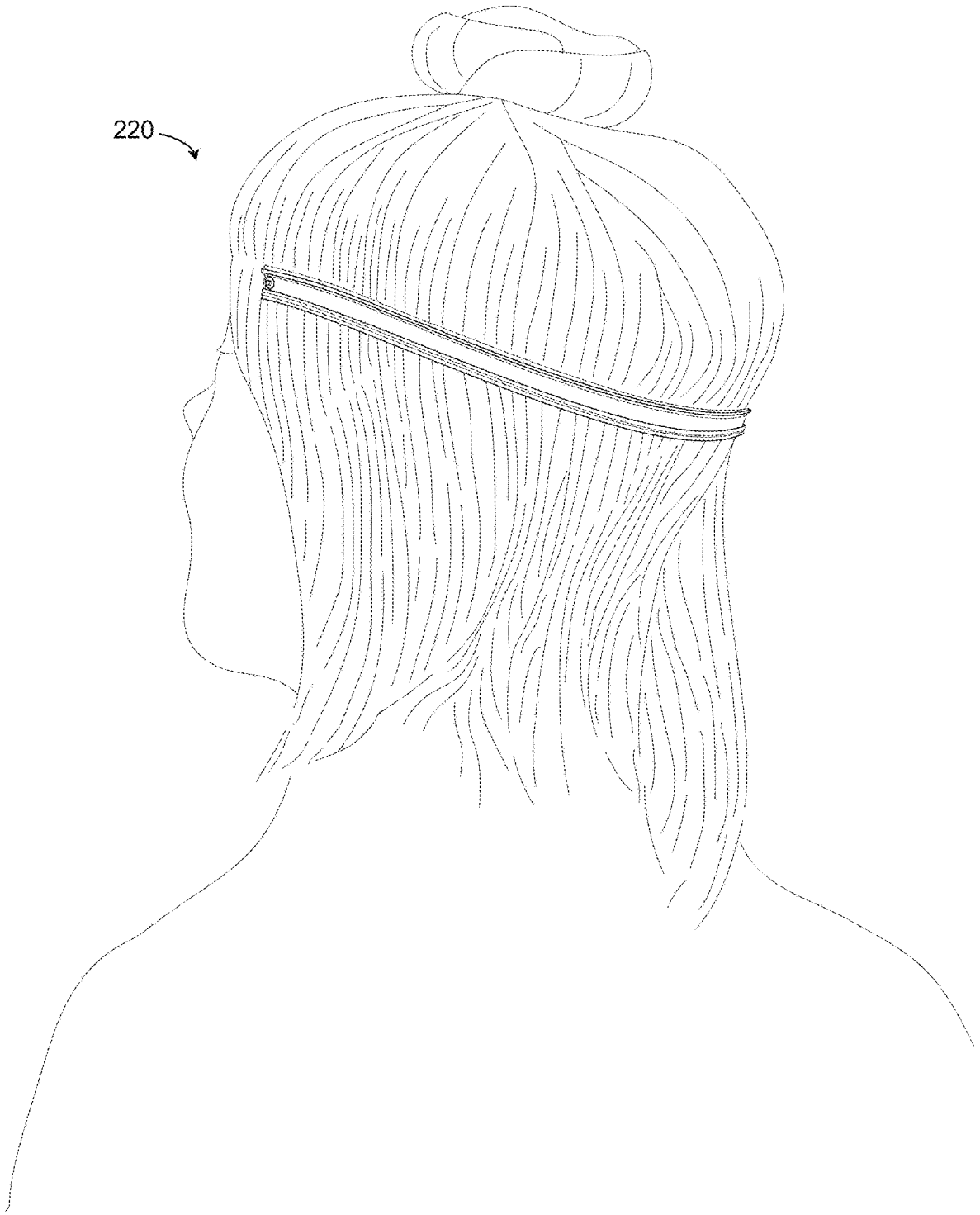
FIG. 4C illustrates another portion of the method of installing the hair extension system of FIG. 3 on a user according to some implementations of the present disclosure.
Figure 4D:
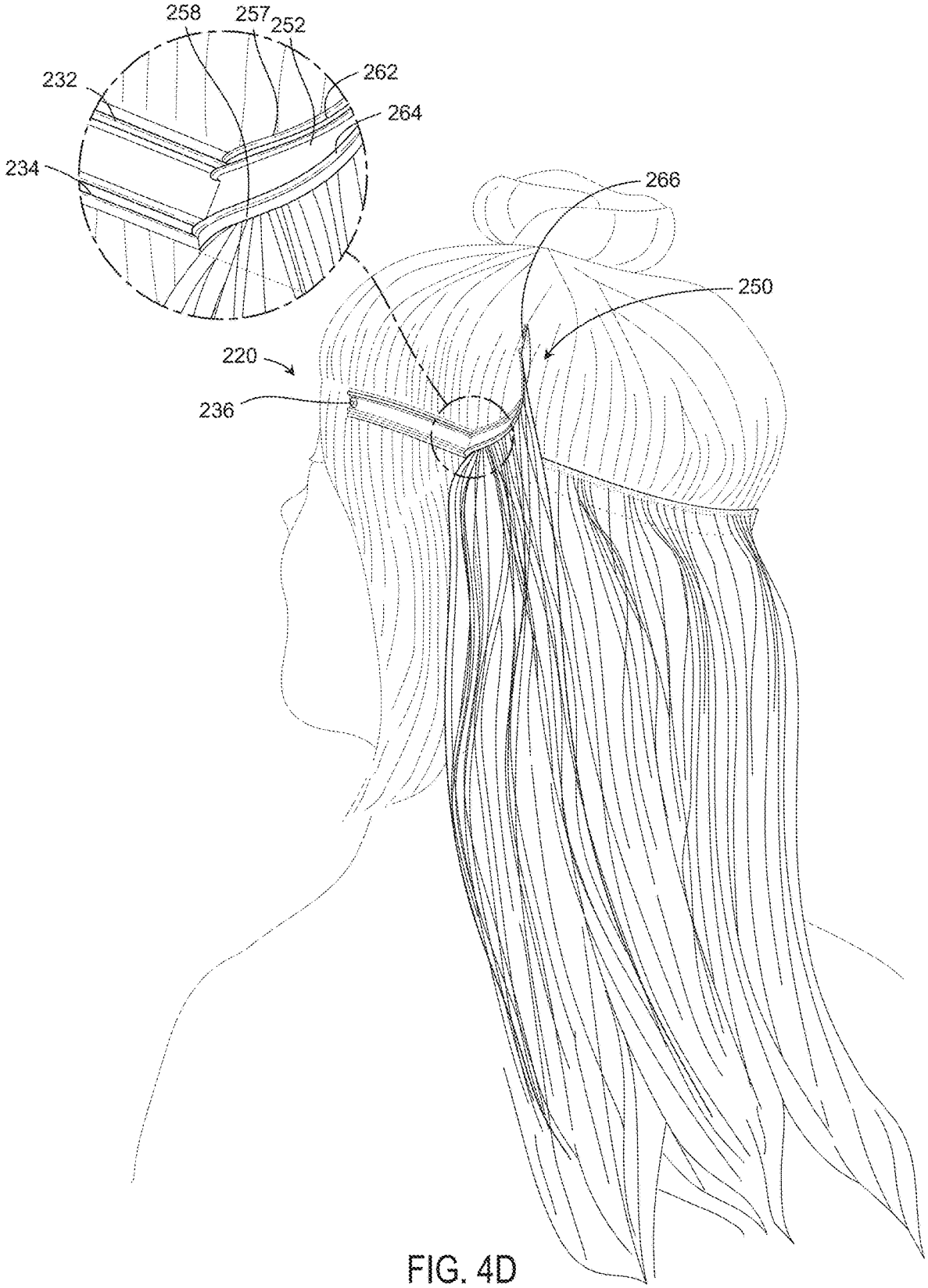
FIG. 4D illustrates another portion of the method of installing the hair extension system of FIG. 3 on a user according to some implementations of the present disclosure.

Referring now to FIGS. 4A-4F a method of attaching the hair extension system 200 to the scalp base of the user is illustrated. It should be noted that although FIGS. 4A-4F are illustrated with reference to the hair extension system 200, the same or similar techniques are suitable to couple any other hair extension system described herein to a scalp base 280 of a user. As illustrated in FIG. 4A, first a technician or a user of the hair extension system 200 creates a part in the hair of the user to reveal the scalp base 280 consisting of the hair part 282 that runs along the rear of the head of the user between respective temples of the user. FIG. 4B-4C illustrates a sequence in which the base 220 is attached to the scalp base 280 along the hair part 282. The base 220 features a first surface 225, which is intended to face towards the user's head, ensuring a secure and comfortable fit. The first surface 225 is designed to be in contact with the scalp base 280, providing stability and preventing slippage during use. A second surface 226 of the base 220 faces away from the head, and it is typically where the hair extensions are attached or integrated. The base 220 is further defined by a top edge 227 and a bottom edge 228. The top edge 227 is positioned closer to the top of the head, while the bottom edge 228 is oriented towards the bottom of the head while the base 220 is in use. Base 220 is attached to the scalp base 280 using any suitable means, including but not limited to adhesives, threads, sutures, piercings, and any combination thereof.

Referring now to FIG. 4D, the removable coupling of the base 220 to the hair extension element 250 is illustrated. The base 220 is equipped with the first interlocking mechanism 232 and the second interlocking mechanism 234. These interlocking 232, 234 mechanisms are designed to detachably engage with corresponding interlocking mechanisms on the hair extension element 250 to ensure a secure fit. The first interlocking mechanism 232 and the second interlocking mechanism 234 are positioned on the substrate 222 of the base 220.

The hair extension element 250 is designed to integrate seamlessly with the base 220. The hair extension element 250 has a top edge 257 and a bottom edge 258, which define the boundaries of the hair extension element 250. The hair extension element 250 also includes a first interlocking mechanism 262 and a second interlocking mechanism 264 coupled to the second substrate 252. These interlocking mechanisms 262, 264 correspond to the interlocking mechanisms 232, 234 on the base 220, allowing for a secure attachment.

To further enhance the security of the attachment, the hair extension system 200 includes additional securing mechanism 236 on the base 220 and additional securing mechanism 266 on the hair extension element 250. These additional securing mechanisms provide extra retention of the ends of the base 220 to the hair extension element 250, ensuring that the hair extension system 200 remains firmly in place during use.

The design of the interlocking mechanisms and the additional securing mechanisms ensures that the hair extension system 200 is both easy to use and reliable. The interlocking mechanisms 232, 234, 262, and 264 allow for quick attachment and detachment of the base 220 from the hair extension element 250, while the additional securing mechanisms 236 and 266 provide added security to the attachment of the base 220 to the hair extension element 250, preventing the hair extension element 250 from slipping or becoming loose with respect to base 220.

Figure 4E:
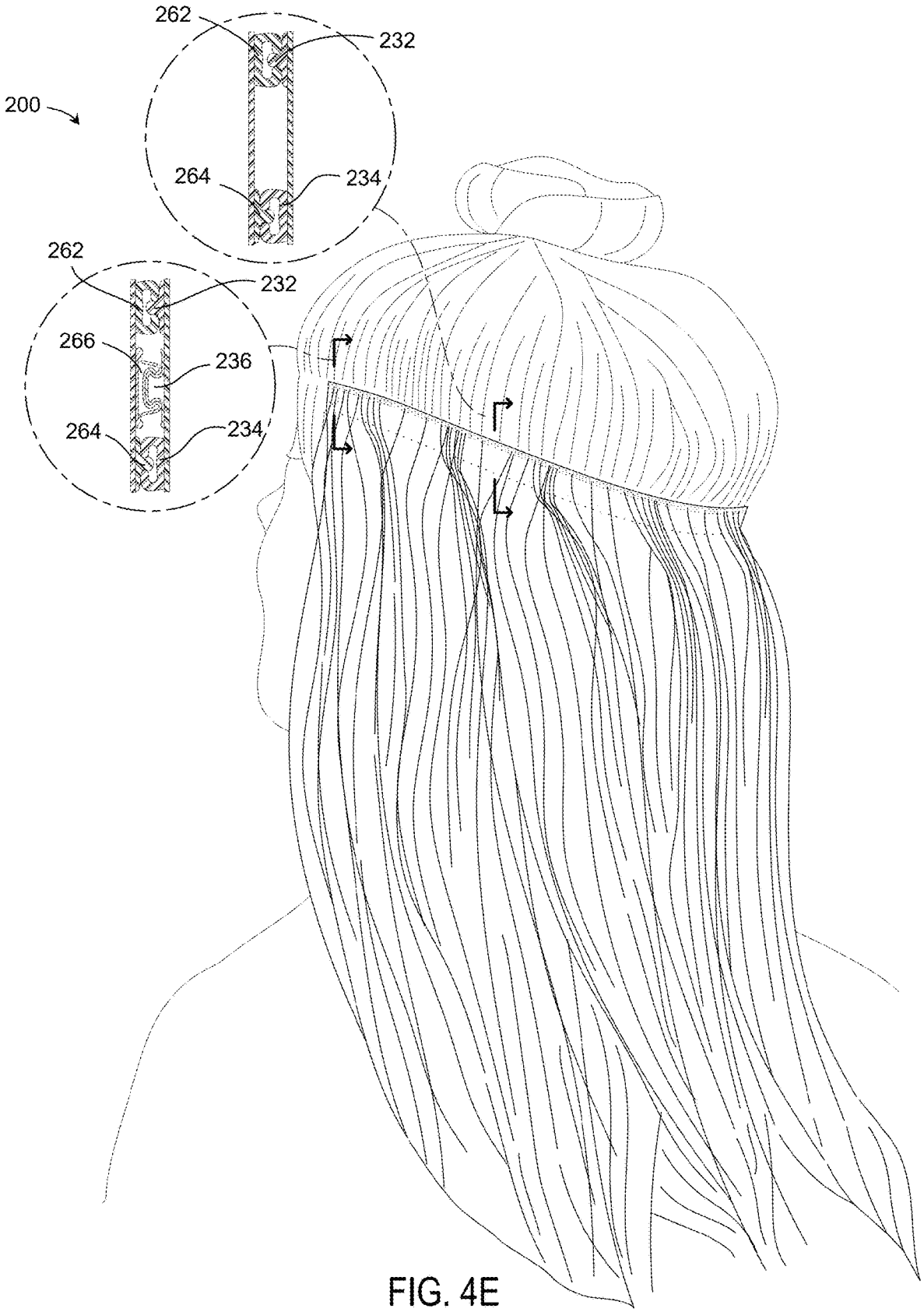
FIG. 4E illustrates another portion of the method of installing the hair extension system of FIG. 3 on a user according to some implementations of the present disclosure.
Figure 4F:
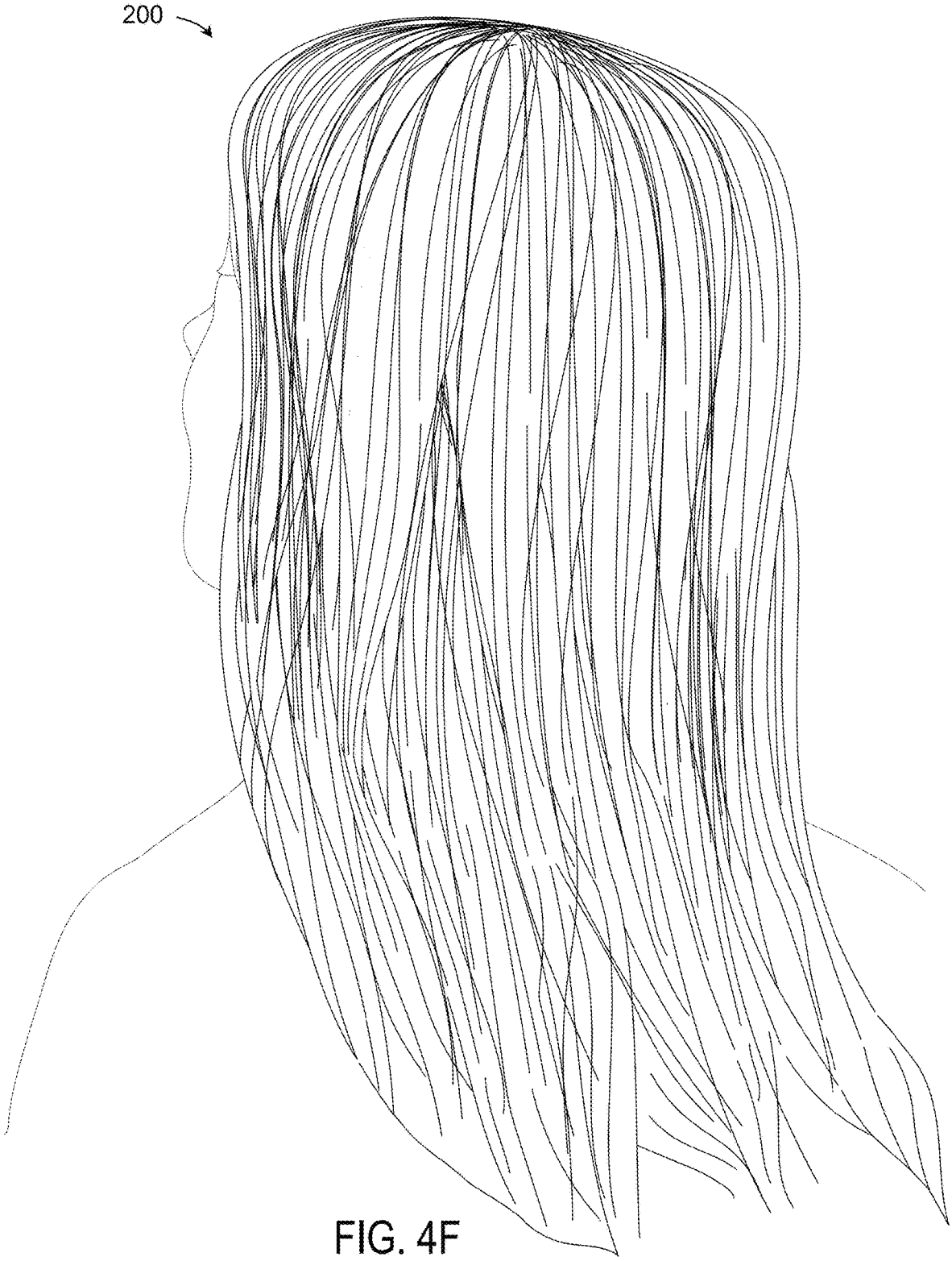
FIG. 4F illustrates another portion of the method of installing the hair extension system of FIG. 3 on a user according to some implementations of the present disclosure.

FIG. 4E illustrates a cross-sectional view of the attachment between the base 220 and the hair attachment element 250. Within a middle portion of the attachment interface between the base 220 and the hair attachment element 250, the first interlocking mechanism 232 of the base 220 and the corresponding first interlocking mechanism 262 of the hair extension element 250 are fit together in a press and fit configuration and similarly, the second interlocking mechanism 234 of the base 220 and the corresponding second interlocking mechanism 264 of the hair extension element 250 are fit together. At respective ends of the base 220 and the hair extension element 250, the connection is similar except with an additional secure connection being made between the additional securing mechanism 236 and the additional securing mechanism 266. As illustrated, the additional securing mechanisms 236 and 266 are implemented as a snap, but it should be understood that the additional securing mechanism is varied as desired in some implementations. For example, a button, a snap, a magnet, a pin, etc., or any combinations thereof are suitable to be the additional securing mechanisms 236, 266. After the base 220 is attached to the scalp base 280 and the hair extension element 250 is attached to the base 220, the hair part of the user is unparted and the natural hair returned to its resting position (e.g., a worn configuration), as illustrated in FIG. 4F, with the hair extension system 200 fully attached in a worn configuration.

Figure 5A:
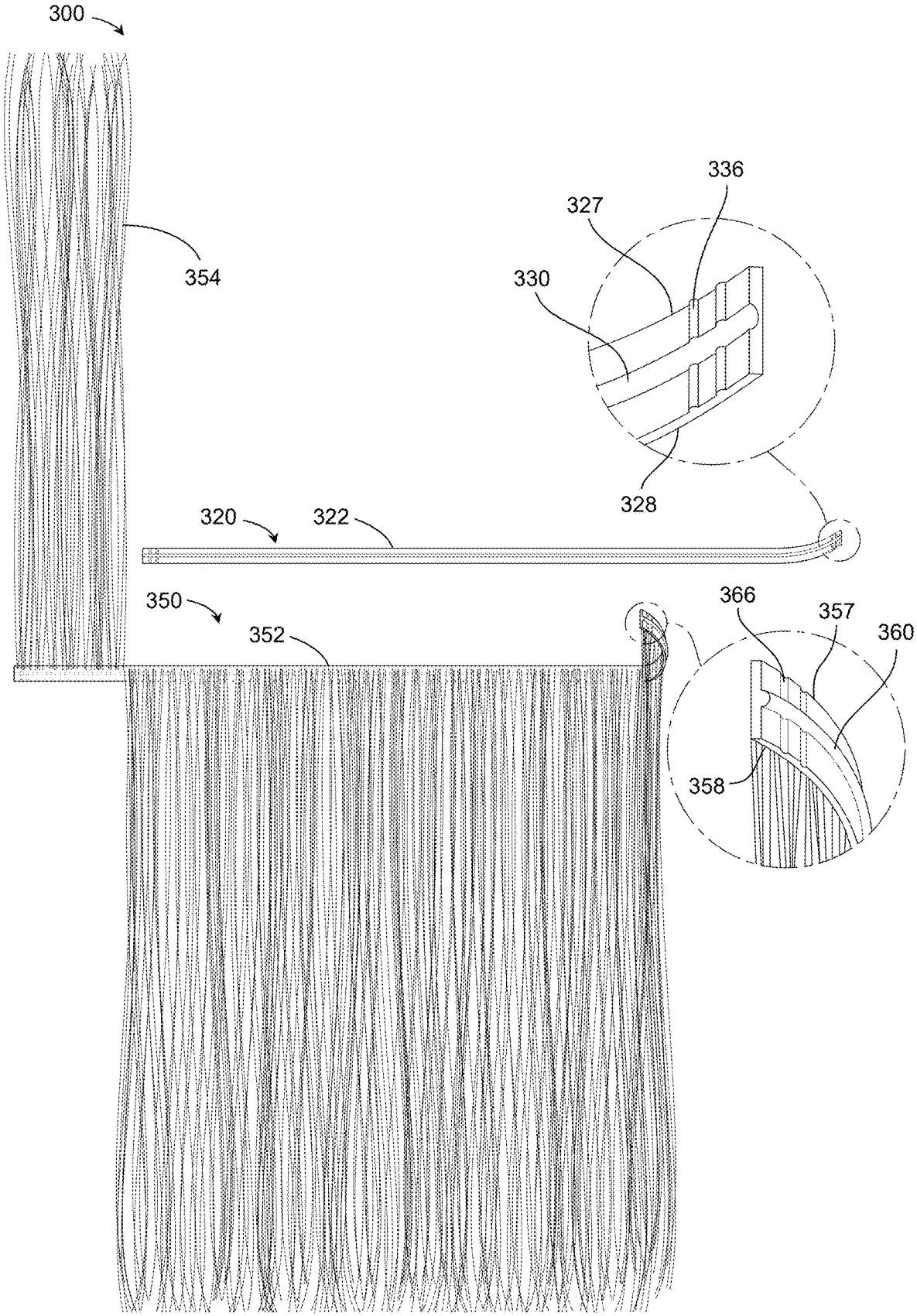
FIG. 5A is a front view of a hair extension system including a magnetic fastening mechanism according to some implementations of the present disclosure.
Figure 5B:
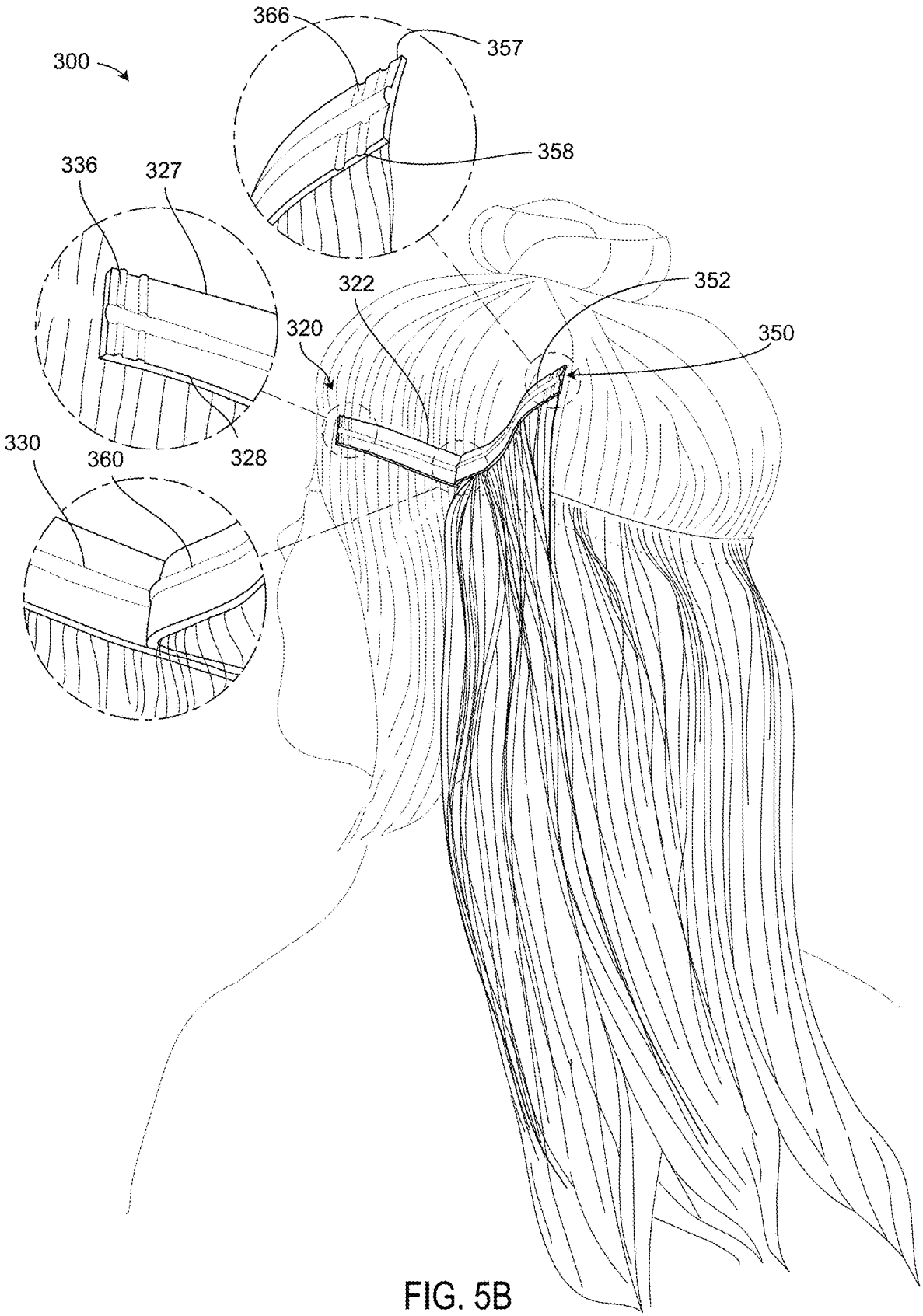
FIG. 5B illustrates a portion of a method of installing the hair extension system of FIG. 5A on a user according to some implementations of the present disclosure.
Figure 5C:
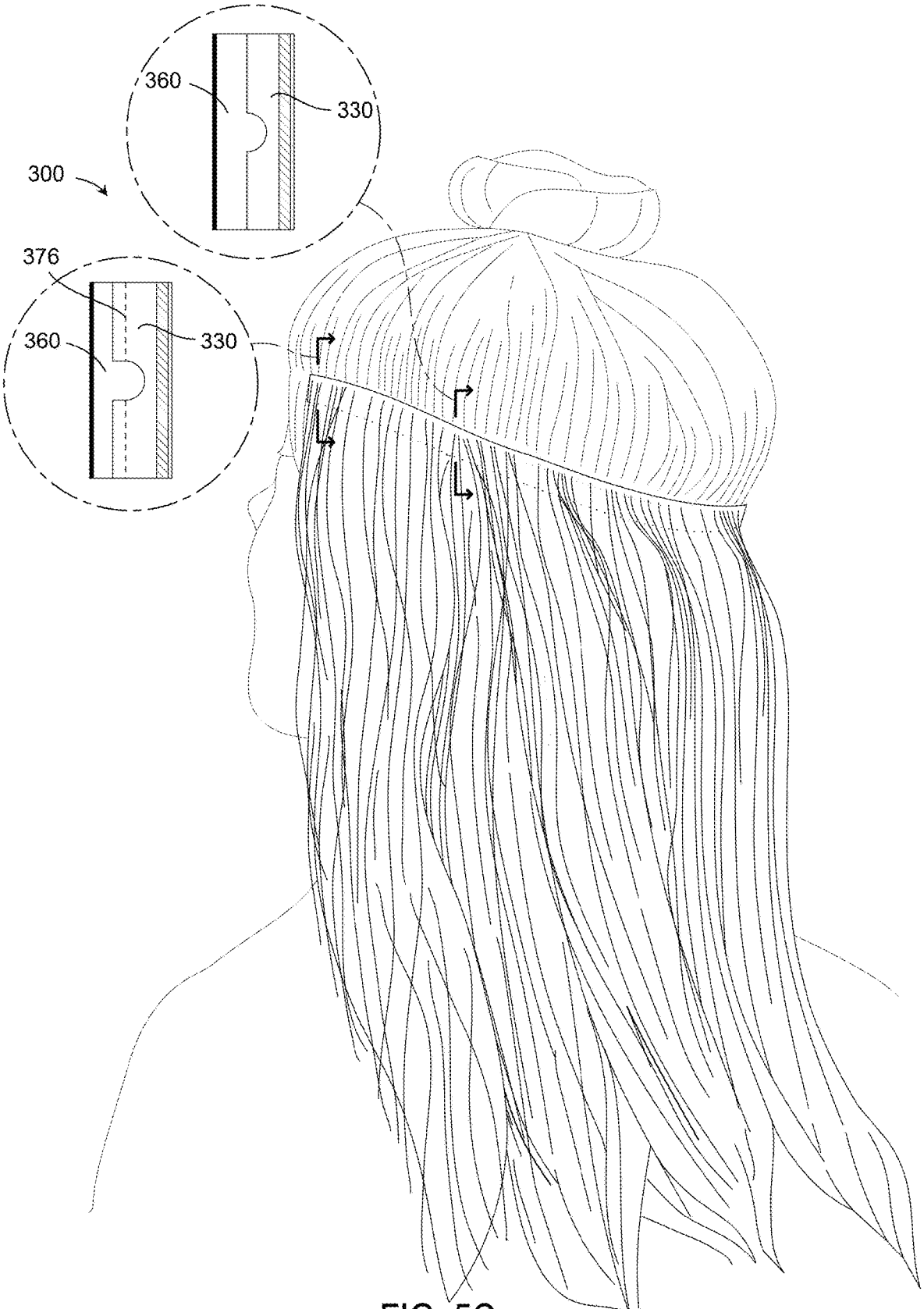
FIG. 5C illustrates another portion of the method of installing the hair extension system of FIG. 5A according to some implementations of the present disclosure.

Now referring to FIGS. 5A-5C, a hair extension system 300 is illustrated as well as a method of attaching the hair extension system 300 to the scalp base 280. Although hair extension system 300 is illustrated attached to the scalp base 280, it should be understood that in other implementations, hair extension system 300 is attached to the hair base 180 as described in reference to the hair extension system 100.

FIG. 5A illustrates the hair extension system 300 including a base 320 and a hair extension element 350, both of which incorporate magnetic elements 330 and 360 to facilitate attachment therebetween.

The base 320 is an elongated structure that serves as the primary attachment point for the hair extension element 350. According to some implementations, the base 320 is constructed of a substrate 322. The base 320 has a top edge 327 and a bottom edge 328. The magnetic element 330 is integrated into the base 320 and extends along its length. The magnetic element 330 is designed to attract and hold the corresponding magnetic element 360 on the hair extension element 350, ensuring a secure connection. Additionally, alignment elements 336 are positioned along the base 320 to aid in the precise alignment of the magnetic elements 330, 360 to facilitate secure attachment of the base 320 to the hair extension element 350.

The hair extension element 350 includes a substrate 352, to which extension hair 354 is attached. The substrate 352 has a top edge 357 and a bottom edge 358. Similar to the base 320, the hair extension element 350 includes the magnetic element 360 that extends along the length of the substrate 352. The magnetic element 360 is positioned to align with and attach to the magnetic element 330 on the base 320. Alignment elements 366 are also included on the hair extension element 350 to ensure proper positioning and secure attachment to the base 320.

According to some implementations, magnetic element 330 and magnetic element 360 are of an elongated and flexible construction, ensuring that magnetic element 330 is able to follow the contour of the substrate 322 and that magnetic element 360 is able to follow the contour of the substrate 352, for example, when the hair extension system is in a worn configuration (e.g., when the base 320 is coupled to the user and the hair extension element 350 is coupled to the base 320).

When the hair extension system 300 is in use, the base 320 is coupled to the scalp base 280, and the hair extension element 350 is aligned with the base 320 using the alignment elements 336, 366. The magnetic elements 330, 360 attract each other, securing the hair extension element 350 to the base 320. This magnetic attachment method provides a strong and reliable connection while allowing for easy removal and reattachment of the hair extension element 350 as needed.

The extension hair 354 attached to the substrate 352 of the hair extension element 350 blends seamlessly with the natural hair, providing a natural and aesthetically pleasing appearance. The hair extension system 300 is designed to be lightweight and comfortable to wear, ensuring that the user enjoys the benefits of hair extensions without discomfort or inconvenience.

Referring now to FIG. 5B, the base 320 of the hair extension system 300 is attached to the scalp base 280 of the user in a similar manner as described with respect to the hair extension system 200 (e.g., using string, sutures, adhesive, piercings, and any combinations thereof). Once the base 320 of the hair extension system 300 is appropriately attached to the scalp base 280, the hair extension element 350 is positioned and aligned such that the magnetic element 360 is attracted to and moves towards the magnetic element 330 until the hair extension element 350 is attached to the base 320.

The substrate 352 includes a top edge 357 and a bottom edge 358. Attached to the substrate 352 is the magnetic element 360, which corresponds to the magnetic element 330 on the base 320, allowing for a secure magnetic connection. The hair extension element 350 also includes the alignment elements 366, which work in conjunction with the alignment elements 336 on the base 320 to ensure precise alignment and secure attachment.

In use, the magnetic element 330 on the base 320 and the magnetic element 360 on the hair extension element 350 attract each other, securing the hair extension element 350 to the base 320. The alignment elements 336 on the base 320 and the alignment elements 366 on the hair extension element 350 ensure that the two components are properly aligned, providing a stable and secure attachment. This system allows for easy attachment and removal of the hair extension element 350, providing a convenient and effective solution for hair extensions.

The hair extension system 300 depicted in FIG. 5C utilizes a magnetic mechanism for secure attachment. The hair extension system 300 includes a pair of magnetic elements 330 and 360, which are designed to align and attract each other, thereby securing the hair extension in place. The magnetic element 330 is integrated into the base 320 of the hair extension system 300, while the corresponding magnetic element 360 is embedded within the hair extension element 350.

When the hair extension system 300 is applied, the magnetic elements 330 and 360 are brought into proximity, causing them to attract and align due to their magnetic properties. This alignment is facilitated by the aligned elements 376, which are a result of the combination of the alignment element 336 of the base 320 and alignment element 366 of the hair extension element 350 coming together, which ensure that the magnetic elements 330, 360 are correctly positioned relative to each other. The aligned elements 376 are designed to provide a stable and secure connection, preventing any misalignment that could compromise the attachment of the hair extension.

The magnetic elements 330, 360 are strategically placed to maximize the holding strength while maintaining a discreet appearance. This design allows for a seamless integration of the hair extension system 300 with the natural hair, providing a natural look and feel. The use of magnetic elements 330 and 360 also enables easy application and removal of the hair extension system 300, offering convenience and flexibility to the user.

Figure 6:
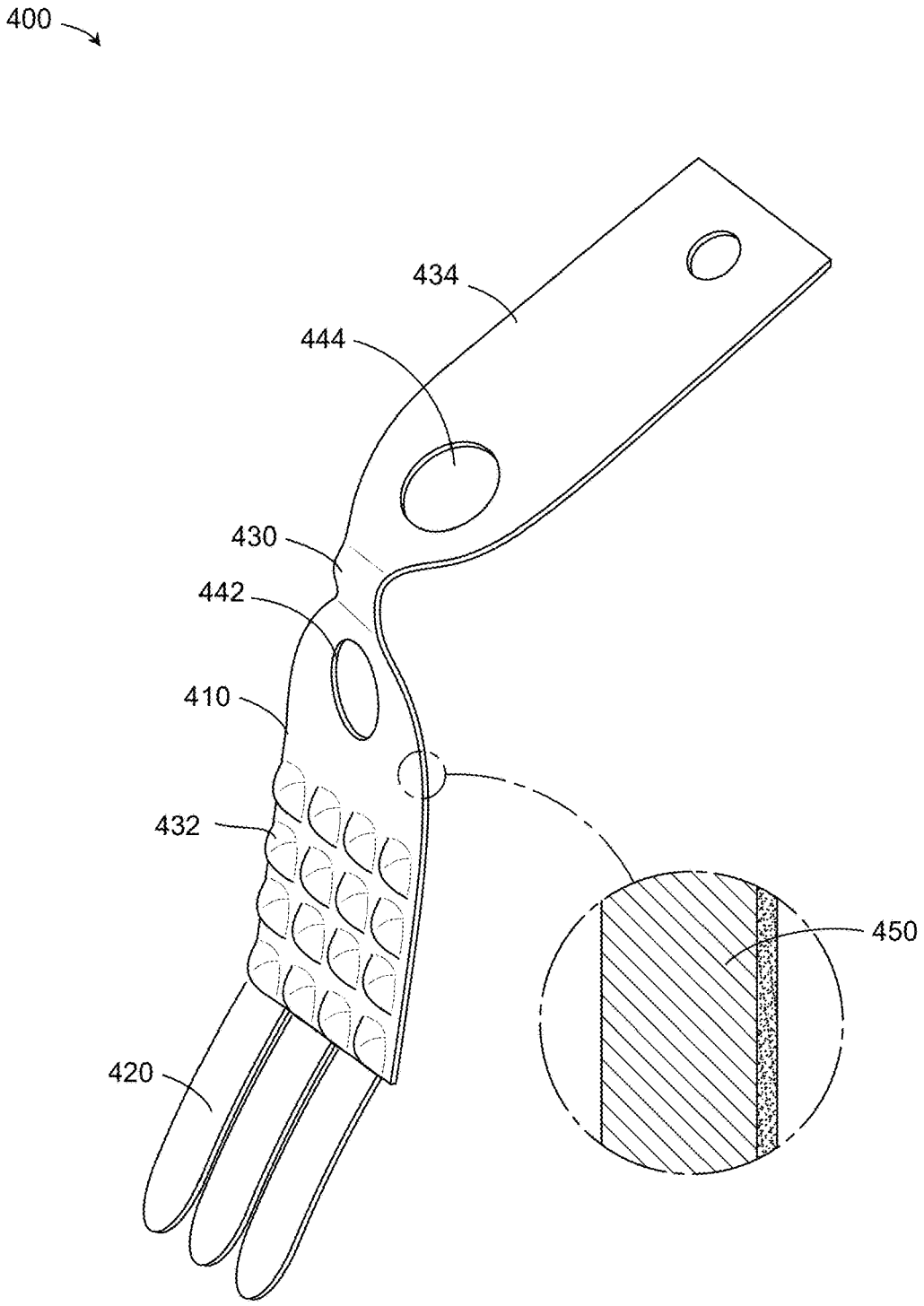
FIG. 6 illustrates an end clip to aid in holding down ends of a hair extension system relatively closer to the scalp of the user according to some implementations of the present disclosure.

Referring now to FIG. 6, an end clip 400 is disclosed that is compatible with any of the hair extension system disclosed herein to further secure respective ends of a hair extension element to a respective base when the hair extension system is in a worn configuration. In this regard, the end clip 400 is designed to provide additional stability and security to hair extensions, ensuring they remain firmly in place during use.

The end clip 400 includes a base 410, which serves as the primary structural component of the clip. Extending from the base 410 are multiple fingers 420, which are designed to grip and hold the any of the described hair extension elements securely. The fingers 420 are flexible and conform to the shape of the hair extension element, providing a secure fit without causing damage to the hair.

Connecting the base 410 to the fingers 420 is a neck 430. The neck 430 includes a first portion 432, which is larger in size, and a second portion 434, which is smaller in size than the first portion 432. This design allows for a graduated transition from the base 410 to the fingers 420, enhancing the clip's ability to hold a respective hair extension element securely.

The neck 430 also features apertures 442 and 444. The aperture 442 is located on the larger side of the neck 430, while the aperture 444 is situated on the smaller side. These apertures are designed to reduce the overall weight of the clip and provide points for additional securing mechanisms if needed.

To enhance the grip and prevent slippage, one or more portions of the end clip 400 is lined with silicone 450. The silicone 450 provides a non-slip surface that helps to hold the hair extension in place, even during vigorous activities. The silicone 450 is strategically placed to maximize contact with a respective hair extension element, ensuring a secure hold.

Figure 7:
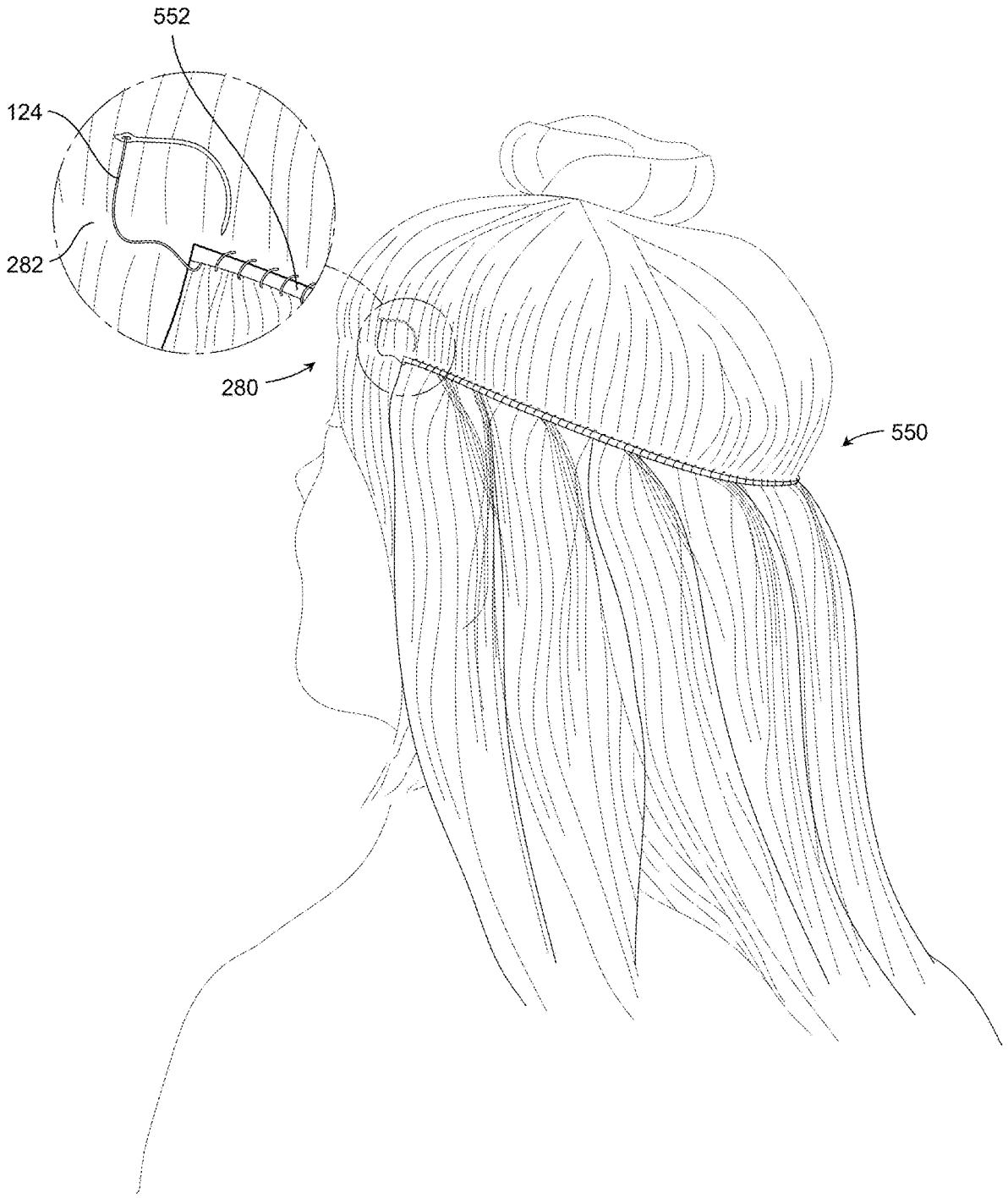
FIG. 7 illustrates a method of installing a hair extension directly to the scalp/skin of a user according to some implementations of the present disclosure.

FIG. 7 illustrates a hair extension element 550 being attached directly to the scalp base 280 of a user. Note that hair extension elements 150, 250, and 350, described elsewhere herein, can be attached directly to the scalp base 280 of the user in a similar manner as described with respect to the hair extension element 550.

The hair part 282 is a section of the user's scalp that includes a part in the hair to create a space for the attachment of the hair extension element 550. The hair part allows the extension hair 554 of hair extension element 550 to blend seamlessly with the user's natural hair, enhancing the overall appearance and making the hair extension element 550 less noticeable.

To attach hair extension element 550 to the user, thread 124 is used to stitch portions of the hair extension element 550 to the scalp base 280. In one implementation, thread 124 is used to attach a substrate 552 to the scalp base 280. In some implementations, the thread 124 is chosen to match the color of the user's hair, further enhancing the natural appearance of the extension.

Figure 8:
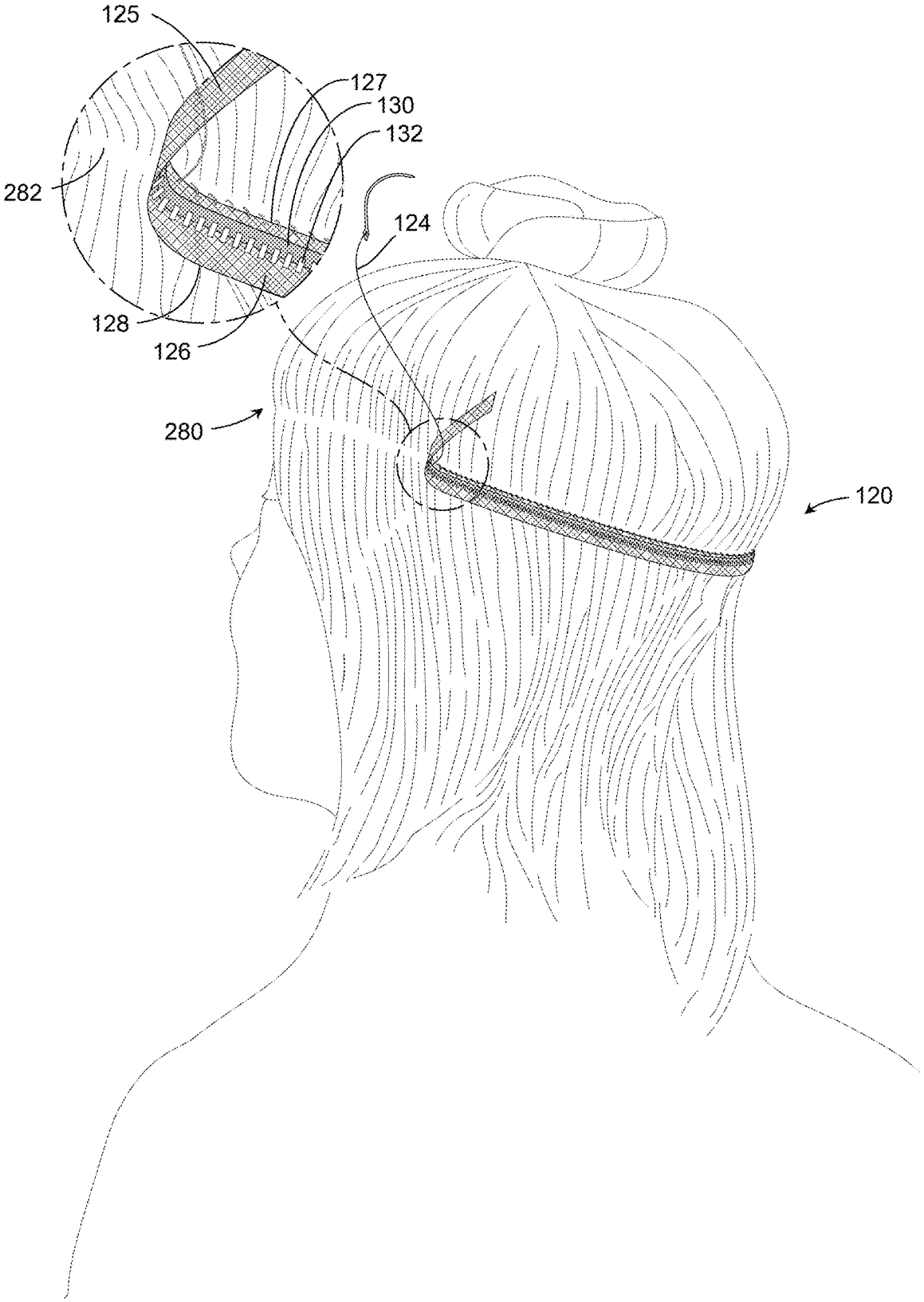
FIG. 8 illustrates a method of installing a base of a hair extension system directly to the scalp/skin of a user according to some implementations of the present disclosure.

Now referring to FIG. 8, a method of attaching the base 120 to the scalp base 280 of a user is illustrated. It should be noted that, although FIG. 8 is illustrated with reference to the base 120, the same or similar techniques are suitable to couple any other base to the scalp base 280 of a user. In some such implementations, the base is a piece of mesh that is coupled to the scalp base 280 of the user (e.g., via one or more stiches). In some such implementations, a hair weft, wig, or topper is thereafter coupled directly to the mesh using a thread.

The base 120 is constructed with the first surface 125 facing the head and the second surface 126 facing away from the head. The first surface 125 is designed to be comfortable when positioned against the scalp, while the second surface 126 is intended to support the attachment of a corresponding hair extension element (e.g., hair extension element 150).

The base 120 includes the top edge 127 and the bottom edge 128, which define the vertical boundaries of the base. Along the length of the base 120, the zipper tape 130 is affixed. The zipper tape 130 is equipped with zipper teeth 132 that interlock with corresponding zipper teeth 162 of the hair extension element 150 to secure the hair extension element 150 to the base 120.

The scalp base 280 serves as the foundation for the hair extension system 100, providing a stable surface for attachment. The hair part 282 is the section of the user's natural hair that is parted to accommodate the placement of the base 120. The hair part 282 ensures that the hair extension element 150 blends seamlessly with the user's natural hair, creating a natural and undetectable appearance.

In some implementations, the thread 124 is used to attach the base 120 to the scalp base 280. In this regard, the base 120 includes a substrate 122 that is composed at least in part of a mesh material. The thread 124 is used to create a number of vertical stitches along the top edge 127 at regular intervals along the scalp base 280. In some implementations, the vertical stitches are placed along the top edge 127 at equidistant intervals of every eighth inch, every quarter inch, every half inch, every inch, and/or variations thereof, depending on a number of factors, such as the weight of the hair extension element being attached to the user, the user's hair length/quality/strength, the activity level of the user, etc. In some other implementations, the vertical stitches are placed along the top edge 127 but not at equidistant intervals.

In some implementations (not illustrated), respective ends of the base 120 are configured to be attached by the thread 124 with a vertical stitch along the top edge 127 of respective ends of the base 120 and an additional vertical stitch along the bottom edge 128 of respective ends of the base 120. In contrast, between, the respective ends of the base 120, the base 120 is attached with a vertical stitch along the top edge 127 and not the bottom edge 128.

In some implementations, a base is of a generally circular or oval shape and constructed of a mesh material that extends across the center of the generally circular or oval shape to allow for the secure attachment of wigs, toppers, and/or other hairpieces to the user. In some such implementations, the base is configured to be positioned on the top of the head of the user, with the mesh material extending across the top of the head of the user. The base is attached to the scalp of the user using any of the methods described herein. For example, the base can be attached to the scalp along the top of the head of the user by pulling portions of the natural hair through holes of the mesh material and subsequently locking the natural hair into place with one or more hair beads (e.g., which are the same as, or similar to, the hair beads 184 described elsewhere herein). The hair beads are sized and shaped such that the hair beads do not readily pass through the holes in the mesh. Additionally, or alternatively, the base can be attached to the scalp of the user by sewing the mesh material to the natural hair of the user and/or the hair beads. Additionally, or alternatively, the base can be stitched to the scalp of the user directly, using stitches that are permanent or semi-permanent in nature. Subsequently, the base is configured to receive one or more hair extension elements configured to mimic the natural hair of the user and replace conventional wigs or toppers.

In yet other implementations, the mesh extends around a perimeter of the generally circular or oval shape with an open portion lacking mesh material within the center of the generally circular or oval shape. In other words, the mesh of base forms a generally ring-like structure, which is attached to the scalp of the user. The ring-like structure is advantageous for when the user has retained some natural hair along the top of the scalp and would like to supplement the natural hair along the perimeter of the scalp. In such implementations, the base is configured to be positioned around an upper perimeter of the top of the head (e.g., about a scalp base). For example, the base can be attached to the scalp along the scalp base by pulling portions of the natural hair through holes of the mesh material and subsequently locking the natural hair into place with one or more hair beads. The hair beads are sized and shaped such that the hair beads do not readily pass through the holes in the mesh. Additionally, or alternatively, the base can be attached to the scalp of the user by sewing the mesh material to the natural hair of the user and/or the hair beads. Additionally, or alternatively, the base can be stitched to the scalp of the user directly, using stitches that are permanent or semi-permanent in nature. Subsequently, the base is configured to receive one or more hair extension elements configured to mimic the natural hair of the user and replace conventional wigs or toppers.

Although not specifically illustrated in FIG. 8, according to some implementations, ends of the base 120 include a number of apertures (e.g., similar to apertures 134 described above). According to some implementations, three apertures are provided in each respective end of the base 120. In a worn configuration of the hair extension system 100, the ends of the base 120 are positioned approximately near respective temples of the user, and the apertures are used to further secure the base 120 to the scalp base 280.

In some implementations, the hair extension element 550 is configured to couple to a base 520, as illustrated with reference to FIGS. 9 and 10. Although FIGS. 9-10 refer to the hair extension element 550, it should be understood that the same or similar techniques are suitable to couple any other hair extension element described herein to the base 520.

Figure 9:
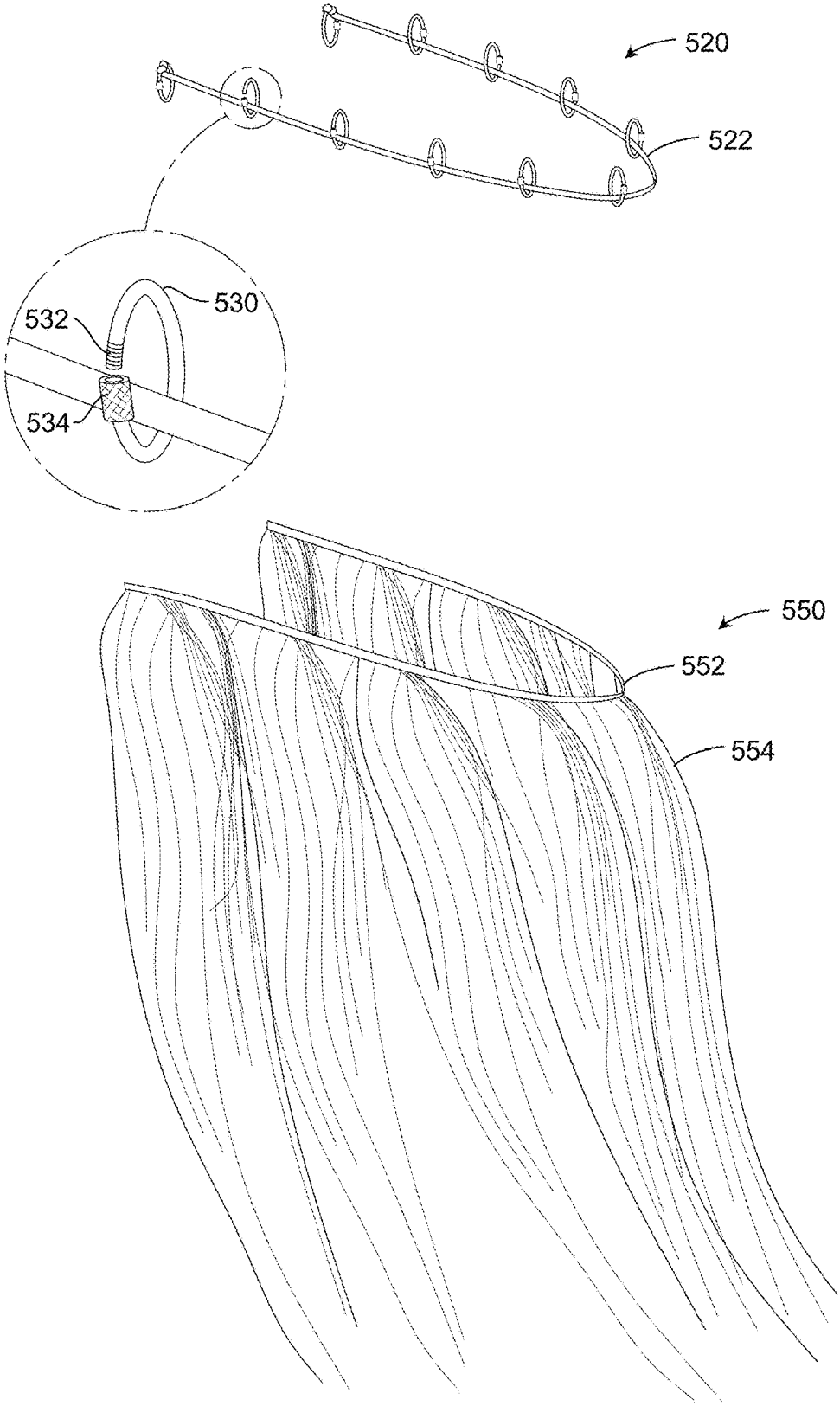
FIG. 9 illustrates a partially exploded view of a hair extension system including a wire base coupled to loop piercings according to some implementations of the present disclosure.

Referring to FIG. 9, the hair extension system 500 includes the base 520, which serves as the primary support structure for the hair extension element 550. The base 520 includes a substrate 522, which provides a stable platform for the attachment of other components, such as the hair extension element 550. The base 520 includes substrate 522 and a plurality of loop piercings 530. Each loop piercing 530 is configured to receive the substrate 522 therethrough and thereby secure the substrate 522 to the scalp base 280 of a user. In this regard, each loop piercing 530 is configured to be pierced through the skin of a user and thereafter a shaft 532 is connected to a connector ring 534, securing the substrate 522 to the loop piercings 530 and the loop piercings 530 to the scalp base 280 of the user.

The hair extension element 550 is designed to be coupled to the base 520. The hair extension element 550 includes the substrate 552, which acts as the foundation for the extension hair 554. The extension hair 554 is attached to the substrate 552, allowing it to hang naturally and blend seamlessly with the user's natural hair.

Figure 10:
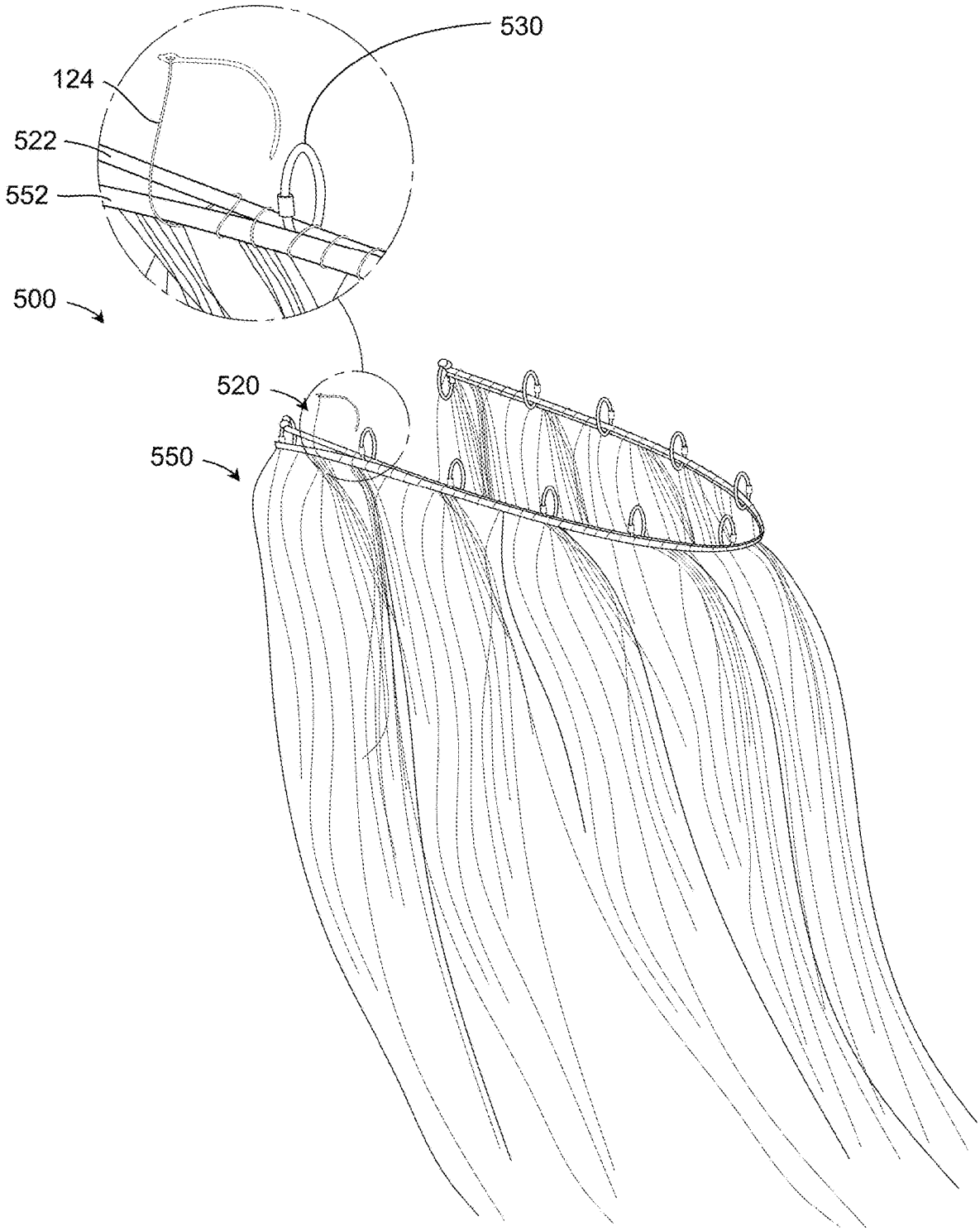
FIG. 10 illustrates a method of attaching a hair extension portion of the system of FIG. 9 to the wire base according to some implementations of the present disclosure.

Referring to FIG. 10, the hair extension element 550 includes a substrate 552 bonded to extension hair 554. The substrate 552 is a flexible material similar to the substrate 522, designed to hold the extension hair 554 securely. The extension hair 554 is attached to the substrate 552 using various methods, such as sewing, gluing, stitching, or bonding, and any combinations thereof. The substrate 552 is then attached to the base 520 and the substrate 522 using the loop piercing 530 and the thread 124.

The thread 124 is used to secure the hair extension element 550 to the base 520 and the substrate 522. According to some implementations, the thread 124 is threaded around the substrate 552 and the substrate 522 and passed through the skin of the user to secure the base 520 to the hair extension element 550. In some implementations, the thread 124 is threaded through the loop piercing 530, creating a strong and durable connection. The thread 124 can be made from various materials, such as nylon or polyester, to ensure strength and longevity.

The loop piercing 530 is designed to create a secure attachment to the scalp of a user (e.g., to the scalp base 280 of a user) and to hold the weight of the hair extension element 550 when the hair extension system 500 is in a worn configuration. As illustrated, the loop piercing 530 is positioned along the edge of the base 520 and the substrate 522, allowing the thread 124 to pass through and secure the hair extension element 550 to the scalp base 280 of a user. The loop piercing 530 can be made from metals, plastics, resins, and combinations thereof, and is designed to withstand the tension applied by the hair extension element 550.

The hair extension element 550 includes the substrate 552 with extension hair bonded thereto. The substrate 552 is a flexible material similar to the substrate 522, designed to hold the extension hair 554 securely. In some implementations, the substrate 552 includes a thin layer of keratin glue for bonding the extension hair 554 together. The extension hair 554 are attached to the substrate 552 using various methods, such as sewing, stitching, gluing, or bonding. The substrate 552 is then attached to the base 520 by the substrate 522 using the loop piercing 530 and the thread 124.

Figure 11:
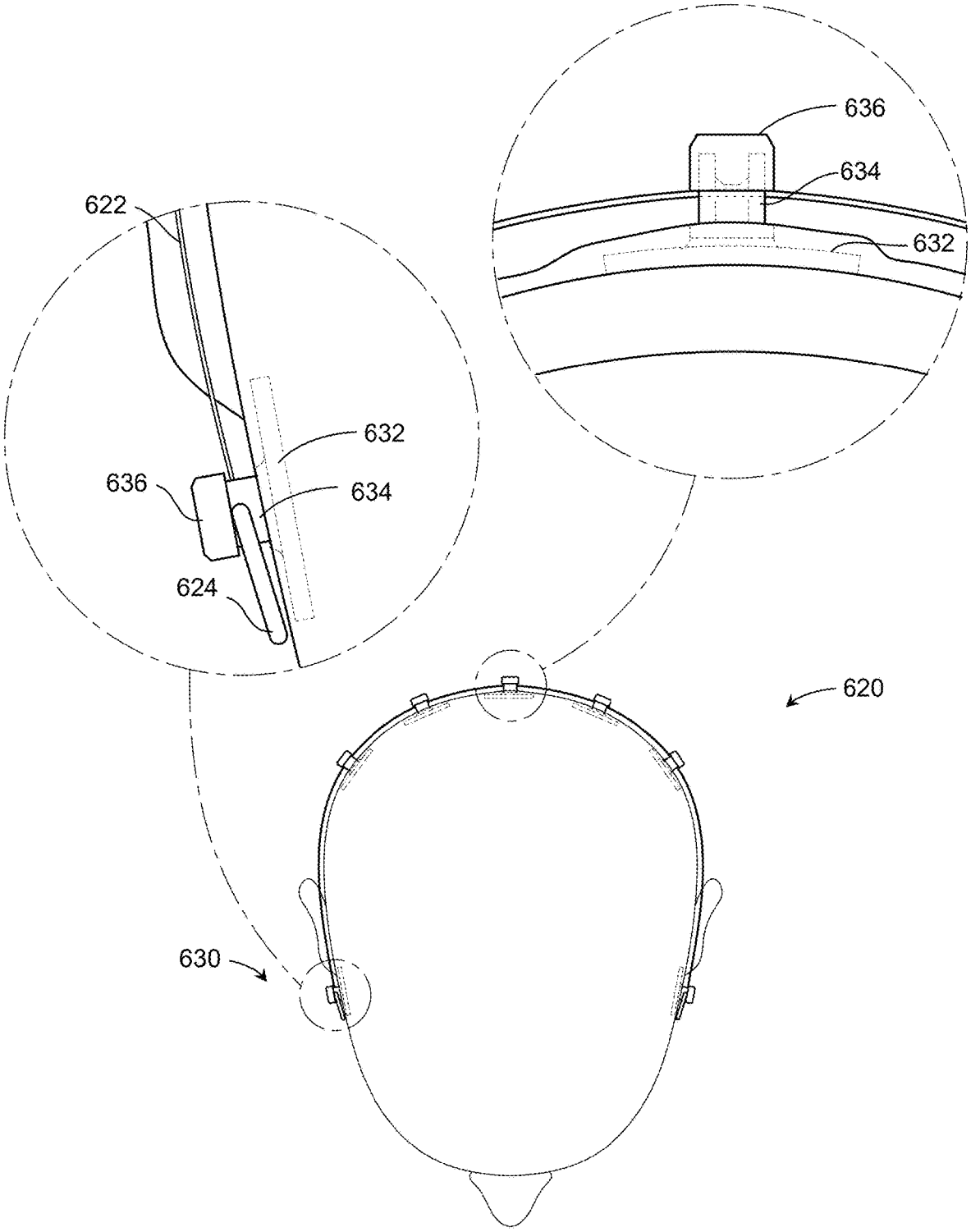
FIG. 11 is a top view of a head of a user with a plurality of implants installed about the head of the user and coupled with a base wire to form a foundation for attaching a hair extension portion thereto according to some implementations of the present disclosure.

FIG. 11 illustrates a hair extension system 600 that includes a base 620 configured to be positioned around the head of a user. The base 620 is designed to provide a secure foundation for the attachment of hair extensions, such as any of the hair extension elements described elsewhere herein (e.g., hair extension element 150, 250, 350, 550, and combinations thereof).

The base 620 includes a number of implants 630 holding a base wire 622 against the scalp of a user. While the implementation illustrated in FIG. 11 includes two implants at the temples of a user and an additional five (5) implants around the back of the head of the user, it should be understood that the number and positioning of the implants 630 can be varied as desired according to a number of parameters, for example weight of the attached hair extension element (e.g., hair extension element 150, 250, 350, 550, or combinations thereof), the elasticity of the skin of the scalp, the age of the user, the activity level of the user, etc. Although the base 620 is illustrated having implants 630 in FIG. 11, in some implementations, base 620 includes one or more implants 630, one or more implants 650, one or more implants 670, one or more implants 690, and/or combinations and variations thereof.

The base 620 includes the base wire 622, which extends around the perimeter of the user's head, providing structural support and stability for attaching the hair extension element (e.g., hair extension element 150, 250, 350, 550, or combinations thereof).

The base wire 622 is connected to an end cap 624 at each terminal end of the base wire 622, ensuring that the base wire 622 remains securely in place and does not move or shift during use. The end cap 624 serves to protect the ends of the base wire 622 and to provide a smooth, finished appearance.

The hair extension system 600 further includes additional implants 630, which are strategically positioned around the head of the user. Each implant 630 has a base 632 that is designed to be implanted below the skin of the user. The base 632 provides a stable anchor point for the implant 630. In some implementations, the base 632 is generally smooth. In some other implementations, the base 632 is generally roughened to aid in osteointegration of the implant and the skin and/or bone of the user. In some implementations, the base 632 includes a porous coating to aid in osteointegration of the implant and the skin and/or bone of the user.

Extending from the base 632 is a post 634, which protrudes through the skin and provides a point of attachment of the base wire 622 to the user. The post 634 is designed to be durable and to withstand the forces exerted through the base wire 622 by the attached hair extension element (e.g., hair extension element 150, 250, 350, 550, or combinations thereof) during daily wear by the user.

A cap 636 is removably coupled to the post 634. The cap 636 serves to secure the base wire 622 to the post 634, preventing any movement or displacement of the wire. Additionally, the cap 636 provides a smooth and aesthetically pleasing appearance, concealing the post 634 and the attachment point.

Figure 12:
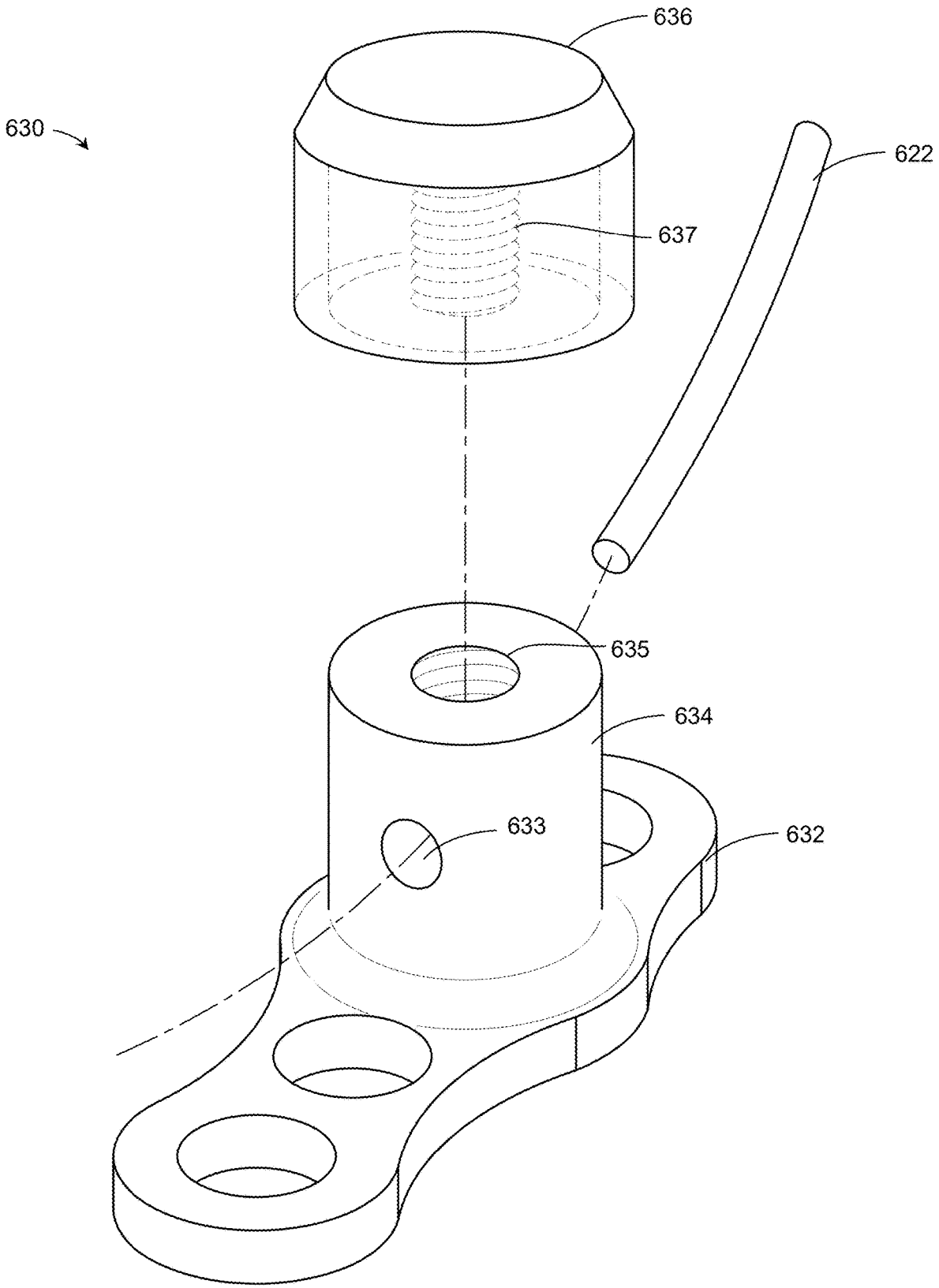
FIG. 12 is an exploded perspective view of one of the implants of FIG. 11 illustrating a path of the base wire therethrough.

Implant 630 is illustrated in exploded view in FIG. 12. A base 632 serves as the foundational structure of the implant 630 and anchors the implant 630 below the skin of the user. In some implementations, implant 630 is a subdermal implant. In some implementations, implant 630 is configured to attach to the bone of the user's scalp.

Extending from the base 632 is a post 634. The post 634 is a cylindrical extension that rises vertically from the base 632 and in some implementations, at least a portion of the post 634 extends above the skin of a user. The post 634 includes a threaded bore 635, an internal threaded cavity designed to receive and engage with a threaded shaft 637.

The post 634 includes a throughbore 633, which is a passageway that allows the base wire 622 to pass through. The throughbore 633 is strategically positioned to ensure the base wire 622 is threaded through the implant 630 without obstruction while positioning the base wire 622 strategically close to the scalp of the user, to provide a discreet fit mimicking the appearance of natural hair while providing comfort to the user. In some implementations of the present disclosure, the posts 634 are sized and shaped to protrude from the skin, when implanted/installed, between about 0.5 millimeters and about 5 millimeters. In some implementations, the throughbore 633 of the post is sized and shaped to permit a wire therethrough having a diameter between about 0.1 millimeters and about 1.0 millimeters The cap 636 is designed to thread into the post 634. The cap 636 is equipped with a threaded shaft 637 that corresponds to the threaded bore 635 within the post 634. When the cap 636 is screwed onto the post 634, the threaded shaft 637 engages with the threaded bore 635, securing the cap 636 in place. This mechanism ensures that the cap 636 remains firmly attached to the post 634, providing a secure closure. Any other removable or non-removable connection between the cap 636 and the post 634 is contemplated (e.g., a snap connection, a welded connection, a press-fit connection, a Morse taper connection, etc., or any other connection or any combination thereof).

When the cap 636 is in a coupled configuration, the threaded shaft 637 comes into contact with the base wire 622 and hold base wire 622 firmly in position. This configuration prevents the base wire 622 from moving relative to the implant 630, ensuring a stable and secure attachment. Base wire 622 is designed to be positioned through the throughbore 633 of the base 632 of implants 630, or similar implants (described below) to secure a respective hair extension element (e.g., hair extension element 150, 250, 350, 550, or combinations thereof) to a user.

Figure 13:
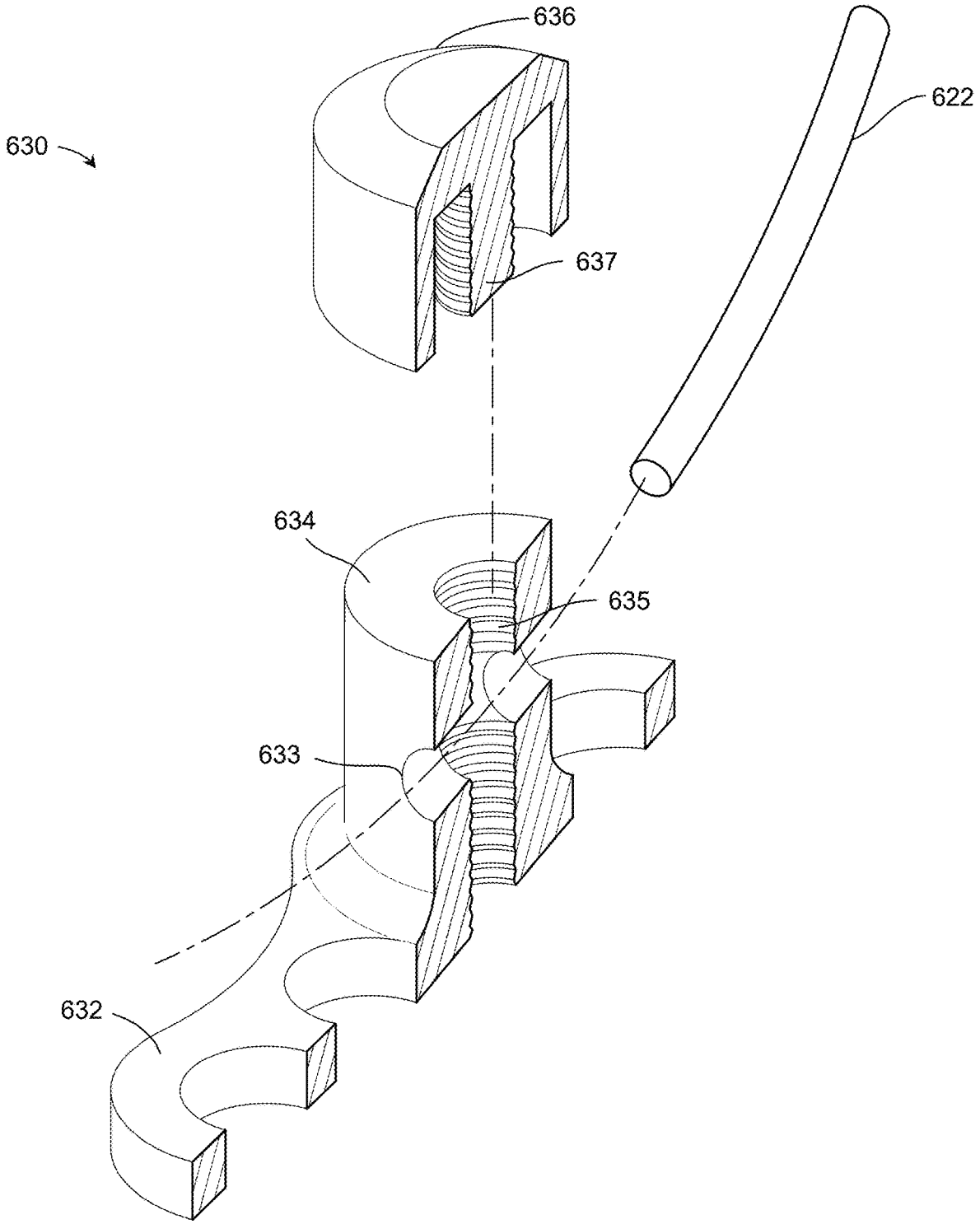
FIG. 13 is a cross-sectional perspective view of the implant of FIG. 12.

FIG. 13 illustrates an exploded, sectional view of the implant 630 in which the base wire 622 is positioned through the throughbore 633. The throughbore 633 extends into and intersects with at least a portion of the threaded bore 635. When the cap 636 is in a coupled configuration, as described above, the threaded shaft 637 extends towards, and comes into contact with a portion of the base wire 622, holding the base wire 622 securely in place with respect to the implant 630.

Figure 14A:
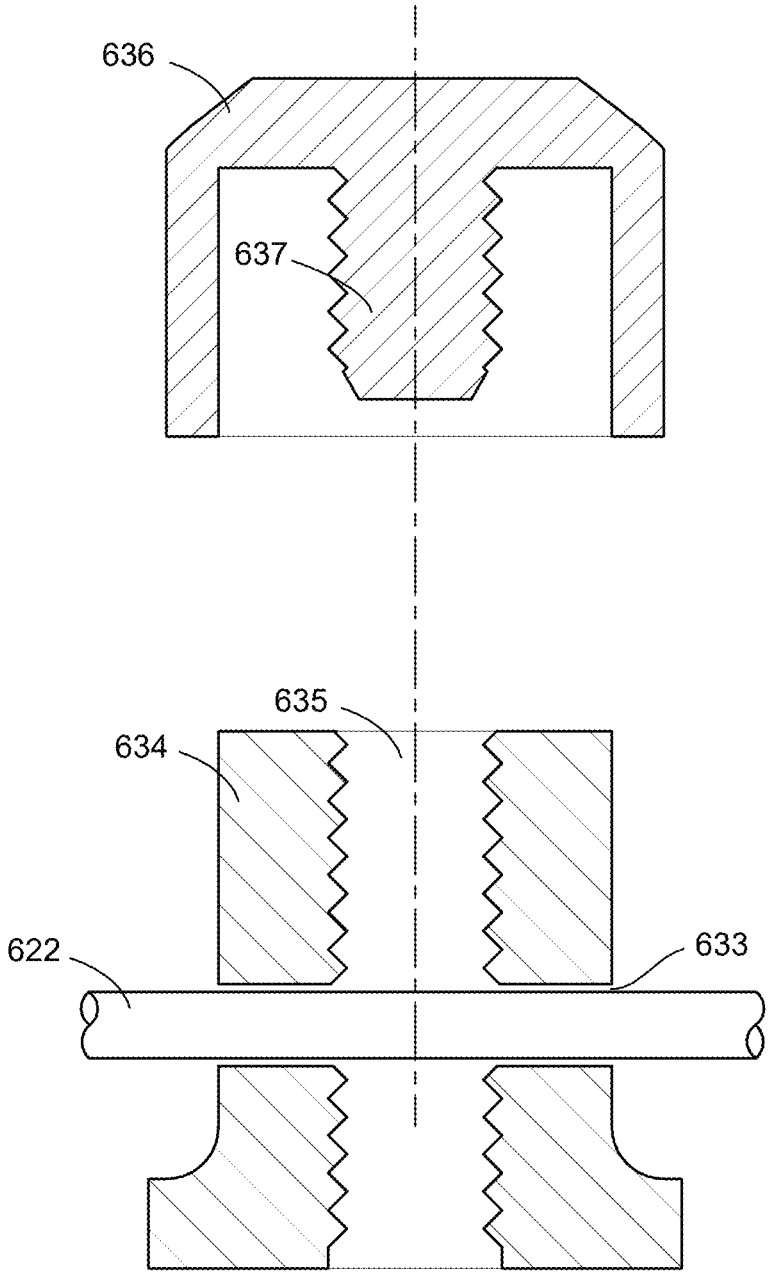
FIG. 14A is a cross-sectional side of the implant of FIG. 12 in a first configuration with a cap decoupled from a post of the implant.
Figure 14B:
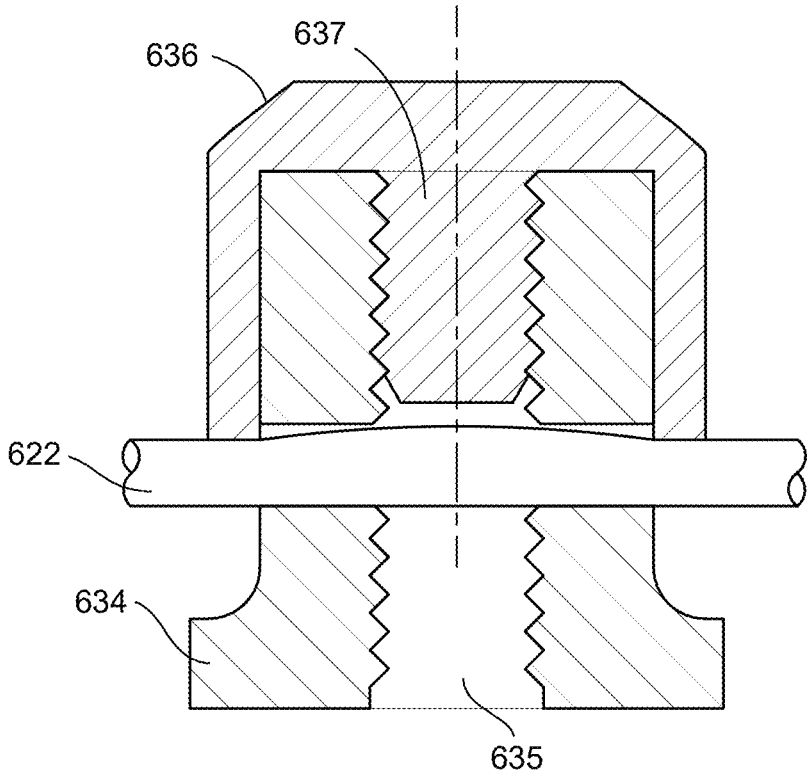
FIG. 14B is a cross-sectional side of the implant of FIG. 12 in a second configuration with the cap coupled to the post and engaging the wire.

In that regard, FIGS. 14A-14B illustrates the implant 630 in a decoupled configuration and coupled configuration, respectively. In FIG. 14A, the cap 636 is in a decoupled configuration and although the base wire 622 is already positioned through the throughbore 633, the base wire 622 is free to move with respect to the implant 630. In contrast, in FIG. 14B, the cap 636 is in a coupled configuration and the threaded shaft 637 has come into contact with a portion of the base wire 622 to securely hold the base wire 622 in place with respect to the implant 630.

Figure 15:
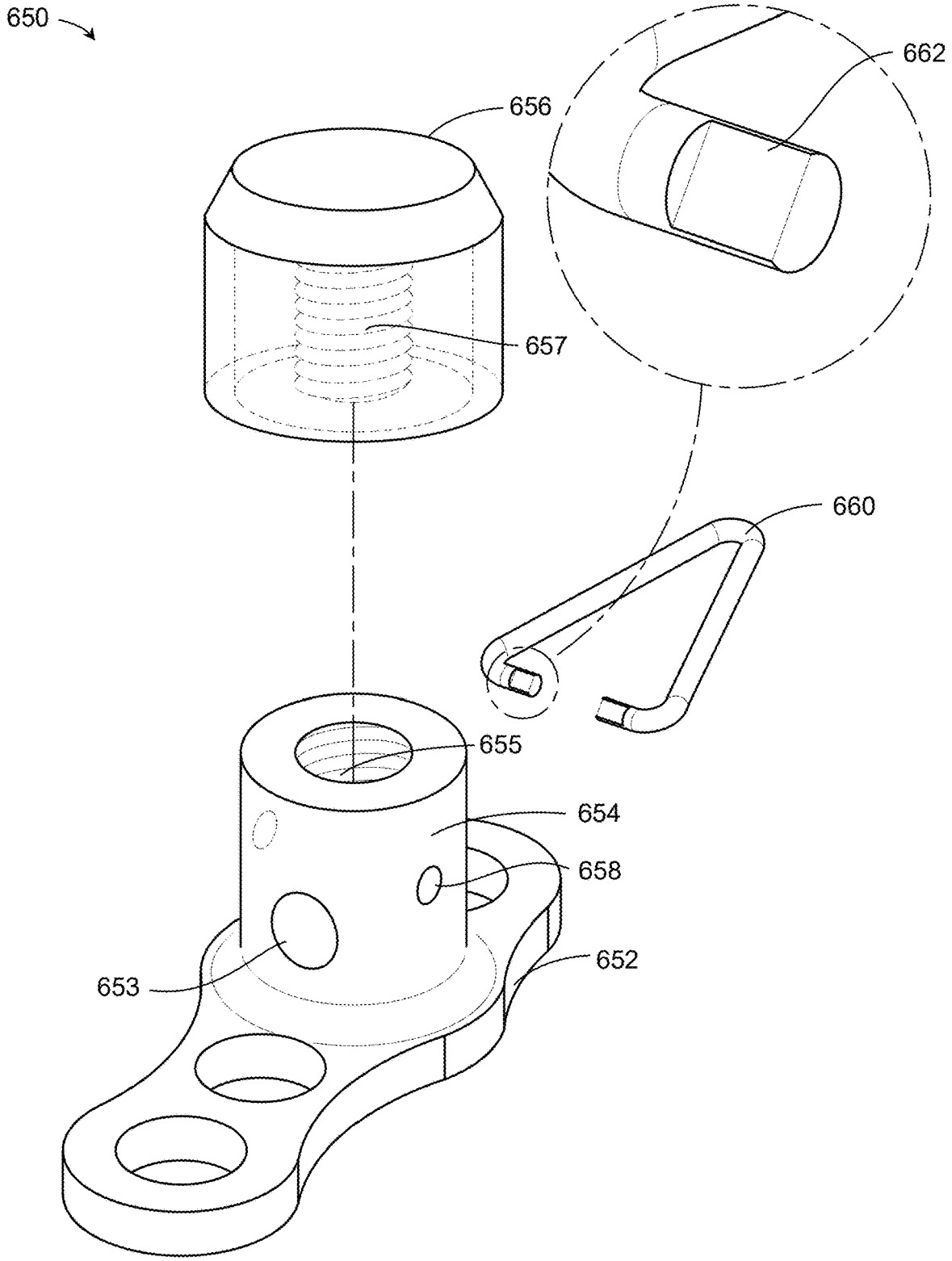
FIG. 15 is an exploded perspective view of another one of the implants of FIG. 11 positioned at the end of the foundation according to some implementations of the present disclosure.

In some implementations, the base 620 uses one or more implants 650, as illustrated in FIG. 15. The implants 650 are placed near the respective temples of a user. When a respective hair extension element (e.g., one of hair extension elements 150, 250, 350, 550, or combinations thereof) is coupled to the base 620, portions of the implant 650 are configured to closely hold the ends of the coupled hair extension element against the user to keep the hair extension element secure to the user.

The base 652 of the implant 650 is configured to be anchored into the user in a similar manner as was described with respect to the implant 630 and be positioned under the skin of the user when implanted. In some implementations, the base 652 is generally smooth. In some other implementations, the base 652 is generally roughened to aid in osteointegration of the implant and the skin and/or bone of the user. In some implementations, the base 652 includes a porous coating to aid in osteointegration of the implant and the skin and/or bone of the user.

Extending from the base 652 is a post 654. The post 654 includes a throughbore 653, which allows for the passage of the base wire 622. The post 654 also includes a threaded bore 655, which at least partially intersects with the throughbore 653. The threaded bore 655 provides a secure and adjustable connection for the cap 656, which is configured to be removably coupled to the post 654 by a connection between the threaded shaft 657 and the threaded bore 655. In some implementations of the present disclosure, the posts 654 are sized and shaped to protrude from the skin, when implanted/installed, between about 0.5 millimeters and about 5 millimeters. In some implementations, the throughbore 653 of the post is sized and shaped to permit a wire therethrough having a diameter between about 0.1 millimeters and about 1.0 millimeters The implant 650 also features a biasing tab 660. When the cap 656 is in a coupled configuration with the base 652, the biasing tab 660 is configured to rotate towards the scalp of the user. The biasing tab 660 is positioned and configured to be attached to respective ends of the hair extension element (e.g., any of the hair extension elements described herein, and combinations and variations thereof) and hold the ends of the hair extension element closely to the user for increased security and comfort. Biasing tab 660 includes two arms with ends that are configured to fit into respective apertures 658 of the implant 650, located in post 654. Located at the ends of the two arms is a corresponding cam 662. In some implementations, the biasing tab 660 aids in keeping the hair extension within about 1 millimeter to about 3 millimeters from the scalp of the user. In some implementations, the biasing tab 660 aids in keeping the hair extension within about 2 millimeters from the scalp of the user.

While the biasing tab 660 is shown as having a generally triangular shape, the biasing tab 660 can have any shape, such as, for example, a rectangular shape, a rounded triangular shape, a square shape, a circular shape, an ovular shape, etc., or any combination thereof. The corner flap can be made of any suitable material, such as, for example, plastic, metal, rubber, silicone, or any combination thereof. In some implementations, the biasing tab 660 is about 1 millimeter wide to about 5 millimeters wide and about 3 millimeters long to about 8 millimeters long. In some implementations, the biasing tabs 660 are positioned between about 0.5 inches and 2 inches from the natural hairline of the user. In some implementations, the corner implants are positioned between about 1.0 inches and 2.0 inches from the natural hairline of the user.

Figure 16A:
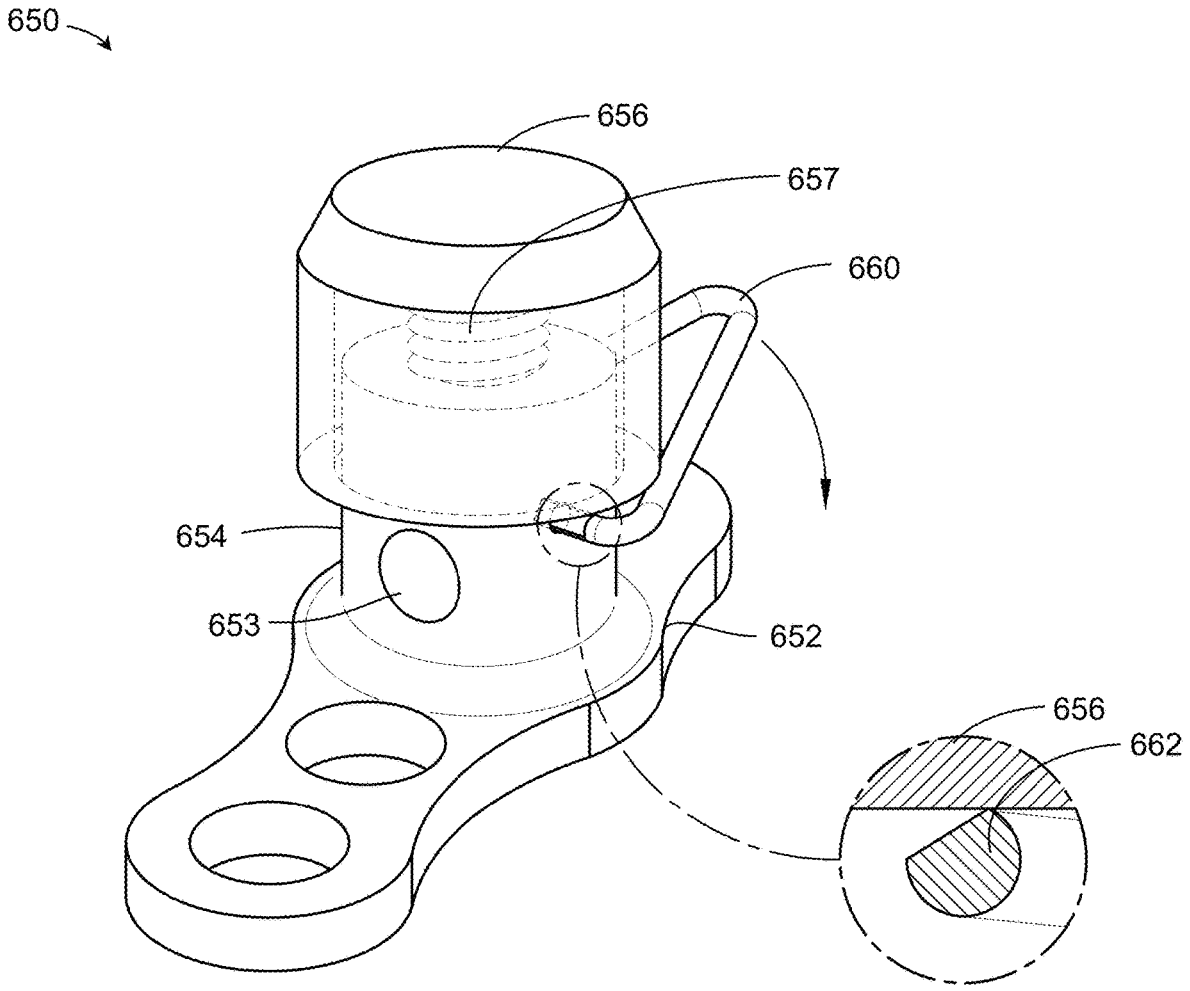
FIG. 16A is an assembled perspective view of the implant of FIG. 15 in a first configuration with a cap partially coupled to a post of the implant.
Figure 16B:
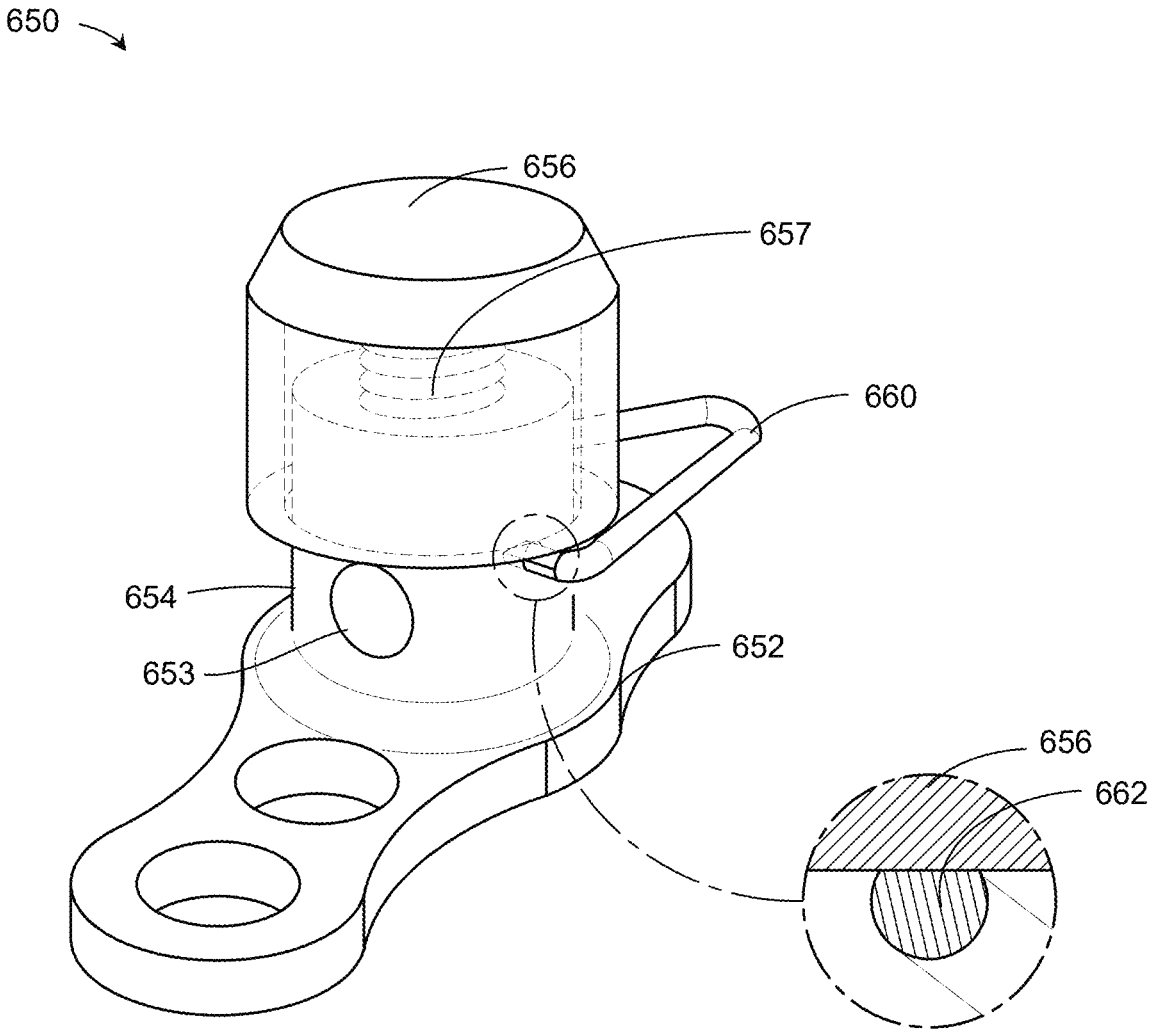
FIG. 16B is an assembled perspective view of the end implant of FIG. 15 in a second configuration with a cap further coupled to the post of the implant.
Figure 17:
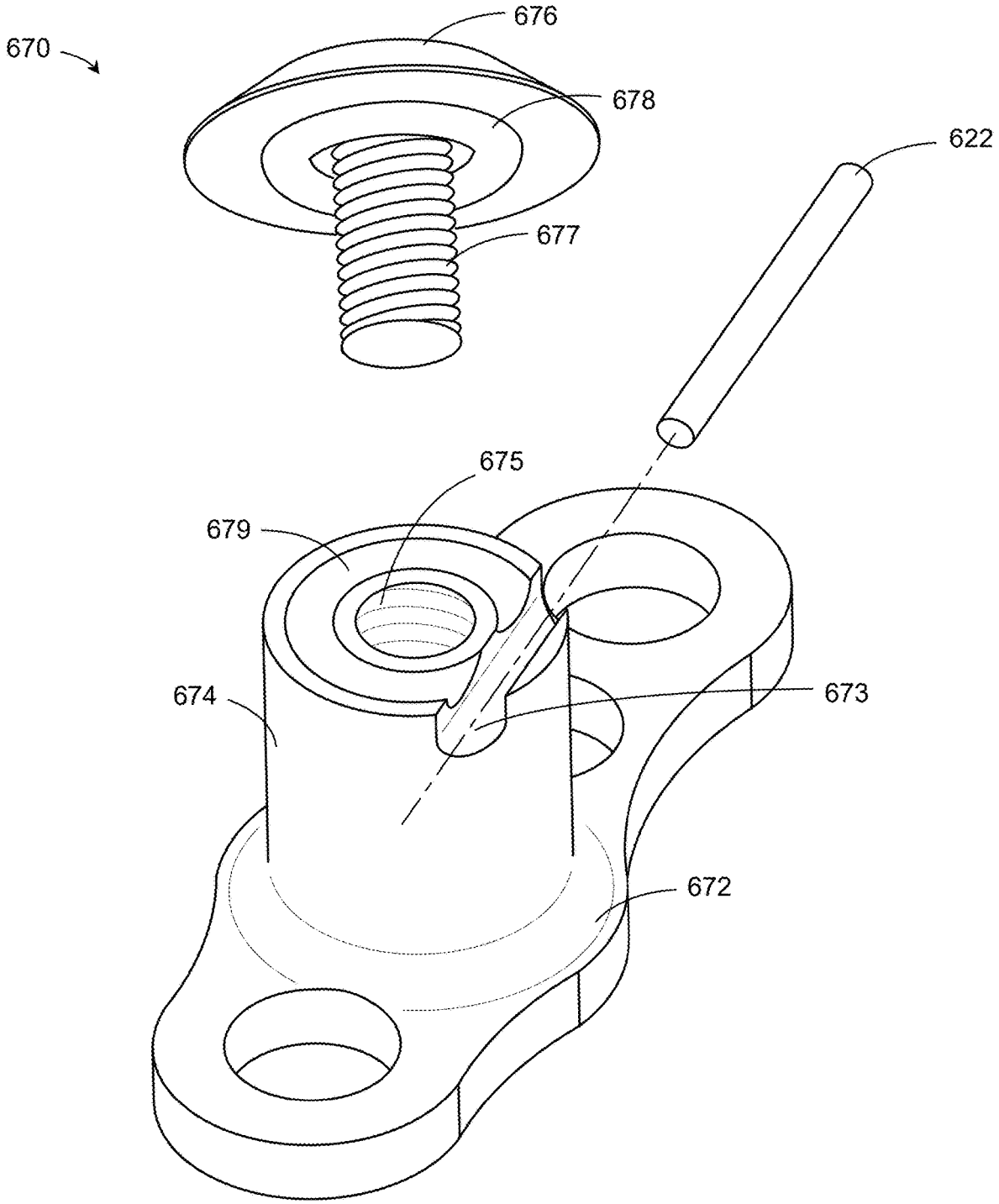
FIG. 17 is an exploded perspective view of an implant configured to mate with a wire according to some implementations of the present disclosure.

FIGS. 16A-16B illustrates a sequence in which the cam 662 moves from an uncoupled configuration in FIG. 16A to a coupled configuration in FIG. 16B. According to some implementations, the arms of the biasing tab 660 fit into the respective apertures 658, and the cams 662 position the biasing tab 660 at an angle away from the scalp of the user when the cap 656 is uncoupled to the base 652 as illustrated in FIG. 16A. In contrast, when the cap 656 is in a coupled configuration (e.g., when the threaded shaft 657 is fully threaded into the threaded bore 655), the threaded shaft 657 comes into contact with the cams 662, causing the biasing tab 660 to pivot towards the scalp of the user, as illustrated in FIG. 16B.

Figure 18:
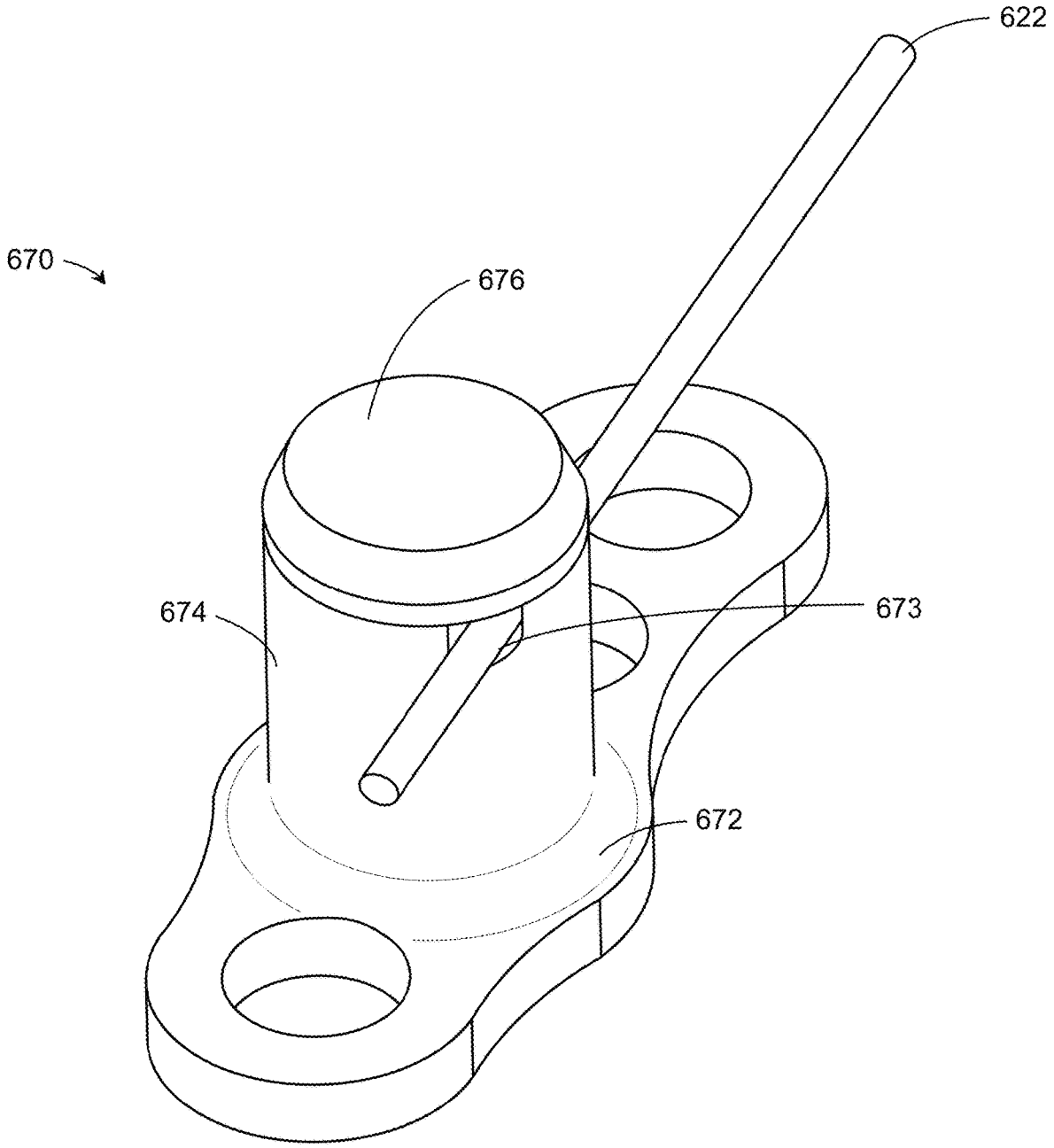
FIG. 18 is an assembled perspective view of the implant of FIG. 17.

In some implementations, the base 620 uses one or more implants 670. The implant 670 is similar to implant 630 except that the base wire 622 is configured to be positioned through a throughbore notch 673. Throughbore notch 673, in combination with a gasket 678 of cap 676, form the aperture through which the base wire 622 is configured to be positioned. The throughbore notch 673 is formed within mating surface 679. To detachably couple the cap 676 to base 672 of the implant 670, the threaded shaft 677 is screwed into the threaded bore 675 until the gasket 678 comes into contact with the base wire 622 while the base wire 622 is positioned within throughbore notch 673. In such a configuration, the base wire 622 is held securely and firmly such that base wire 622 cannot move with respect to the implant 670, as illustrated in FIG. 18.

Figure 19B:
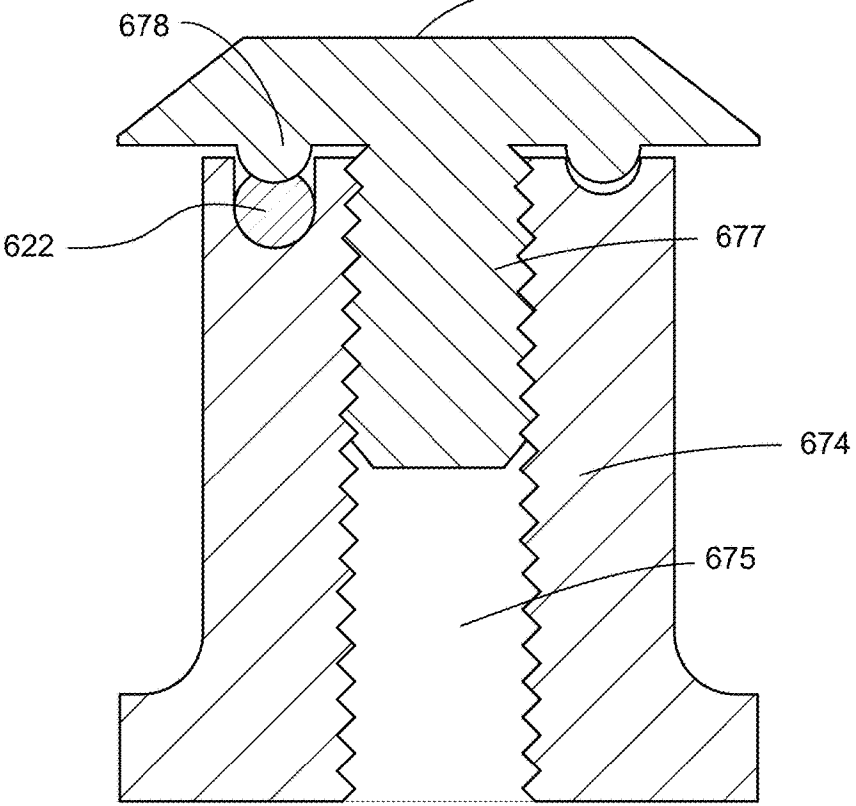
FIG. 19B is a cross-sectional side of the implant of FIG. 17 in a second configuration with the cap coupled to the post and engaging the wire.
Figure 19A:
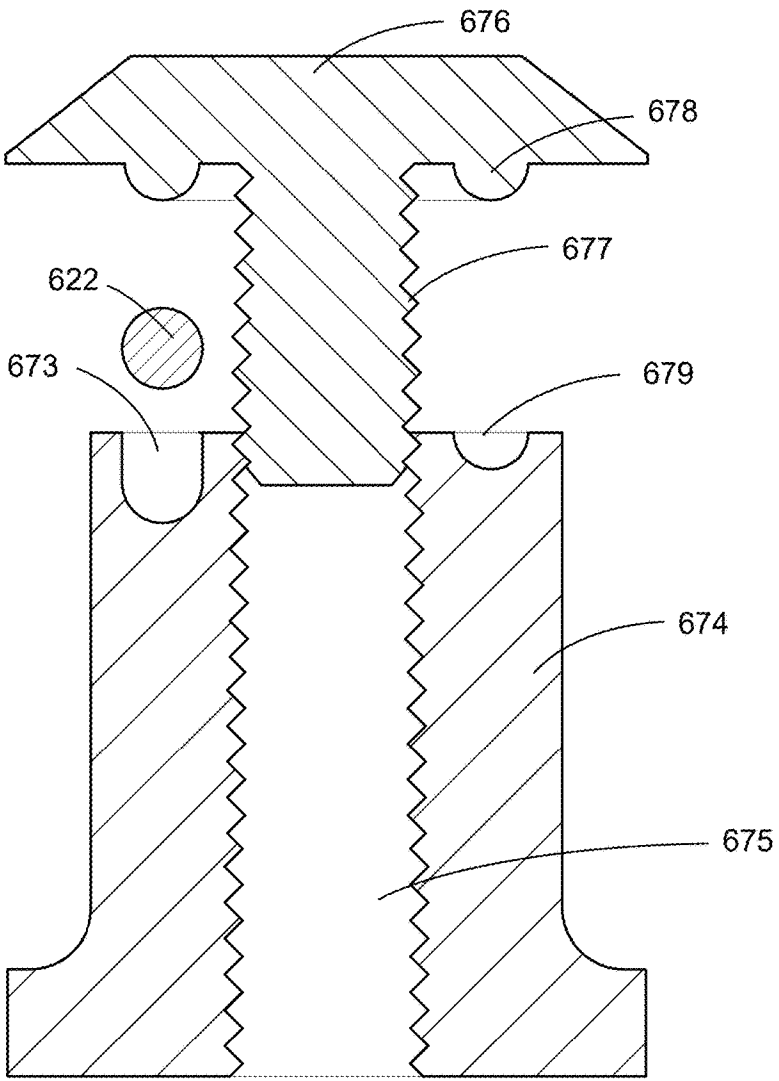
FIG. 19A is a cross-sectional side of the implant of FIG. 17 in a first configuration with a cap decoupled from a post of the implant.
Figure 20:
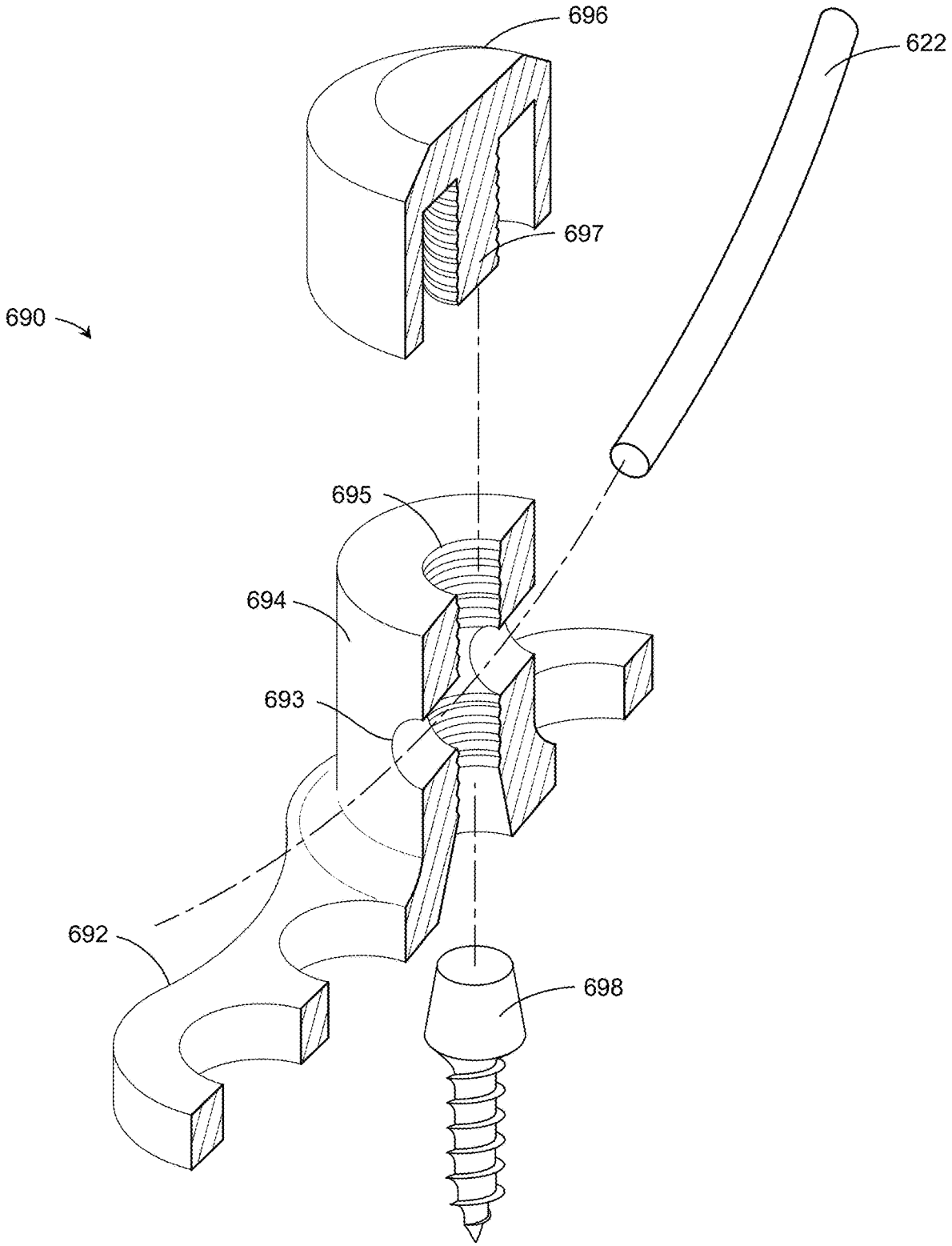
FIG. 20 is an exploded perspective view of an implant configured to mate with a wire according to some implementations of the present disclosure.

FIGS. 19A and 19B illustrate a cross-sectional view of the implant 670 in both a decoupled (FIG. 19A) and coupled (FIG. 19B) configuration. The cap 676 is designed to be removably coupled to the post 674. The cap 676 features the threaded shaft 677 that engages with the threaded bore 675 of the post 674. The threaded connection between the threaded bore 675 and the threaded shaft 677 allows for easy removal and reattachment of the cap 676 when necessary, facilitating maintenance and adjustments. In a coupled configuration, the base wire 622 is held in between the throughbore notch 673 of the base 672, and the gasket 678 of the cap 676 in a similar manner as described with respect to the implant 630 and the implant 650. In some implementations, the base 672 is generally smooth. In some other implementations, the base 672 is generally roughened to aid in osteointegration of the implant and the skin and/or bone of the user. In some implementations, the base 672 includes a porous coating to aid in osteointegration of the implant and the skin and/or bone of the user. In some implementations of the present disclosure, the posts 674 are sized and shaped to protrude from the skin, when implanted/installed, between about 0.5 millimeters and about 5 millimeters. In some implementations, the throughbore notch 673 of the post is sized and shaped to permit a wire therethrough having a diameter between about 0.1 millimeters and about 1.0 millimeters In some implementations, one or more implants 690 are used to attach the base 620 to a user.

The implant 690 is similar to the implant 630 in components and functionality, except that the implant 690 is coupled to the user via bone screw 698 to provide further security to the connection between the implant 690 and the user. Thus, the implant 690 is suitable for use when hair extension element being attached (e.g., one of hair extension elements 150, 250, 350, 550, or combinations thereof) is heavier (e.g., due to longer extension hair), when the skin of the user cannot hold the weight of the attached hair extension element (e.g., due to inelasticity of the skin), etc.

The implant 690 includes a base 692, which is configured to be positioned adjacent to the bone structure of a user. In some implementations, the base 692 is generally smooth. In some other implementations, the base 692 is generally roughened to aid in osteointegration of the implant and the skin and/or bone of the user. In some implementations, the base 692 includes a porous coating to aid in osteointegration of the implant and the skin and/or bone of the user.

Extending from the base 692 is a post 694. The post 694 is designed to protrude from the base 692 and provide an attachment point for other components of the implant 690. The post 694 also includes a threaded bore 695. The threaded bore 695 is configured to receive a threaded shaft 697, which is part of the cap 696.

The post 694 includes a throughbore 693, which is designed to allow the base wire 622 to pass therethrough. The throughbore 693 ensures that the base wire 622 is securely held in place, preventing any unwanted movement. In some implementations of the present disclosure, the posts 694 are sized and shaped to protrude from the skin, when implanted/installed, between about 0.5 millimeters and about 5 millimeters. In some implementations, the throughbore 693 of the post is sized and shaped to permit a wire therethrough having a diameter between about 0.1 millimeters and about 1.0 millimeters The cap 696 is designed to be removably coupled to the post 694. The cap 696 includes the threaded shaft 697 that engages with the threaded bore 695 of the post 694. When the cap 696 is screwed onto the post 694, the cap 696 acts to secure the base wire 622 in place, preventing it from moving relative to the post 694.

Additionally, the implant system 690 includes a bone screw 698. The bone screw 698 is designed to be inserted into the bone structure of a user, providing a secure anchor for the implant 690. The bone screw 698 ensures that the base 692 remains firmly attached to the bone, maintaining the stability of the implant 690 and the base wire 622.

Alternative Implementations

Implementation 1. A method comprising: coupling a substrate to a scalp of a user; and coupling a hair extension element to the substrate.

Implementation 2. The method of Implementation 1, wherein the substrate is permanently, semi-permanently, or temporarily coupled to the scalp of the user.

Implementation 3. The method of Implementation 1, wherein the coupling of the substrate to the scalp of the user includes using adhesive, one or more strips of tape, one or more hair beads, one or more clips, one or more non-dissolving threads, one or more dissolving threads, or any combination thereof.

Implementation 4. The method of Implementation 1, wherein the coupling of the substrate to the scalp of the user includes stitching, using one or more sutures, the substrate directly to the scalp of the user.

Implementation 5. The method of Implementation 1, wherein the coupling of the substrate to the scalp of the user includes sewing, using a thread, the substrate directly to a hair base.

Implementation 6. The method of Implementation 5, wherein the hair base is formed using natural hair of the user.

Implementation 7. The method of Implementation 6, wherein the hair base is further formed using a plurality of hair beads.

Implementation 8. The method of Implementation 1, wherein the substrate is a flexible sheet of material with a plurality of apertures therethrough.

Implementation 9. The method of Implementation 8, wherein the flexible sheet of material with the plurality of apertures therethrough forms a mesh.

Implementation 10. The method of Implementation 1, wherein the coupling of the hair extension element to the substrate includes removably coupling a first coupling mechanism that is fixed to the substrate to a second coupling mechanism that is fixed to the hair extension element.

Implementation 11. The method of Implementation 10, wherein the first coupling mechanism includes a first zipper portion and the second coupling mechanism includes a second zipper portion configured to be removably coupled to the first zipper portion.

Implementation 12. The method of Implementation 11, wherein the first zipper portion includes a first magnetic element, the second zipper portion includes a second magnetic element, and wherein the first magnetic element and the second magnetic element are configured to facilitate alignment of the first zipper portion with the second zipper portion when coupling the first zipper portion with the second zipper portion.

Implementation 13. The method of Implementation 10, wherein the first coupling mechanism includes a first interlocking mechanism and the second coupling mechanism includes a second interlocking mechanism configured to be removably coupled to the first interlocking mechanism.

Implementation 14. The method of Implementation 13, further comprising removably coupling a first additional coupling mechanism that is fixed to a first end portion of the substrate to a second additional coupling mechanism that is fixed to a first end portion of the hair extension element.

Implementation 15. The method of Implementation 10, wherein the first coupling mechanism includes a first elongated and flexible magnetic element and the second coupling mechanism includes a second elongated and flexible magnetic element configured to be removably coupled to the first elongated and flexible magnetic element.

Implementation 16. The method of Implementation 15, wherein the substrate includes a first alignment element and the hair extension element includes a second alignment element, wherein the first alignment element and the second alignment element are configured to facilitate alignment of corresponding ends of the first elongated and flexible magnetic element and the second elongated and flexible magnetic element when coupling the first elongated and flexible magnetic element with the second elongated and flexible magnetic element.

Implementation 17. The method of Implementation 9, wherein the coupling of the substrate to the scalp of the user includes stitching the mesh to the scalp of the user along a hair part line formed in the natural hair of the user.

Implementation 18. The method of Implementation 17, wherein the mesh has a top edge, a bottom edge, a first end portion, and a second opposing end portion, and wherein the stitching of the mesh to the scalp of the user includes making one or more vertical sutures along the top edge of the mesh between the first end portion and the second end portion.

Implementation 19. The method of Implementation 18, wherein the stitching the mesh to the scalp of the user further includes (i) making a first vertical stitch at the top edge of the first end portion, (ii) making a second vertical stitch at the bottom edge of the first end portion, (iii) making a third vertical stitch at the top edge of the second end portion, and (iv) making a fourth vertical stitch at the bottom edge of the second end portion.

Implementation 20. The method of Implementation 18, wherein the vertical stitches along the top edge of the mesh between the first end portion and the second end portion include an equidistant spacing between respective vertical stitches.

Implementation 21. The method of Implementation 20, wherein the equidistant spacing between respective vertical stitches is between ⅛ inch to 1 inch.

Implementation 22. The method of Implementation 1, wherein the coupling of the hair extension element to the substrate includes bonding the hair extension element to the substrate after the coupling of the substrate to the scalp of the user.

Implementation 23. The method of Implementation 22, wherein the bonding includes sewing, stitching, adhesive, melting, or any combination thereof.

Implementation 24. A hair extension system comprising: a substrate configured to be coupled to a scalp of a user; and a hair extension element configured to be coupled to the substrate.

Implementation 25. The system of Implementation 24, wherein the substrate is permanently, semi-permanently, or temporarily coupled to the scalp of the user.

Implementation 26. The system of Implementation 24, wherein the substrate is coupled to the scalp of the user by an adhesive, one or more strips of tape, one or more hair beads, one or more clips, one or more non-dissolving threads, one or more dissolving threads, or any combinations thereof.

Implementation 27. The system of Implementation 24, wherein the substrate is configured to be stitched, using one or more sutures, directly to the scalp of the user.

Implementation 28. The system of Implementation 24, wherein the coupling of the substrate to the scalp of the user includes sewing, using a thread, the substrate directly to a hair base.

Implementation 29. The system of Implementation 28, wherein the hair base is formed using natural hair of the user.

Implementation 30. The system of Implementation 29, wherein the hair base is further formed using a plurality of hair beads.

Implementation 31. The system of Implementation 24, wherein the substrate is a flexible sheet of material with a plurality of apertures therethrough.

Implementation 32. The system of Implementation 31, wherein the flexible sheet of material with the plurality of apertures therethrough forms a mesh.

Implementation 33. The system of Implementation 24, wherein the substrate includes a first coupling mechanism that is fixed to the substrate, the hair extension element includes a second coupling mechanism that is fixed to the hair extension element, and the first coupling mechanism is configured to be removably coupled to the second coupling mechanism.

Implementation 34. The system of Implementation 33, wherein the first coupling mechanism includes a first zipper portion and the second coupling mechanism includes a second zipper portion configured to be removably coupled to the first zipper portion.

Implementation 35. The system of Implementation 34, wherein the first zipper portion includes a first magnetic element, the second zipper portion includes a second magnetic element, and wherein the first magnetic element and the second magnetic element are configured to facilitate alignment of the first zipper portion with the second zipper portion when coupling the first zipper portion with the second zipper portion.

Implementation 36. The system of Implementation 33, wherein the first coupling mechanism includes a first interlocking mechanism and the second coupling mechanism includes a second interlocking mechanism configured to be removably coupled to the first interlocking mechanism.

Implementation 37. The system of Implementation 27, wherein the substrate includes a first additional coupling mechanism that is fixed to a first end portion of the substrate, the hair extension element includes a second additional coupling mechanism that is fixed to a first end portion of the hair extension element, wherein the first additional coupling mechanism is configured to be removably coupled to the second additional coupling mechanism.

Implementation 38. The system of Implementation 33, wherein the first coupling mechanism includes a first elongated and flexible magnetic element and the second coupling mechanism includes a second elongated and flexible magnetic element configured to be removably coupled to the first elongated and flexible magnetic element.

Implementation 39. The system of Implementation 38, wherein the substrate includes a first alignment element and the hair extension element includes a second alignment element, wherein the first alignment element and the second alignment element are configured to facilitate alignment of corresponding ends of the first elongated and flexible magnetic element and the second elongated and flexible magnetic element when coupling the first elongated and flexible magnetic element with the second elongated and flexible magnetic element.

Implementation 40. The system of Implementation 32, further comprising suture material for use in coupling the substrate to the scalp of the user along a hair part line formed in the natural hair of the user.

Implementation 41. The system of Implementation 40, further comprising thread material for use in coupling the hair extension element to the substrate.

Implementation 42. The system of Implementation 24, wherein the hair extension is bonded to the substrate.

Implementation 43. The system of Implementation 42, wherein the bond is formed using sewing, stitching, adhesive, or any combination thereof.

Implementation 44. A hair extension system comprising: a foundation including: a plurality of implants configured to be positioned about a head of a user; and a wire coupled to each of the plurality of implants; and a hair extension coupled to the foundation.

Implementation 45. The system of Implementation 44, wherein each of the plurality of implants includes a base, a post, and a cap.

Implementation 46. The system of Implementation 45, wherein the base is configured to be implanted below skin of the user and the post is configured to at least partially protrude from the skin of the user.

Implementation 47. The system of Implementation 46, wherein the post includes a throughbore configured to permit the wire to pass therethrough.

Implementation 48. The system of Implementation 47, wherein the cap is configured to be removably coupled to the post to aid in preventing the wire from moving relative to the post.

Implementation 49. The system of Implementation 45, wherein the post extends from a first surface of the base and a second opposing surface of the base is smooth, roughened, includes a porous coating, or any combination thereof.

Implementation 50. The system of Implementation 45, wherein the post extends from a first surface of the base and a fastener extends from a second opposing surface of the base, the fastener being configured to aid in securing the implant to a skull of the user.

Implementation 51. The system of Implementation 44, wherein the hair extension is sown to the foundation using one or more threads.

Implementation 52. The system of Implementation 45, wherein the plurality of implants includes two corner implants and one or more central implants, and wherein each of the corner implants further includes a corner flap.

Implementation 53. The system of Implementation 52, wherein corner flap is pivotably coupled to the post.

Implementation 54. The system of Implementation 52, wherein corner flap is fixedly coupled to the post.

Implementation 55. The system of Implementation 52, wherein corner flap is pivotably coupled to the post such that when the cap is removably coupled to the post, the cap aids in biasing the corner flap towards a scalp of the user.

Implementation 56. A hair extension system comprising: a foundation including: a first implant configured to be positioned adjacent to a first ear of a user; a second implant configured to be positioned adjacent to a second ear of the user; a loop piercing configured to be positioned between the first implant and the second implant; and a wire coupled to the first implant, the second implant, and the loop piercing; and a hair extension coupled to the foundation.

Implementation 57. The system of Implementation 56, wherein the first implant includes a first base, a first post, and a first cap, the second implant includes a second base, a second post, and a second cap.

Implementation 58. The system of Implementation 57, wherein the first base is configured to be implanted below skin of the user such that the first post is configured to at least partially protrude from the skin of the user, and wherein the second base is configured to be implanted below skin of the user such that the second post is configured to at least partially protrude from the skin of the user, and wherein the loop piercing is configured to be coupled to the skin of the user such that a first portion of the loop piercing is below the skin of the user and a second portion of the loop piercing is outside the user.

Implementation 59. The system of Implementation 58, wherein the loop piercing and the skin of the user form a throughbore configured to permit the wire to pass therethrough.

Implementation 60. The system of Implementation 57, wherein the first implant includes a first corner flap and the second implant includes a second corner flap.

Implementation 61. The system of Implementation 60, wherein the first corner flap is pivotably coupled to the first post the second corner flap is pivotably coupled to the second post.

Implementation 62. The system of Implementation 60, wherein the first corner flap is pivotably coupled to the first post such that when the first cap is removably coupled to the first post, the first cap aids in biasing the first corner flap towards a scalp of the user, and wherein the second corner flap is pivotably coupled to the second post such that when the second cap is removably coupled to the second post, the second cap aids in biasing the second corner flap towards the scalp of the user.

Implementation 63. A hair extension system comprising: a foundation configured to be coupled about a portion of a head of a user, the foundation including: a first substrate with a first surface that is configured to face the head of the user and a second opposing surface; and a first portion of an interlocking mechanism protruding from the second opposing surface of the first substrate; and a hair extension configured to be removably coupled to the foundation, the hair extension including: extension hair bundled together; a second substrate with a first surface that is configured to face the extension hair and a second opposing surface; and a second portion of the interlocking mechanism protruding from the second opposing surface of the second substrate.

Implementation 64. The system of Implementation 63, wherein the foundation is configured to be taped to hair of the user to aid in maintaining a connection of the foundation with the head of the user.

Implementation 65. The system of Implementation 63, wherein the foundation is configured to be sewn to hair of the user to aid in maintaining a connection of the foundation with the head of the user.

Implementation 66. The system of Implementation 63, wherein the foundation is configured to be attached to one or more implants in the head of the user.

Implementation 67. The system of Implementation 63, wherein the foundation is configured to be attached to one or more loop piercings coupled to the head of the user.

Implementation 68. A hair extension system comprising: a foundation configured to be coupled about a portion of a head of a user, the foundation including: a first substrate; and a first portion of a zipper mechanism coupled to the first substrate; and a hair extension configured to be removably coupled to the foundation, the hair extension including: a second substrate; extension hair bundled together and coupled to the second substrate; and a second portion of the zipper mechanism coupled to the second substrate.

Implementation 69. The system of Implementation 68, wherein the foundation is configured to be taped to hair of the user to aid in maintaining a connection of the foundation with the head of the user.

Implementation 70. The system of Implementation 68, wherein the foundation is configured to be sewn to hair of the user to aid in maintaining a connection of the foundation with the head of the user.

Implementation 71. The system of Implementation 68, wherein the foundation is configured to be attached to one or more implants in the head of the user.

Implementation 72. The system of Implementation 68, wherein the foundation is configured to be attached to one or more loop piercings coupled to the head of the user.

Implementation 73. The system of Implementation 68, wherein the zipper mechanism includes a zipper pull configured to aid in securing the second portion of the zipper mechanism to the first portion of the zipper mechanism, thereby coupling the hair extension to the foundation.

Implementation 74. The system of Implementation 73, further comprising a bundle of hair coupled to the zipper pull to aid in camouflaging the zipper pull when hanging relative to the extension hair.

Implementation 75. The system of Implementation 73, wherein the zipper pull is removably coupled to the second portion of the zipper mechanism or the first portion of the zipper mechanism, thereby permitting the zipper pull to be decoupled from the foundation and the hair extension when the second portion of the zipper mechanism is secured to the first portion of the zipper mechanism.

Implementation 76. The system of Implementation 68, wherein the zipper mechanism includes metal zipper teeth, plastic zipper teeth, or a combination thereof.

Implementation 77. An end clip configured to be used in a hair extension system, the end clip comprising: a base having a first portion and a second portion with a necked portion between the first portion and the second portion; and a plurality of fingers extending from the second portion of the base.

Implementation 78. The end clip of Implementation 77, wherein the base includes a first aperture in the first portion of the base and second aperture in the second portion of the base.

Implementation 79. The end clip of Implementation 78, wherein the base is configured to be folded at the necked portion such that the first aperture aligns with the second aperture.

Implementation 80. The end clip of Implementation 79, wherein a first surface of the base is coated with silicone.

One or more elements or aspects or steps, or any portion (s) thereof, from one or more of any of the above implementations and/or below claims can be combined with one or more elements or aspects or steps, or any portion(s) thereof, from one or more of any of the other above implementations and/or below claims or combinations thereof, to form one or more additional implementations and/or claims of the present disclosure.

While the present disclosure has been described with reference to one or more particular implementations, those skilled in the art will recognize that many changes may be made thereto without departing from the spirit and scope of the present disclosure. Each of these implementations and obvious variations thereof is contemplated as falling within the spirit and scope of the present disclosure. It is also contemplated that additional implementations according to aspects of the present disclosure may combine any number of features from any of the implementations described herein.

What is claimed is:

1. A hair extension system comprising:

a base configured to be coupled to a scalp of a user, the base including:

a base substrate having a first base end portion, an opposing second base end portion, and a central base portion extending from the first base end portion to the second base end portion;

a first base end coupling mechanism fixed to the first base end portion of the base substrate;

a second base end coupling mechanism fixed to the second base end portion of the base substrate; and a first elongated coupling mechanism fixed along an entire length of the central base portion of the base substrate; and a hair extension element configured to be coupled to the base, the hair extension element including:

an extension substrate having a first extension end portion, an opposing second extension end portion, and a central extension portion extending from the first extension end portion to the second extension end portion;

a first extension end coupling mechanism fixed to the first extension end portion of the extension substrate, the first extension end coupling mechanism being configured to be coupled to the first base end coupling mechanism to aid in securing the first extension end portion of the extension substrate to the first base end portion of the base substrate;

a second extension end coupling mechanism fixed to the second opposing extension end portion of the extension substrate, the second extension end coupling mechanism being configured to be coupled to the second base end coupling mechanism to aid in securing the second extension end portion of the extension substrate to the second base end portion of the base substrate; and a second elongated coupling mechanism fixed along an entire length of the central extension portion of the extension substrate, the second elongated coupling mechanism being configured to be coupled to the first elongated coupling mechanism to aid in securing the central extension portion of the extension substrate to the central base portion of the base substrate.

2. The system of claim 1, wherein the first elongated coupling mechanism includes a first zipper portion and the second elongated coupling mechanism includes a second zipper portion configured to be removably coupled to the first zipper portion.

3. The system of claim 2, wherein the first zipper portion includes a first magnetic element, the second zipper portion includes a second magnetic element, and wherein the first magnetic element and the second magnetic element are configured to facilitate alignment of the first zipper portion with the second zipper portion when coupling the first zipper portion with the second zipper portion.

4. The system of claim 1, wherein the first elongated coupling mechanism includes a first interlocking mechanism and the second elongated coupling mechanism includes a second interlocking mechanism configured to be removably coupled to the first interlocking mechanism.

5. The system of claim 4, wherein the first interlocking mechanism defines a channel and the second interlocking mechanism includes a protrusion configured to fit at least partially within the defined channel of the first interlocking mechanism.

6. The system of claim 4, wherein the first interlocking mechanism includes a first protrusion and defines a first channel and wherein the second interlocking mechanism includes a second protrusion and defines a second channel, wherein the first protrusion is configured to fit at least partially within the defined second channel of the second interlocking mechanism and the second protrusion is configured to fit at least partially within the defined first channel of the first interlocking mechanism.

7. The system of claim 6, wherein the first base end coupling mechanism is a first portion of a snap fastener and wherein the first extension end coupling mechanism is a second corresponding portion of the snap fastener.

8. The system of claim 7, wherein the first portion of the snap fastener is positioned between the first channel and the first protrusion and wherein the second corresponding portion of the snap fastener is positioned between the second channel and the second protrusion.

9. The system of claim 6, wherein the first base end coupling mechanism is positioned between the defined first channel and the first protrusion and wherein the first extension end coupling mechanism is positioned between the defined second channel and the second protrusion.

10. The system of claim 4, wherein the second interlocking mechanism is configured to be removably coupled to the first interlocking mechanism via an interference fit.

11. The system of claim 1, wherein the first elongated coupling mechanism includes a first flexible magnetic element and the second elongated coupling mechanism includes a second flexible magnetic element configured to be removably coupled to the first elongated and flexible magnetic element.

12. The system of claim 1, wherein the base is configured to be coupled to the scalp of the user using adhesive, one or more strips of tape, one or more hair beads, one or more clips, one or more non-dissolving threads, one or more dissolving threads, or any combination thereof.

13. The system of claim 1, wherein the base further includes a strip of tape coupled to a first surface of the base substrate, the first surface of the base substrate being configured to face the scalp of the user.

14. The system of claim 1, wherein the base is configured to be stitched, using one or more sutures, directly to the scalp of the user.

15. The system of claim 1, wherein the base is configured to be coupled indirectly to the scalp of the user via a hair base formed using natural hair of the user.

16. The system of claim 15, wherein the hair base is further formed using a plurality of hair beads.

17. The system of claim 1, wherein the base further includes a flexible sheet of material with a plurality of apertures therethrough forming a mesh, the base substrate being fixed to the flexible sheet of material.

18. The system of claim 17, further comprising suture material for use in coupling the flexible sheet of material of the base to the scalp of the user along a hair part line formed in natural hair of the user.

* * * * *